US011452653B2

(12) United States Patent
Hidler

(10) Patent No.: US 11,452,653 B2
(45) Date of Patent: Sep. 27, 2022

(54) GAIT TRAINING VIA PERTURBATIONS PROVIDED BY BODY-WEIGHT SUPPORT SYSTEM

(71) Applicant: Joseph Hidler, Ashburn, VA (US)

(72) Inventor: Joseph Hidler, Ashburn, VA (US)

( * ) Notice: Subject to any disclaimer, the term of this patent is extended or adjusted under 35 U.S.C. 154(b) by 430 days.

(21) Appl. No.: 16/748,033

(22) Filed: Jan. 21, 2020

(65) Prior Publication Data

US 2020/0230005 A1 Jul. 23, 2020

Related U.S. Application Data

(60) Provisional application No. 62/795,186, filed on Jan. 22, 2019.

(51) Int. Cl.
*A61G 7/10* (2006.01)
*A61H 3/00* (2006.01)

(52) U.S. Cl.
CPC ..... *A61G 7/1065* (2013.01); *A61G 7/1001* (2013.01); *A61G 7/1015* (2013.01); *A61G 7/1042* (2013.01); *A61H 3/008* (2013.01); *A61G 2200/36* (2013.01); *A61H 2003/007* (2013.01); *A61H 2201/5061* (2013.01); *A61H 2201/5064* (2013.01)

(58) Field of Classification Search
CPC .. A61G 7/1065; A61G 7/1063; A61G 7/1015; A61G 7/1013; A61G 7/1042; A61G 7/104; A61G 2200/36; A61H 3/008; A61H 2003/007; A61H 2201/5064; A61H 2201/5058
USPC ..... 5/85.1, 83.1, 81.1 R; 601/5
See application file for complete search history.

(56) References Cited

U.S. PATENT DOCUMENTS

| | | | |
|---|---|---|---|
| 2,086,795 | A | 7/1937 | Frank |
| 2,871,915 | A | 2/1959 | Hogan |
| 3,031,540 | A | 4/1962 | Cole, Jr. |
| 3,204,954 | A | 9/1965 | Scannell |
| 3,316,362 | A | 4/1967 | Mayo et al. |

(Continued)

FOREIGN PATENT DOCUMENTS

| | | | |
|---|---|---|---|
| DE | 3300202 | A1 | 7/1984 |
| DE | 19833010 | A1 | 1/2000 |

(Continued)

OTHER PUBLICATIONS

Notification of Transmittal of International Preliminary Report on Patentability including International Preliminary Report on Patentability for International Application No. PCT/US2020/014369 dated Jul. 27, 2021, 9 pages.

(Continued)

*Primary Examiner* — Robert G Santos
(74) *Attorney, Agent, or Firm* — Edell, Shapiro & Finnan, LLC

(57) ABSTRACT

A body-weight support system that allows individuals with severe gait impairments to practice over-ground walking in a safe, controlled manner is disclosed. The system includes a body-weight support system that rides along a driven trolley and can be controlled in response to the movement of the subject using the system. They system is also configured to apply strong, yet brief perturbations to a subject as they are stationary or performing a dynamic task, such as walking, side stepping, etc., via the trolley of a body weight support system.

20 Claims, 63 Drawing Sheets

(56) References Cited

U.S. PATENT DOCUMENTS

| | | | | |
|---|---|---|---|---|
| 3,571,532 | A | 3/1971 | Falque | |
| 3,780,663 | A | 12/1973 | Pettit | |
| 3,892,299 | A | 7/1975 | Killburg | |
| 3,985,082 | A | 10/1976 | Barac | |
| 4,164,350 | A | 8/1979 | Zeijdel et al. | |
| 4,229,136 | A | 10/1980 | Panissidi | |
| 4,243,147 | A | 1/1981 | Twitchell et al. | |
| 4,252,063 | A | 2/1981 | Brooks, Jr. | |
| 4,372,452 | A | 2/1983 | McCord | |
| 4,445,502 | A | 5/1984 | Swan et al. | |
| 4,781,665 | A | 11/1988 | Walker | |
| 4,825,769 | A | 5/1989 | Watts | |
| 4,907,571 | A | 3/1990 | Futakami | |
| 4,911,426 | A | 3/1990 | Scales | |
| 4,973,044 | A | 11/1990 | Jones | |
| 5,064,191 | A | 11/1991 | Johnson | |
| 5,158,516 | A | 10/1992 | Johnson | |
| 5,190,507 | A | 3/1993 | Iijima | |
| 5,273,502 | A | 12/1993 | Kelsey et al. | |
| 5,333,333 | A | 8/1994 | Mah | |
| 5,337,908 | A | 8/1994 | Beck, Jr. | |
| 5,372,561 | A | 12/1994 | Lynch | |
| 5,419,260 | A | 5/1995 | Hamilton | |
| 5,569,129 | A | 10/1996 | Seif-Naraghi et al. | |
| 5,695,432 | A | 12/1997 | Soderlund | |
| 5,704,881 | A | 1/1998 | Dudley | |
| 5,850,928 | A | 12/1998 | Kahlman et al. | |
| 5,915,673 | A | 6/1999 | Kazerooni | |
| 5,961,541 | A | 10/1999 | Ferrati | |
| 5,980,435 | A | 11/1999 | Joutras et al. | |
| 5,996,823 | A | 12/1999 | Dyson | |
| 6,079,578 | A | 6/2000 | Dyson | |
| 6,080,087 | A | 6/2000 | Bingham | |
| 6,241,065 | B1 | 6/2001 | Kohlenberg et al. | |
| 6,244,991 | B1 | 6/2001 | Bingham | |
| 6,273,844 | B1 | 8/2001 | Kelsey et al. | |
| 6,302,828 | B1 | 10/2001 | Martin et al. | |
| 6,315,138 | B1 | 11/2001 | Dyson | |
| 6,436,009 | B1 | 8/2002 | Marucci | |
| 6,450,103 | B2 | 9/2002 | Svensson | |
| 6,464,208 | B1 | 10/2002 | Smith | |
| 6,645,126 | B1 | 11/2003 | Martin et al. | |
| 6,666,831 | B1 | 12/2003 | Edgerton et al. | |
| 6,890,288 | B2 | 5/2005 | Bingham | |
| 6,907,630 | B2 | 6/2005 | Freon | |
| 6,942,630 | B2 | 9/2005 | Behan | |
| 6,997,668 | B2 | 2/2006 | Salesse et al. | |
| 7,125,388 | B1 | 10/2006 | Reinkensmeyer et al. | |
| 7,137,771 | B2 | 11/2006 | Maurer et al. | |
| 7,222,839 | B2 | 5/2007 | Taylor et al. | |
| 7,240,621 | B2 | 7/2007 | Chepurny et al. | |
| 7,462,138 | B2 | 12/2008 | Shetty et al. | |
| 7,634,825 | B2 * | 12/2009 | Chepurny | A61G 7/1015 5/85.1 |
| 7,883,450 | B2 | 2/2011 | Hidler | |
| 8,128,068 | B2 | 3/2012 | Chepurny et al. | |
| 8,246,354 | B2 | 8/2012 | Chu et al. | |
| 8,701,226 | B2 | 4/2014 | Faucher et al. | |
| 9,510,991 | B2 * | 12/2016 | Stockmaster | A61H 3/008 |
| 9,682,000 | B2 | 6/2017 | Behnke et al. | |
| 9,839,569 | B2 | 12/2017 | Behnke et al. | |
| 9,855,177 | B2 * | 1/2018 | Erturk | A61H 3/008 |
| 10,219,960 | B2 | 3/2019 | Behnke et al. | |
| 10,463,563 | B2 * | 11/2019 | McBride | A61G 7/1042 |
| 10,470,964 | B2 * | 11/2019 | Stockmaster | A61H 3/008 |
| 10,478,371 | B2 * | 11/2019 | Stockmaster | G16H 40/63 |
| 10,500,123 | B2 | 12/2019 | Glukhovsky et al. | |
| 10,537,486 | B2 | 1/2020 | Behnke et al. | |
| 10,668,316 | B2 * | 6/2020 | Mcbride | A63B 21/4001 |
| 11,246,780 | B2 * | 2/2022 | Behnke | A61G 7/1001 |
| 11,253,416 | B2 * | 2/2022 | McBride | A61G 7/1042 |
| 11,324,651 | B2 * | 5/2022 | Behnke | A63B 69/0064 |
| 2002/0065173 | A1 | 5/2002 | Cook | |
| 2004/0059589 | A1 | 3/2004 | Moore et al. | |
| 2004/0064436 | A1 | 4/2004 | Breslin et al. | |
| 2004/0097330 | A1 | 5/2004 | Edgerton et al. | |
| 2004/0172317 | A1 | 9/2004 | Davis et al. | |
| 2004/0199532 | A1 | 10/2004 | Meyers et al. | |
| 2005/0065754 | A1 | 3/2005 | Schaf et al. | |
| 2005/0065807 | A1 | 3/2005 | DeAngelis et al. | |
| 2005/0103591 | A1 | 5/2005 | Micheau et al. | |
| 2005/0105772 | A1 | 5/2005 | Voronka et al. | |
| 2005/0115914 | A1 | 6/2005 | Chepurny et al. | |
| 2005/0144062 | A1 | 6/2005 | Mittal et al. | |
| 2005/0165633 | A1 | 7/2005 | Huber | |
| 2005/0239613 | A1 | 10/2005 | Colombo et al. | |
| 2006/0052728 | A1 | 3/2006 | Kerrigan et al. | |
| 2007/0004567 | A1 | 1/2007 | Shetty et al. | |
| 2007/0016116 | A1 | 1/2007 | Reinkensmeyer et al. | |
| 2007/0119795 | A1 | 5/2007 | Goldring et al. | |
| 2007/0215569 | A1 | 9/2007 | Chepurny et al. | |
| 2008/0287268 | A1 | 11/2008 | Hidler | |
| 2012/0000876 | A1 | 1/2012 | Bergenstrale et al. | |
| 2014/0201905 | A1 * | 7/2014 | Glukhovsky | A61G 7/1049 5/81.1 R |
| 2014/0201906 | A1 * | 7/2014 | Erturk | A61G 7/1015 5/81.1 R |
| 2014/0206503 | A1 | 7/2014 | Stockmaster et al. | |
| 2015/0143627 | A1 * | 5/2015 | McBride | A61G 7/1044 5/81.1 R |
| 2016/0256346 | A1 * | 9/2016 | Stockmaster | G16H 40/63 |
| 2017/0135893 | A1 | 5/2017 | Stockmaster et al. | |
| 2017/0196752 | A1 * | 7/2017 | Behnke | A63B 21/068 |
| 2018/0036196 | A1 * | 2/2018 | Behnke | A63B 21/068 |
| 2018/0071159 | A1 | 3/2018 | Glukhovsky et al. | |
| 2018/0229070 | A1 * | 8/2018 | McBride | A63B 69/0064 |
| 2019/0216664 | A1 * | 7/2019 | Behnke | A63B 21/4001 |
| 2020/0038281 | A1 * | 2/2020 | McBride | A61G 7/1044 |
| 2020/0155399 | A1 * | 5/2020 | Behnke | A63B 21/4001 |
| 2020/0230005 | A1 * | 7/2020 | Hidler | A61G 7/1042 |
| 2021/0401648 | A1 * | 12/2021 | Behnke | A63B 21/00181 |
| 2021/0401649 | A1 * | 12/2021 | Behnke | A61G 7/1042 |
| 2022/0016471 | A1 * | 1/2022 | McBride | A63B 21/00181 |

FOREIGN PATENT DOCUMENTS

| | | | | |
|---|---|---|---|---|
| WO | WO-2009023321 | A2 * | 2/2009 | A61H 3/008 |
| WO | WO-2009023321 | A9 * | 6/2009 | A61H 3/008 |
| WO | 2014113683 | A1 | 7/2014 | |
| WO | 2017083666 | A1 | 5/2017 | |
| WO | 2017146705 | A1 | 8/2017 | |
| WO | 2018152190 | A1 | 8/2018 | |
| WO | WO-2020154265 | A1 * | 7/2020 | A61G 7/1001 |

OTHER PUBLICATIONS

Martin Frey et al., A Novel Mechatronic Body Weight Support System, IEEE Trans Neural Systems and Rehabilitation Engineering 2006, 36 pages.

Vahle Electrification Systems Catalog, Powernail Enclosed Conductor System, catalog-enclosed-conductor-system-2007, 26 pages.

Notification of Transmittal of International Search Report and Written Opinion including International Search Report and Written Opinion for International Application No. PCT/US2020/014369 dated Apr. 15, 2020, 15 pages.

* cited by examiner

GAIT TRAINING VIA PERTURBATIONS PROVIDED BY BODY-WEIGHT SUPPORT SYSTEM

CROSS-REFERENCE TO RELATED APPLICATIONS

This application claims benefit of U.S. Provisional Patent Application No. 62/795,186, entitled "Gait Training Via Perturbations Provided By Body-Weight Support Systems," filed on Jan. 22, 2019, the contents of which are hereby incorporated by reference.

GOVERNMENT RIGHTS STATEMENT

This invention was made with government support under the National Institutes of Health (NIH) Small Business Innovation Research (SBIR) Grant entitled "ZeroG TRIP: Training Responses in Postural Rehabilitation", #1R43AG059257-01 awarded by NIH. The government has certain rights in the invention.

BACKGROUND OF THE INVENTION

The present disclosure relates to a body-weight support system. In particular, the present disclosure relates to an improved body-weight support system in which the body weight support system initiates perturbations to ultimately treat inadequate balance responses in human patients.

Successfully delivering intensive yet safe gait therapy to individuals with significant walking deficits presents the greatest challenges to even the most skilled therapists. In the acute stages of many neurological injuries such as stroke, spinal cord injury, or traumatic brain injury, individuals often exhibit highly unstable walking patterns and poor endurance, making it difficult to safely practice gait for both the patient and therapist. Because of this, there has been a big push in rehabilitation centers to move over-ground gait training to the treadmill where body-weight support systems can help minimize falls while at the same time raising the intensity of the training.

Numerous studies have investigated the effectiveness of body-weight supported treadmill training and have found that this mode of gait training promotes gains in walking ability similar to or greater than conventional gait training. Unfortunately, there is a gap in technologies available on the market for transitioning subjects from training on a treadmill to safe, weight-supported over-ground gait training. Since a primary goal of all individuals with walking impairments is to walk in their homes and in the community rather than on a treadmill, it is imperative that therapeutic interventions targeting walking involve over-ground gait training.

Some conventional support systems involve training individuals with gait impairments over smooth, flat surfaces. However, these systems have their limitations. In some systems, therapists are significantly obstructed from interacting with the subject, particularly their lower legs. For patients that require partial assistance to stabilize their knees and hips or help propel the legs, the systems present significant barriers between the patient and the therapist.

In other systems, the subject is required to physically drag the cart with them as they ambulate. Accordingly, rather than being able to focus on their own balance, posture, and walking ability, the subject is forced to compensate for the dynamics of the cart. For example, on a smooth flat surface, if the subject stops abruptly, the cart can continue to move forward and potentially destabilize the subject. This confounding effect may result in an abnormal compensatory gait strategy that could persist when the subject is removed from the device.

Another problem with some conventional systems is that they only provide static unloading to a subject. That is, under static unloading, the length of the shoulder straps is set to a fixed length, so the subject either bears all of their weight when the straps are slack or no weight when the straps are taught. Static unloading systems have been shown to result in abnormal ground reaction forces and altered muscle activation patterns in the lower extremities. In addition, static unloading systems limit the subject's vertical excursions that prevent certain forms of balance and postural therapy where a large range of motion is necessary.

Some conventional systems include a motorized over-ground gait trainer. While the trainer is motorized and programmed to follow the subject's movement, due to the mechanics of the actuators and overall system dynamics, there are significant delays in the response of the system so that the subject has the feeling that they are pulling a heavy, bulky cart in order to move, a behavior that may destabilize impaired patients during walking. Also, the device cannot traverse over-ground obstacles, such as ascending or descending stairs and rough terrain, making it limited to smooth surface gait training.

In another conventional support system, there is a limitation on the amount of body-weight support that is provided. In such a system, the body-weight support cannot be modulated continuously, but rather is adjusted before the training session begins and is then fixed at that level.

Moreover, in some support systems, the extent of the vertical travel of the system is limited. As a result, subjects cannot be raised from a wheelchair to a standing position, thereby restricting the use of the system to individuals with only minor to moderate gait impairments. Also, while the trolley of a support system may be fairly light, the subject must pull it along the over-head rail as they ambulate. As a result, the subject will feel the presence of a mass. Furthermore, the amount of unloading cannot be adjusted continuously since it requires the operator to manually increase the pressure in the actuator. Finally, the system does not monitor and store quantitative data of gait performance (e.g. subject's walking speed, distance walked, etc) so tracking improvements in gait is not possible.

Thus, there is a need for an improved body-weight support system that overcomes the limitations of the systems described above. Additionally, nearly eight million adults in the United States report balance disorders each year. About one-third of the older population reports difficulty with balance or walking, and the numbers increase significantly with age. While reasons for poor balance are varied and include factors such as muscle weakness, biomechanical constraints, and poor or inadequate postural responses to perturbation, inadequate postural responses following a slip or trip are the most common reason for falls. How a person responds to an external perturbation ultimately determines if a fall will occur. Normal balance responses consist of fast, automatic corrective stepping responses to recover equilibrium in response to sudden external perturbations during standing and walking. Each individual has a specific dynamic limit of stability defined by the perturbation thresholds at which they are forced to recover equilibrium with a step and the thresholds at which their corrective steppings are inadequate to prevent a fall.

People with Parkinson's Disease (PD) are especially prone to falls resulting from inadequate postural responses. Research has shown that postural responses (i.e. compensatory steps) in people with PD are shorter and more delayed when compared to healthy older adults, requiring people with PD to take multiple, small and ineffectual steps to attempt recovery from a perturbation. For example, it has been previously demonstrated that in response to sideways perturbations while standing, patients with PD fell in 75% of trials whereas age-matched control subjects never fell.

SUMMARY

The system of the present disclosure is a novel body-weight support system that allows individuals with severe gait impairments to practice over-ground walking in a safe, controlled manner. This system includes a body-weight support system that rides along a driven trolley.

As the subject or individual ambulates, the trolley automatically moves forward or backwards, staying above the subject so that they only feel a vertical unloading force. Because the system is mounted over-head, subjects can practice walking on uneven terrain and stairs, and subjects can use walking aids such as walkers or canes. In addition, since the system can maintain constant rope force under large vertical excursions, subjects can practice postural tasks and sit-to-stand maneuvers.

Furthermore, because of the instrumentation of the body-weight support system, the software tracks the distance walked, the walking speed, falls prevented, and unloading forces within and across multiple sessions. Using the body-weight support system, individuals with gait impairments can begin practicing walking early after their injuries, in a safe, controlled manner while their improvements can be tracked over time.

The techniques of the present disclosure also provide for the application of a strong, yet brief perturbation to a subject as they are stationary or performing a dynamic task, such as walking, side stepping, etc., via the trolley of a dynamic body weight support system. The direction and strength of the perturbation may be altered within the software controlling the body weight support system, and may depend upon the task being performed by the patient, if any. While it is likely that some of these perturbations may destabilize the subject, the advantage of using a body weight support system to initiate the perturbation is that the dynamic body weight support system may protect the subject against falls caused by the perturbations. Applying perturbations to individuals known to have deficits in balance and postural control will lead to improvements in stepping responses, which has been shown to reduce fall risk in such individuals.

DETAILED DESCRIPTION

Figure 1:
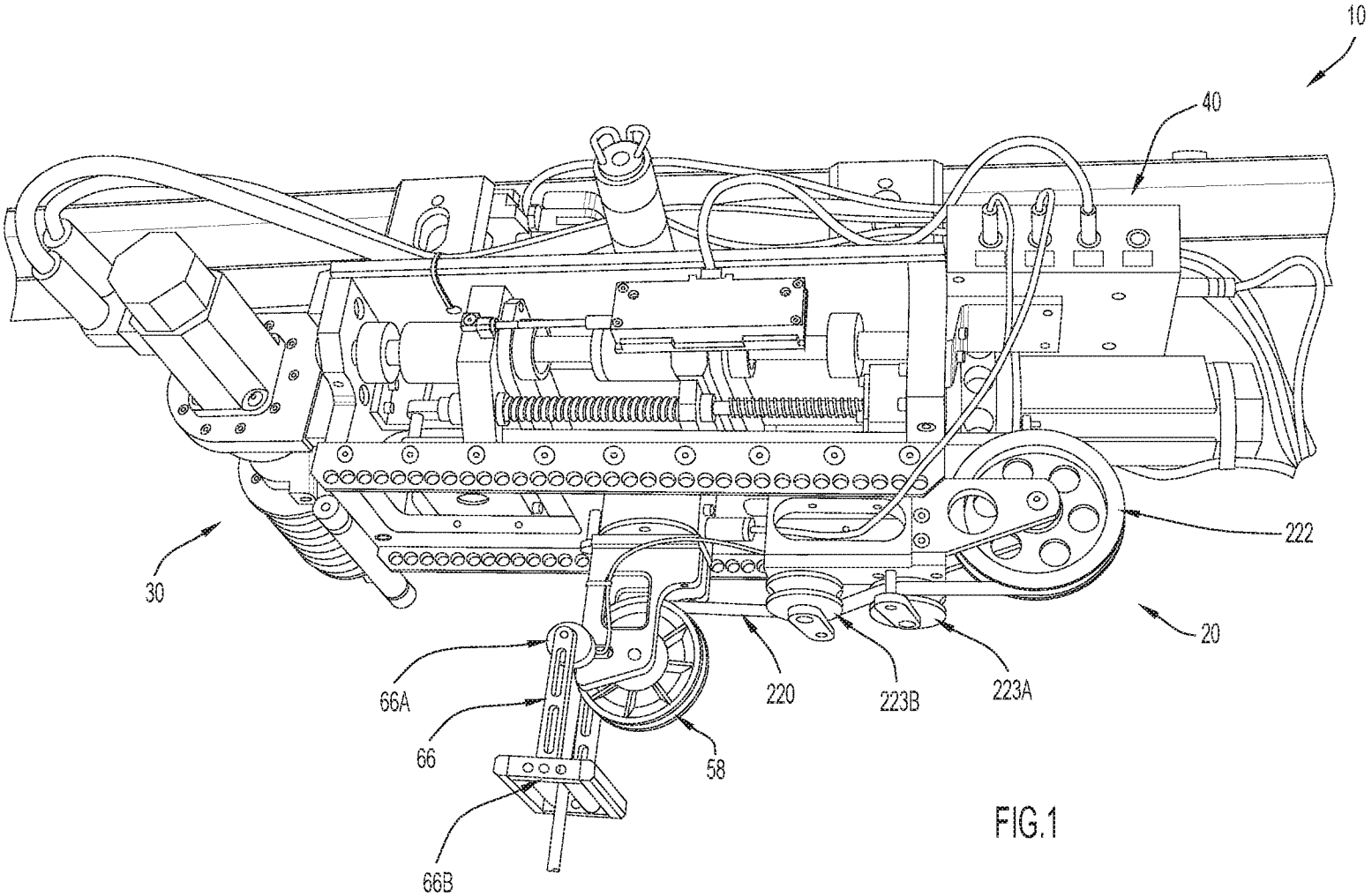
FIG. 1 is a bottom perspective view of a body-weight support system, according to example embodiments.

The system according example embodiments of the techniques of the present disclosure is a body-weight support system that allows individuals with severe to minor gait impairments to freely practice over-ground walking in a safe, controlled manner. The system 10 includes an unloading system 20 (see FIG. 1) that is attached to a driven trolley or movable support 30 that rides along a track 40, which in one implementation, can be mounted to a ceiling or other support structure. The track 40 includes straight sections as well as curved paths, allowing a subject 15 (see FIGS. 3 and 4) to practice walking around and/or over obstacles. In various embodiments, the track 40 may include any configuration and any combination of track sections.

As the subject 15 ambulates, the trolley 30 automatically moves forward or back, staying above the subject 15 so that the subject 15 only feels a vertical unloading force and does not have to drag the mass of the trolley 30. The system can maintain up to a certain amount of constant rope or tether tension and can provide a certain amount of static unloading. In one embodiment, the system can maintain approximately 150 lbs of constant rope or tether tension (e.g. constant force range: 0-150 lbs), and can provide 300 lbs of static unloading. In one embodiment, the system has over 12 feet of vertical travel, allowing patients to be raised or lowered to the floor, or from their wheelchair. In other embodiments, the range of travel of the system can vary. In addition, in other embodiments, the amount of rope or tether tension and static unloading can vary.

Since the system 10 is mounted over-head (e.g. the trolley rides along a track mounted to the ceiling), subjects 15 can practice walking on uneven terrain and steps (see FIG. 4), and subjects can use walking aids such as walkers or canes. As described below, the system also has a user-friendly interface 100 (see FIG. 5), allowing the therapist to fully control the system not only at the control station, but also wirelessly through a pocketPC that can be clipped to their belt or other article. This configuration allows the therapist to remain at their patient's side at all times, encouraging patient-therapist interaction. Furthermore, because of the instrumentation of the system, the software tracks distance walked, walking speed, and unloading forces within and across sessions (see FIGS. 5 and 6).

In one embodiment, the system has extensive safety features that constantly monitor the status of the patient during training sessions and provide a high level of security to the subject being trained. The subject's vertical height is monitored using the system's instrumentation. In one embodiment, if at any time a fall is detected, the system automatically adjusts the unloading force so that the subject will descend a minimal distance, which in one implementation is not more than four inches. In another embodiment, if at any point the vertical height of the subject falls more than four inches or if their vertical speed moves faster than ten inches per second, the system automatically switches into a holding mode and prevents the subject from descending. If the desired unloading force moves outside +/−10%, the system also switches into a safe holding mode. In one embodiment, both the winch motor and the ball-screw or spring motor (each of which is described in detail below) have fail-safe brakes so that in the event of power loss, the brakes lock and the subject cannot fall. During perceived falls, the trolley 30 also will automatically slow the forward or backward progression of the patient until equilibrium is achieved. Using this system, individuals with gait impairments can begin practicing walking early after their injuries, in a safe, controlled manner.

Figure 2:
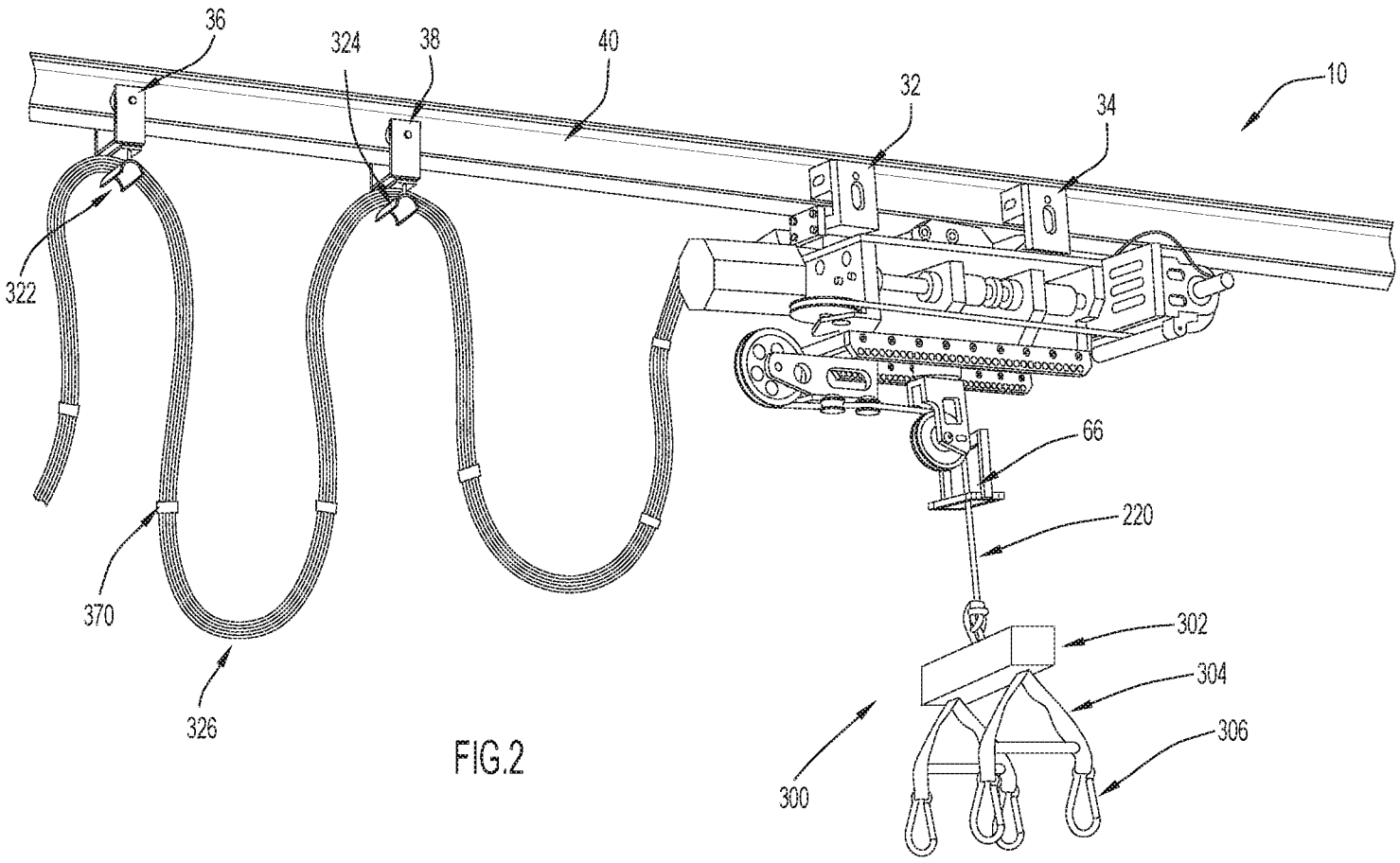
FIG. 2 is another perspective view of the body-weight support system illustrated in FIG. 1, according to example embodiments.
Figure 3:
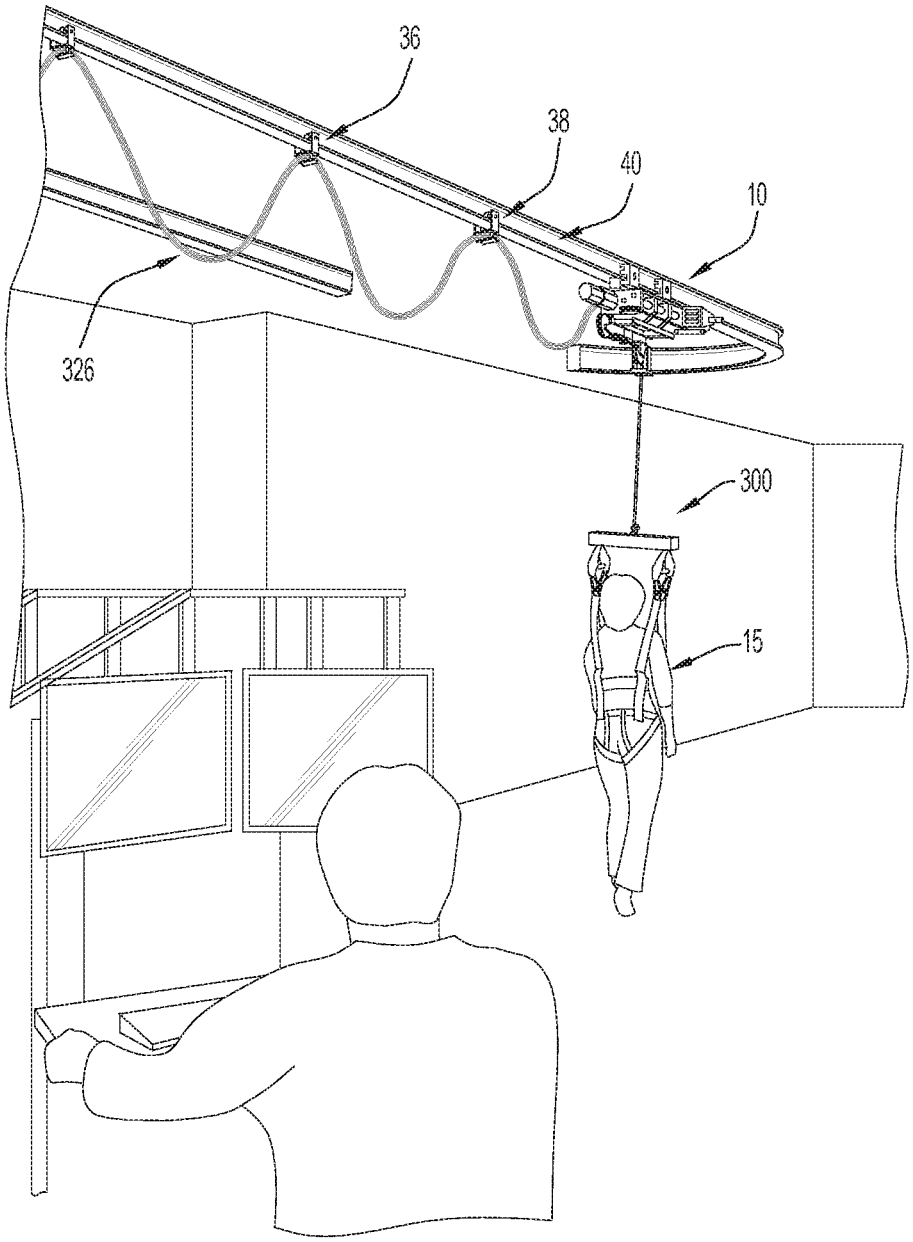
FIGS. 3 and 4 are different views of the body-weight support system illustrated in FIG. 1 in use, according to example embodiments.
Figure 4:
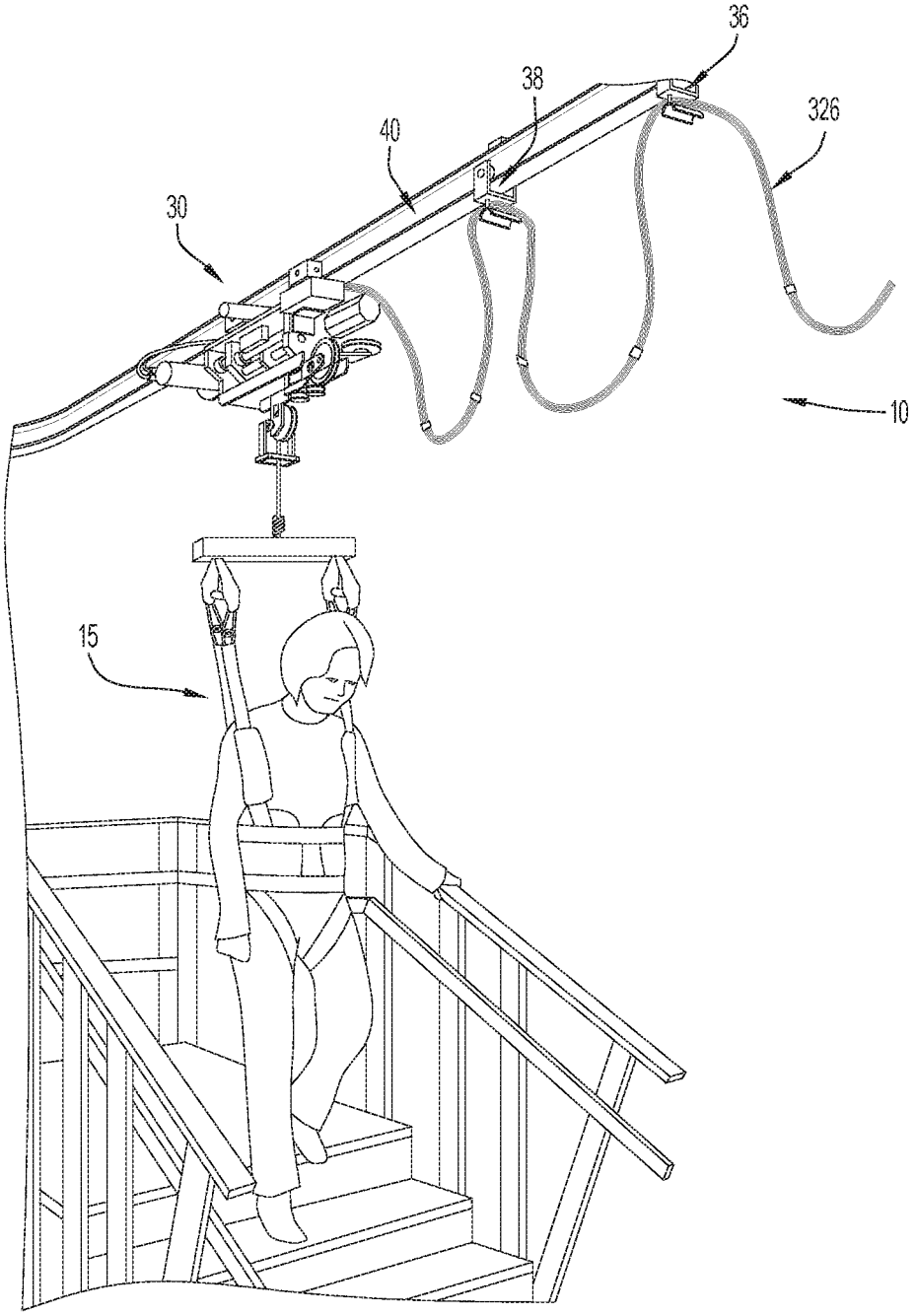

Referring to FIGS. 1-4, an embodiment of the over-ground body-weight support system of the present disclosure is illustrated. FIGS. 1 and 2 show side perspectives of the body-weight support system 10. FIGS. 3 and 4 show subject training over-ground and descending stairs, respectively.

Referring to FIG. 1, the unloading or adjustment system 20 includes a pulley 222 around which a rope 220 passes. Rope 220 can be referred to alternatively as a tether or an elongate member. The rope 220 has one end that is coupled to a winch as described below and another end that is coupled to a support assembly, such as a harness system or assembly, as described below. The support assembly and the elongate member, in this example the rope 220, form a suspension system that can be used to support a person or subject. The rope 220 passes around other pulleys 223A and 223B that guide the rope 220 toward pulley 58. The rope 220 passes around pulley 58 and through a pivotally mounted arm 66 that has an upper end 66A and a lower end 66B. The function and use of arm 66 is described in detail below with respect to FIGS. 15 and 16.

Referring to FIG. 2, several other portions of the body-weight support system 10 are illustrated. In this embodiment, the body-weight support system 10 includes wheel assemblies 32 and 34 that have wheels coupled thereto and that are pivotally mounted to the trolley 30. The wheels assemblies 32 and 34 are configured to support the trolley 30 from the track 40 and move along the track 40. In addition, the system 10 includes several festoons (only festoons 36 and 38 being shown in FIGS. 2 and 3) that are movably mounted on the track 40. Each of the festoons 36 and 38 includes rotatably mounted wheels that support the festoons 36 and 38 on the track 40. Festoons 36 and 38 include support members 322 and 324, respectively, coupled thereto that provide support for one or more cables and/or wires 326. The cables and/or wires 326 are connected to the electrical system on the trolley 30 and as the trolley 30 moves back and forth along the track 40, the cables and/or wires 326 bunch up into loops 370 and the festoons 36 and 38 move along the track 40 as well.

As shown in FIG. 2, the lower end of the rope 220 that passes through or proximate to arm 66 is coupled to a support system 300. The support system 300 includes a support bar 302 from which straps or other members 304 are supported. Coupled to the straps 304 are various clips 306 to which a harness system placed on a subject or patient can be coupled. In different embodiments, clips 306 can be replaced by buckles or other similar structures.

Referring to FIGS. 3 and 4, the body-weight support system 10 is illustrated in use by a subject 15 walking along a track 40 and walking down stairs. The body-weight support system 10 can be used with any track configuration and any combination of obstacles. In one embodiment, the body-weight support system 10 can be used with a treadmill.

Figure 5:
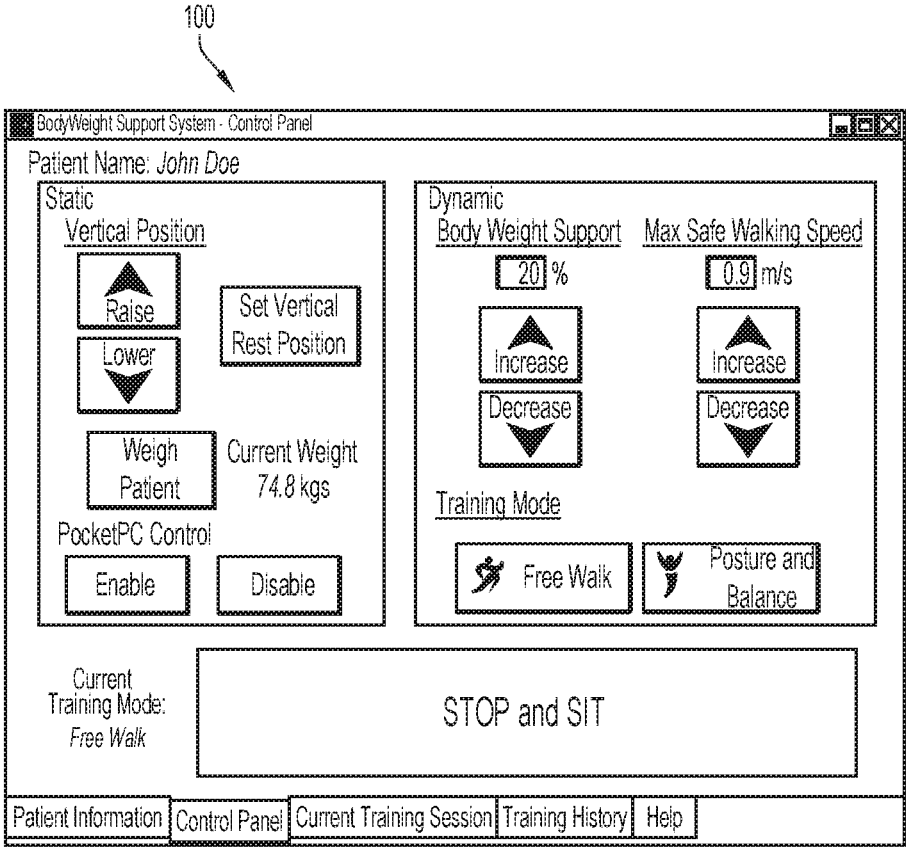
FIG. 5 is a user interface of the body-weight support system illustrated in FIG. 1, according to example embodiments.
Figure 6:
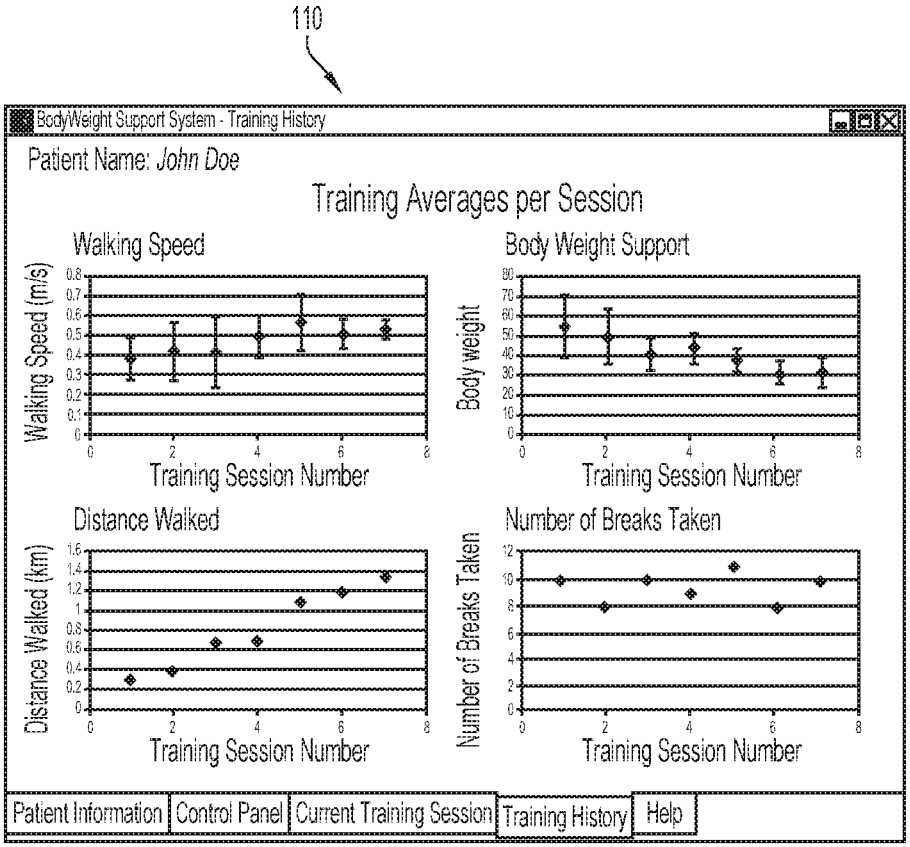
FIG. 6 is a data tracking screen of the body-weight support system illustrated in FIG. 1, according to example embodiments.

Referring to FIGS. 5 and 6, some of the interface components are illustrated. In particular, the user interface 100 (see FIG. 5) allows a therapist to control all aspects of the system while the device tracks patient performance within and across training sessions (see interface 110 of FIG. 6). The user-interface 100 allows the therapist to monitor and control all of the features of the system 10. Large push buttons on a touch-screen such as that shown in FIG. 5 allow the therapist to raise and lower the patient, to start the constant body-weight support, engage the trolley (e.g. have the trolley track the subjects). Data is stored for each training session to monitor improvements in a number of important metrics, such as average walking speed, level of body-weight support, rest breaks, session time, walking time, and falls prevented.

In addition to a touch-screen user interface, the system can also be controlled wirelessly through a pocketPC. This feature allows the therapist to maintain full control over the unloading system at any point along the rail system is a wireless pocketPC interface computer. For example, a situation may occur in which after ambulating down the track, the subject states that they need more body-weight support. Rather than requiring the therapist to run back to the Host Computer to change the body-weight support settings, which would ultimately compromise the safety of the patient, they can simply unclip the pocketPC from their belt and increase the level of support. This in turn sends a wireless signal back to the Host Computer, which will adjust the body-weight support system settings accordingly.

Referring to FIG. 5, the various components of an embodiment of a user interface according to the techniques of the present disclosure are illustrated. FIG. 5 shows an embodiment of a control panel user interface. As shown, a user can adjust the vertical position of a subject and the body weight support provided to a subject. Also, a user can control the walking speed of the subject. The particular training mode of operation determines whether the trolley 30 should track the subject (e.g., a self-paced mode), move at a constant speed (e.g., a paced mode) or hold its position for posture and balance tasks. In addition, a user can enable or disable the pocketPC device used by the therapist.

Referring to FIG. 6, an embodiment of a training history graphical user interface is illustrated. In this embodiment, data related to the walking speed, the body weight support, the distance walked, and the number of breaks taken has been collected and is presented in graphical form for ease of reference by a user or therapist.

Figure 7:
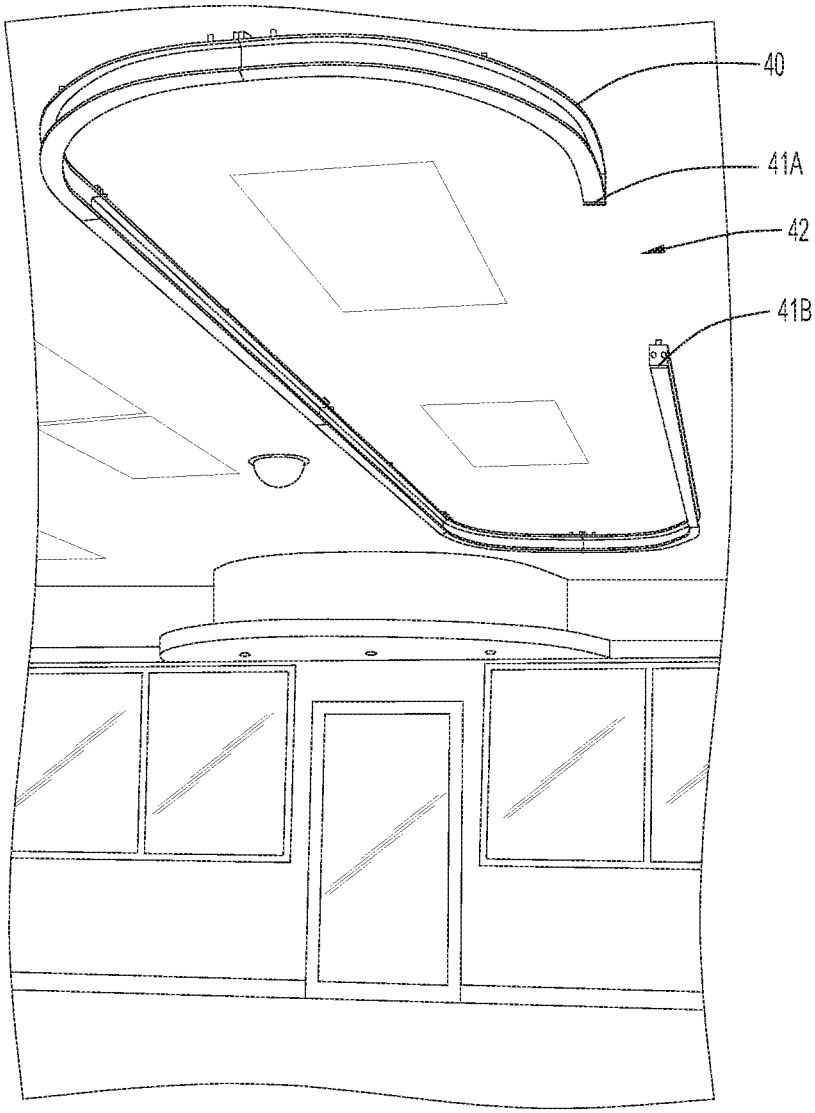
FIG. 7 is a bottom perspective view of a track system, according to example embodiments.

The unloading system 20 mounted to the trolley 30 of the body-weight support system rides along a track 40 that is mounted to the ceiling 42 of the facility. In one embodiment, the track 40 is preferably mounted to the concrete deck in the floor above where the system will be mounted (e.g. from a second floor deck if system is to be used on a first floor). The shape of the track can include straight sections as well as curved paths. This configuration or arrangement allows patients to practice walking straight paths, as well as around obstacles. Referring to FIG. 7, an exemplary track 40 is shown. In this embodiment, the track 40 extends from end 41A to end 41B and includes several curved sections and several straight sections.

The "path" that the patient must walk within lies directly beneath the track. In one embodiment, the "path" normally spans approximately two feet in width. The width of the path that the subject walks within is a function of the ceiling height and the amount of unloading force. The complete track is made custom for each facility, selected by the facility based on the available space and also preference. For example, one facility may choose to have a fifty foot straight section followed by some curves. Another facility may select a twenty-five foot straight section only, with no curved paths. In one implementation, the minimum radius of curvature for the curved sections is approximately two feet.

The trolley 30 rides along the track 40 and allows for forward and backward progression of the subject 15. The wheels on the trolley 30 are pivoting, thereby allowing the system to navigate corners as well as straight sections. In one embodiment, the trolley 30 includes pivoting wheel assemblies 32 and 34 that are pivotally mounted to a plate or base. In the embodiment illustrated in FIG. 12, a direct current (DC) motor 50 is mounted between the front and back trolley wheels or wheel assemblies 32 and 34. In another embodiment, a DC motor is mounted to one of the pivoting wheel assembles 32 or 34. The motor 50, including a gearhead, is utilized to drive the system via a motor drive wheel 52. The terms "motor," "drive," and "drive mechanism" can be used interchangeably herein. As shown in FIG. 13, a spring 56 pushes the drive wheel 52 against the bottom of the I-beam of the track 40. In particular, the spring 56 pushes a movably mounted bracket 54, to which the motor drive wheel 52 is mounted, toward the track. Thus, the drive wheel 52 contacts the I-beam track 41 beneath the lower flange 46C (as described below).

In this setting, the rope of the unloading system hangs down through a pivoting arm and connects to the patient's harness. On the pivoting arm is a sensor or detector that measures the angle of the rope. The terms "sensor" and "detector" can be used interchangeably herein. As the subject steps forward, this causes the pivoting arm to rotate, which is detected by the sensor on the pivoting arm. The trolley motor 50 is turned on, driving the trolley forward or backward, until the rope is vertical (e.g. the patient is directly below the trolley). In this setting, the subject does not have to drag the trolley along but instead the trolley automatically tracks the subject (e.g. stays directly above them) using the motor. The motor can also be used to maintain the trolley in a fixed position along the track if the therapist wants to do postural training, and can limit the subject's over-ground walking speed if the therapist feels the subject should not walk beyond a particular speed. In this setting, the trolley will stay above the subject as long as they walk below a pre-set speed. If the subject tries to walk faster, the trolley will only move at the pre-set speed, effectively slowing down the patient's forward progression. The trolley 30 can also be set to move at a constant walking speed, where the trolley 30 moves at this selected speed as long as the subject is in front of, under, or slightly behind the trolley 30. If the subject lags too far behind the trolley 30, the system assumes that the subject cannot keep up at that speed and the system 10 will stop.

A high-resolution sensor that is mounted to one of the wheels on the pivoting wheel assemblies 32 and 34 measures the rotation of the wheel in order to monitor how far the subject has walked and also their walking speed.

In one embodiment, the track system includes an I-beam 41 that is mounted to the concrete sub-floor above the floor where the system will operate (e.g. if the system is used on the first floor, the beam hangs from the bottom of the second floor deck). The I-beam 41 can also be mounted to the building's main beam structures if access to a concrete upper deck is not available. In one embodiment, the I-beam track 40 can be ceiling-mounted as shown in FIG. 7. Some of the features of the track are illustrated in engineering drawings showing mounting details for supporting straight and curved sections of I-beam track (see FIGS. 8A-8J and 9A-9C). The mounting components can include a steel strut with lateral brace supporting I-beam, not visible, below drop-down ceiling (see FIG. 10) and tubular steel anchors bolted to concrete sub-floor (see FIG. 11).

Figure 9A:
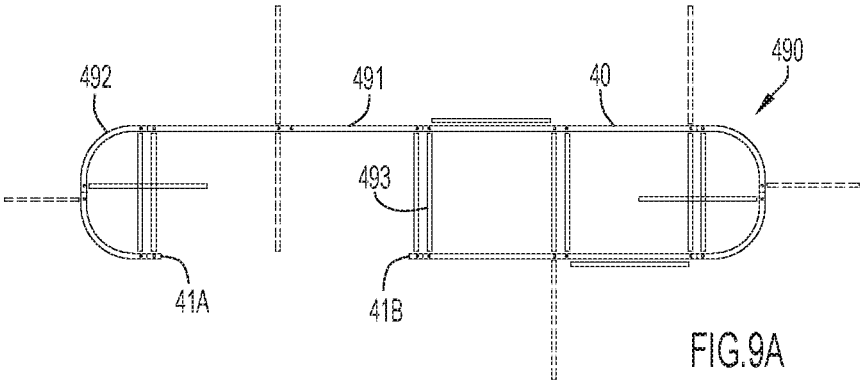
FIGS. 9A-9C are various views of mounting structures for the track system illustrated in FIG. 7, according to example embodiments.
Figure 9B:
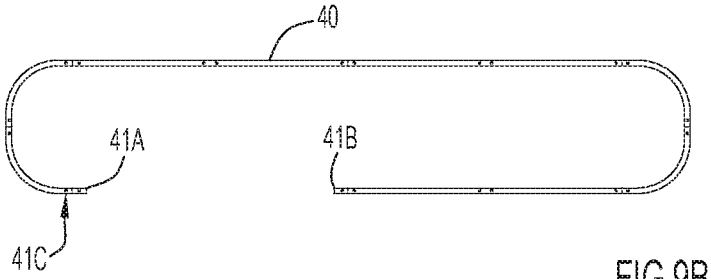
Figure 9C:
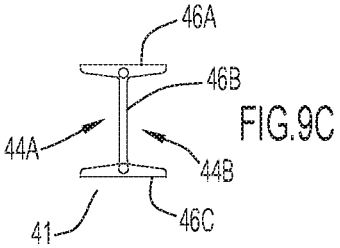
Figure 10:
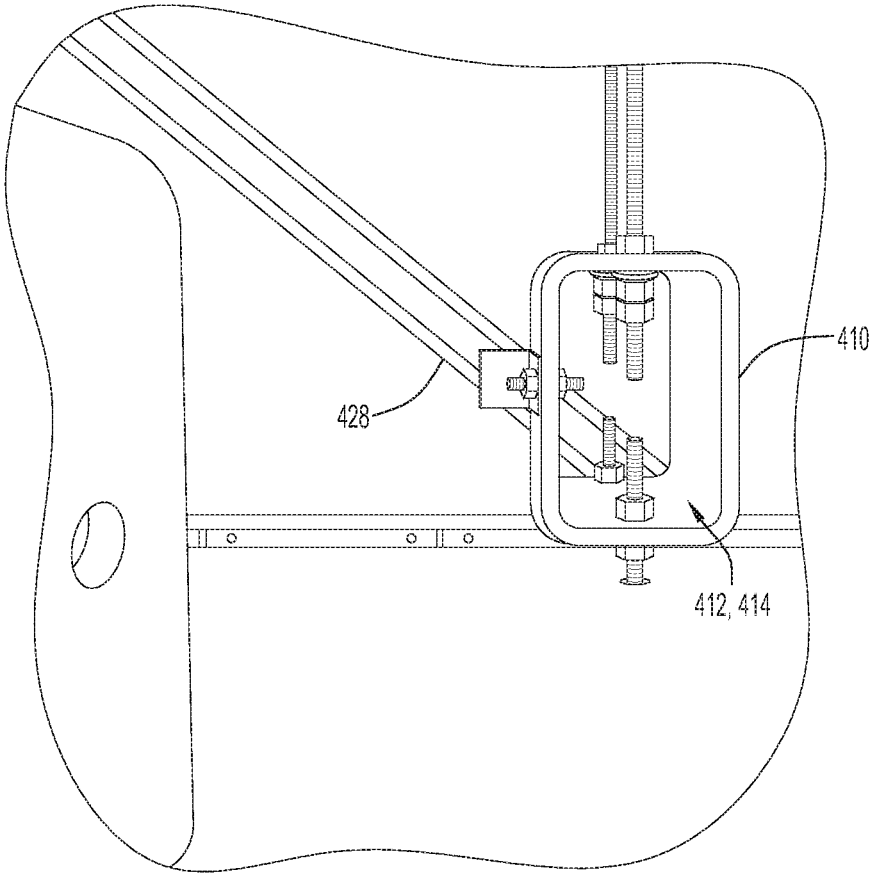
FIGS. 10 and 11 are views of several components of the track system illustrated in FIG. 7, according to example embodiments.
Figure 11:
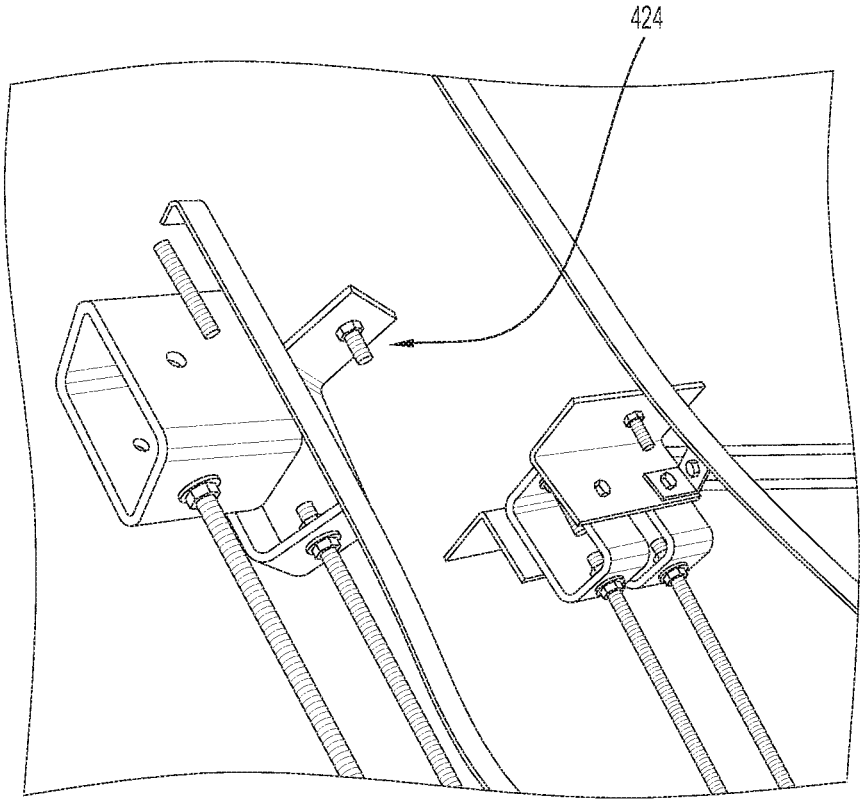

Anchors are first placed in the concrete floor above the floor of operation, after which long threaded rods are fastened to the anchors (see FIGS. 10 and 11). These threaded rods hang down from the deck to just above the ceiling of system operation, and are fastened to box-section support brackets (see FIGS. 8A-8J and 9A-9C, which are schematics of the mounting structure for the I-beam track). Threaded studs are welded onto the top of the I-beam, which extend up through the ceiling and attach to the bottom of the suspended support brackets (see FIG. 10). This modular mounting system can accommodate air ducts, electrical systems, and plumbing lines since the threaded rods that descend from the concrete sub-floor can simply be repositioned as necessary. As shown in FIG. 7, the track can consist of straight sections as well as curved sections, allowing patients the opportunity to practice walking around obstacles.

Referring to FIGS. 8A-8D, two different portions of an I-beam being supported are illustrated. The I-beam 41 is supported by connectors 412 and 414, such as bolts, that are coupled to a box section support member 410. The box section support member 410 is supported by connectors 416 and 418 that are coupled to support members 420 and 422 that are secured to a support portion 430, such as a concrete ceiling or slab. An angled support 428 can be provided for additional lateral support to the support system. The angled support 428 can be coupled to a box section support member 410, to a support member 420 and/or to a bracket 432. In other embodiments, any combination of these components can be used to support a portion of a track 40.

Figure 8A:
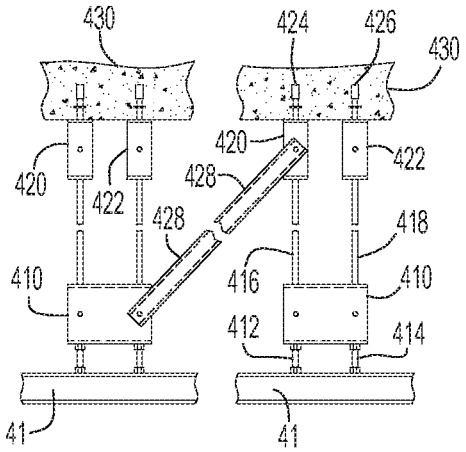
FIGS. 8A-8J are various view of mounting structures for the track system illustrated in FIG. 7, according to example embodiments.
Figure 8B:
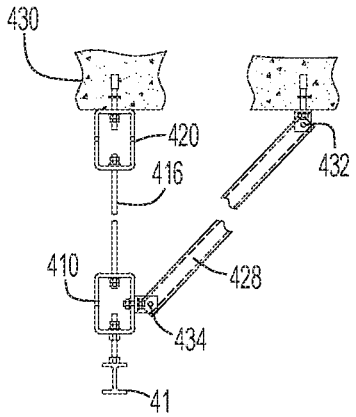
Figure 8C:
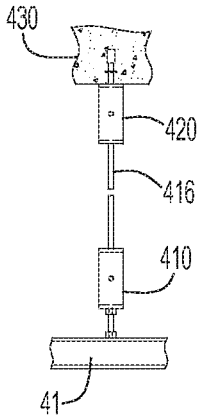
Figure 8D:
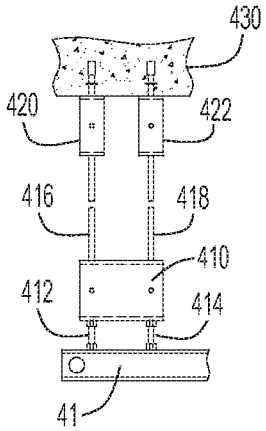
Figure 8E:
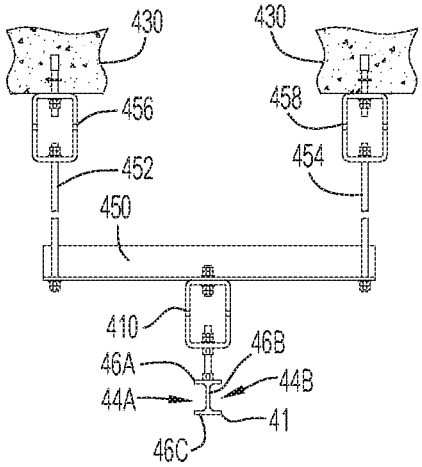
Figure 8F:
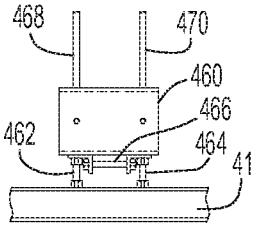
Figure 8G:
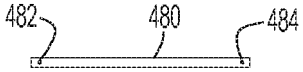
Figure 8H:
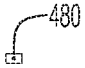
Figure 8I:
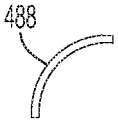
Figure 8J:
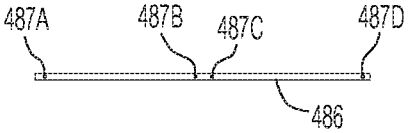

Referring to FIGS. 8E and 8F, a track portion 41 with an I-beam configuration is illustrated. In this embodiment, the track portion 41 is supported by a box section support member 410 that is fastened to a rail portion 450. The rail portion 450 is supported by connectors 452 and 454 that are fastened to box section support members 456 and 458. As shown in FIG. 8F, a connector 466 can be provided between connectors 462 and 464 for additional support relative to member 460. Connectors 468 and 470 can be coupled to box section support members (not shown in FIG. 8F).

FIGS. 8G-8J illustrate various track components or sections that can be used to build a track. Track component 480 includes mounting holes 482 and 484 proximate to its ends. While track component 480 is straight, curved portion 488 can be used as well (see FIG. 8I). Track component 486 includes mounting holes 487A and 487D proximate to its ends and mounting holes 487B and 487C near its middle section. Connectors can be used with the mounting holes to support the track component or section.

Referring to FIGS. 9A-9C, additional features of an embodiment of a track according to the present disclosure are illustrated. In FIG. 9A, track 40 includes straight portions 491 and curved portions 492 to form a path from end 41A to end 41B. Various braces 493 can be provided for support of the track. The track sections can include mounting holes 41C (see FIG. 9B) through which connectors can pass. Referring to FIG. 9C, an embodiment of a track section according to the present disclosure is illustrated. In this embodiment, the track section has an I-beam configuration 41 with an upper flange 46A, a lower flange 46C, and a middle section 46B. Channels or areas 44A or 44B are formed on opposite sides of the middle section 46B.

Referring to FIG. 10, note that the angled support 428 provides side-to-side stability for the I-beam (see FIG. 8). As shown in FIG. 10, threaded rods 412 and 414 welded to the I-beam stick up through the ceiling tiles and connect to the box-section support members 410 hanging from the concrete sub-floor. Referring to FIG. 11, studs 424 anchored into the concrete sub-floor extend out and connect to the top of box-section supports. Rods extend from the bottom of these supports, down to lower box-section supports located just above the ceiling tiles (see FIG. 10).

Figure 14:
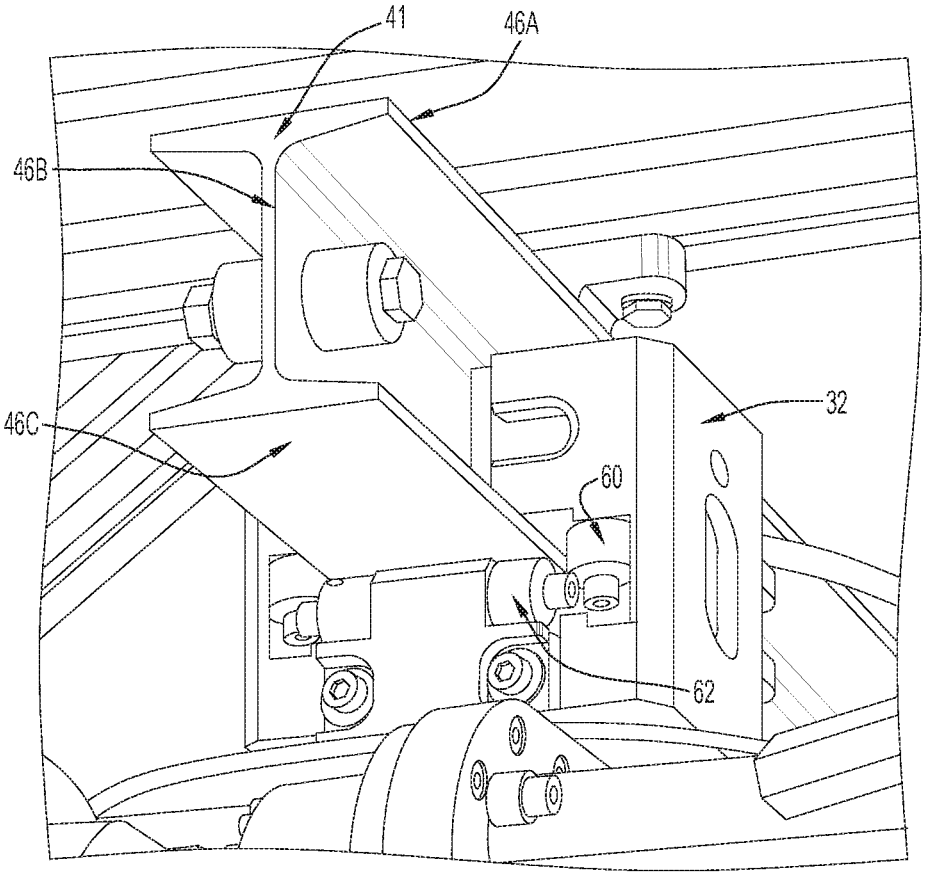

As described above, in one embodiment, the body-weight support system 10 includes a trolley 30 that moves along the track 40. The trolley 30 of the body-weight support system 10 allows subjects to practice walking over-ground by rolling along the track 40 as described above. The unloading system 20 that supports the patient is mounted beneath the trolley 30, as described in detail later. Two large pivoting wheel assemblies 32 and 34 allow the trolley 30 to roll along the I-beam 41 (see FIG. 12). Each wheel assembly includes two large wheels that fit inside the web of the I-beam 41, preventing the trolley 30 from moving up or down or having any vertical movement. Small wheels located on the bottom (see wheels 60) and sides (see wheels 62) of the pivoting wheel assemblies engage the I-beam lower flange 46C prevent the trolley 30 from wobbling or torquing to one side (see FIG. 14). The wheel assemblies 32 and 34 pivot, allowing the trolley 30 to traverse curves on the I-beam 41 (see FIG. 7). Referring to FIG. 14, small wheels 60 and 62 mounted just outside the lower beam flange 46C and just below the flange 46C provide the trolley 30 stability as it moves along the I-beam track 40.

Figure 12:
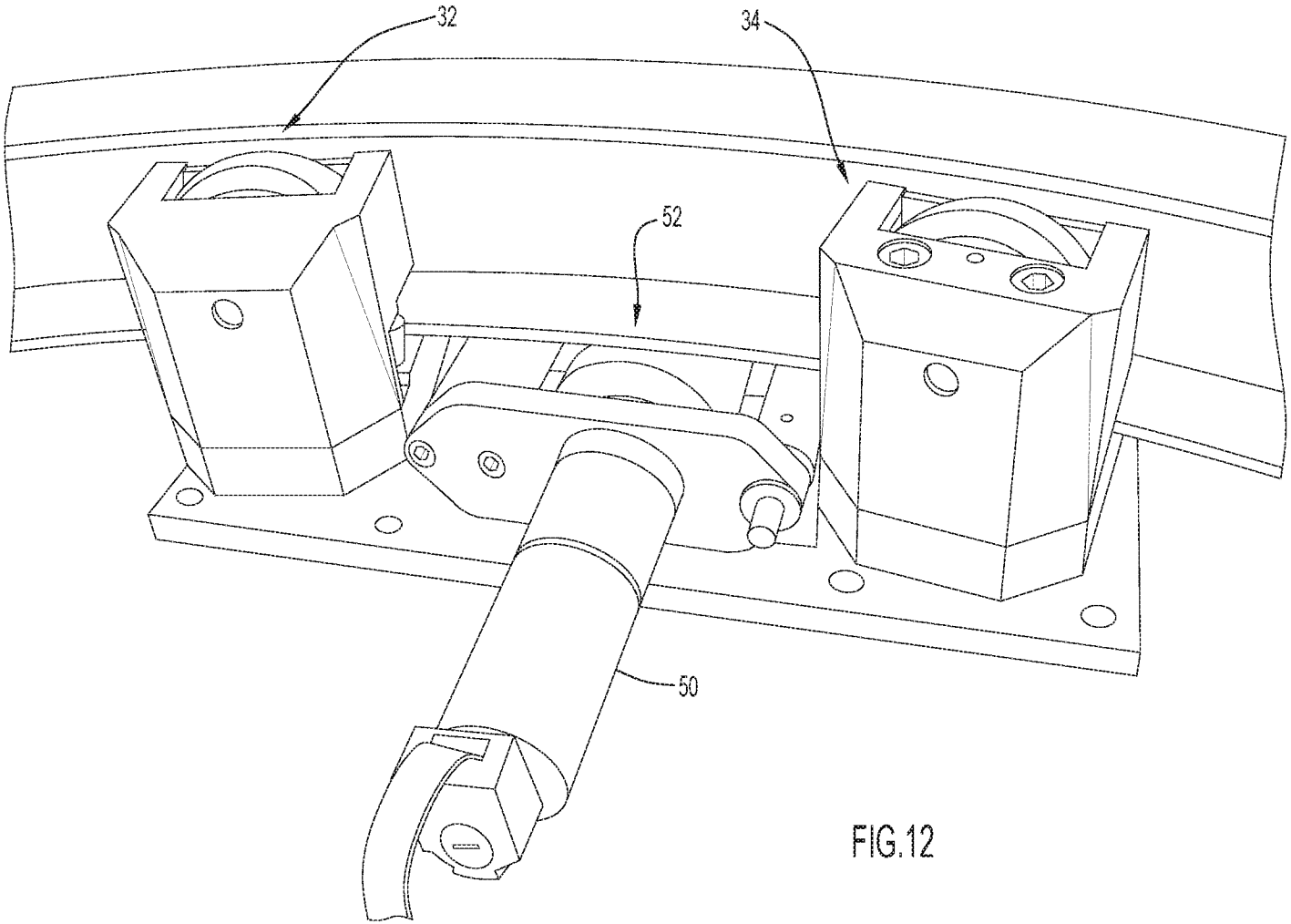
FIGS. 12-14 are views of some of the components of the body-weight support system illustrated in FIG. 1, some of which are showing engagement with the track system, according to example embodiments.
Figure 13:
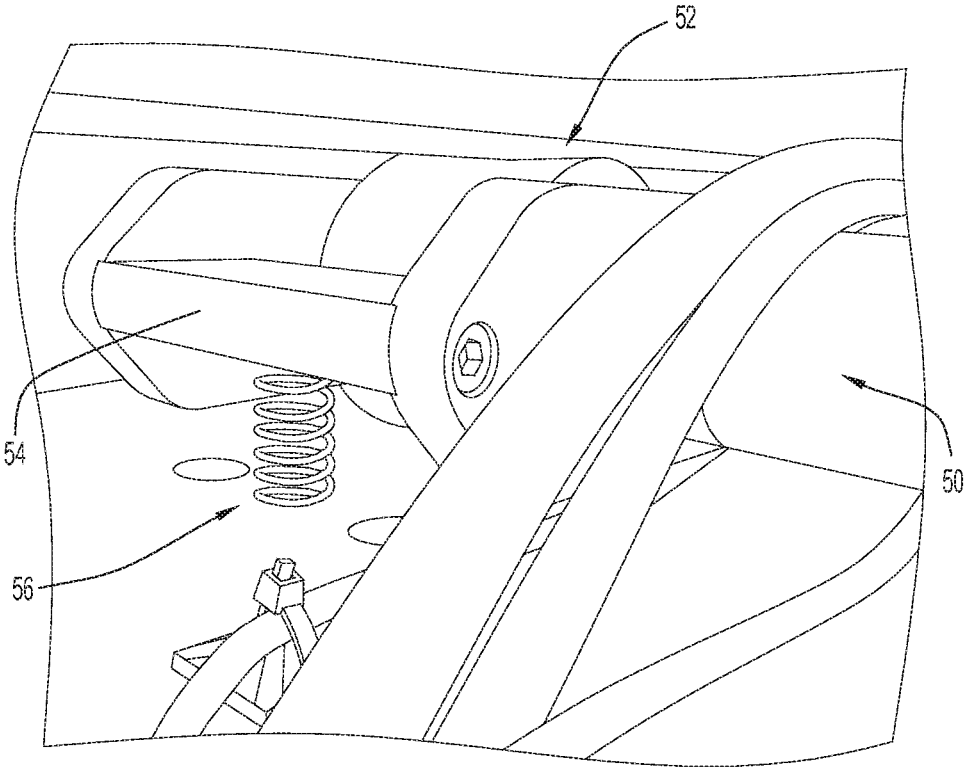

The trolley 30 is actuated by a drive wheel 52 located on one of the two pivoting wheel assemblies 32 and 34, which in turn is connected to a DC motor (an exemplary motor is manufactured by Maxon USA) (see FIGS. 12 and 13). In an alternative embodiment, the drive wheel on the trolley 30 can be located between the two pivoting wheel assemblies. The drive wheel 52 is made of a high-durometer rubber to provide adequate traction on the I-beam 41. Heavy-duty springs 56 push the drive wheel 52 against the lower flange 46C of the I-beam 41 (FIG. 13). The DC motor turns the drive wheel 52, which moves the trolley 30 along the rail or track 40.

Figure 15:
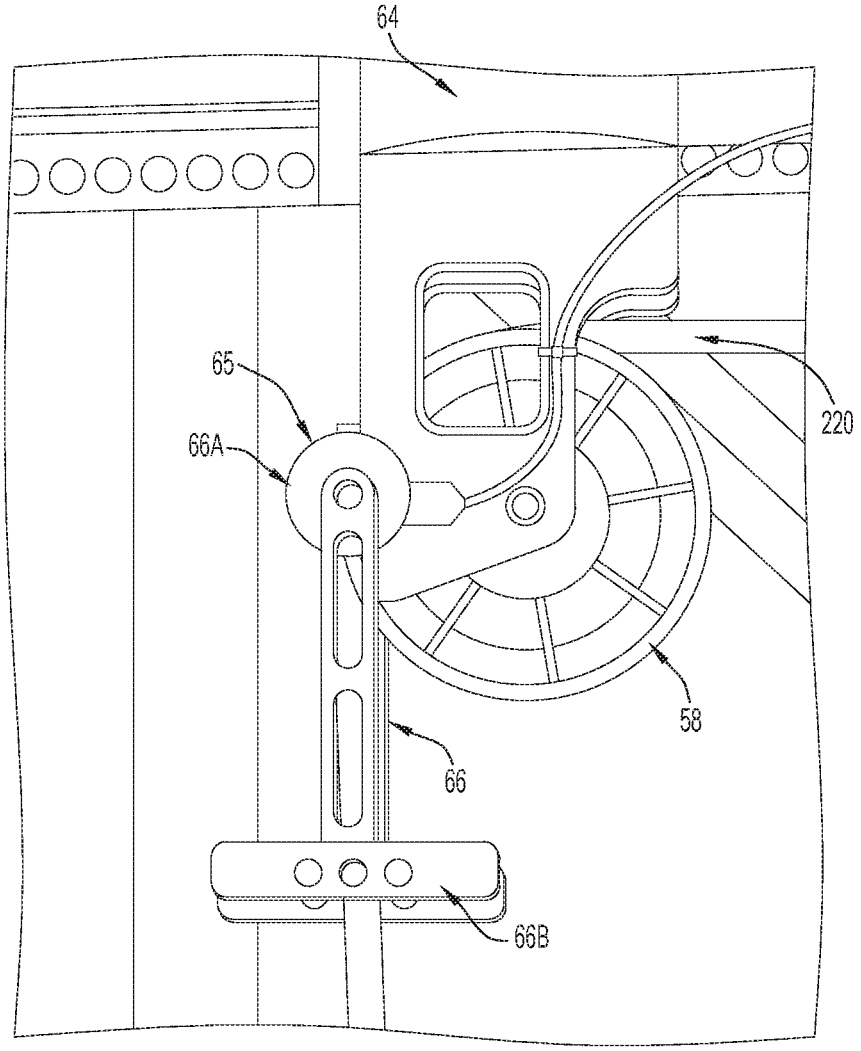
FIGS. 15-16 are views of some of the components of the unloading system of the body-weight support system illustrated in FIG. 1, according to example embodiments.
Figure 16:
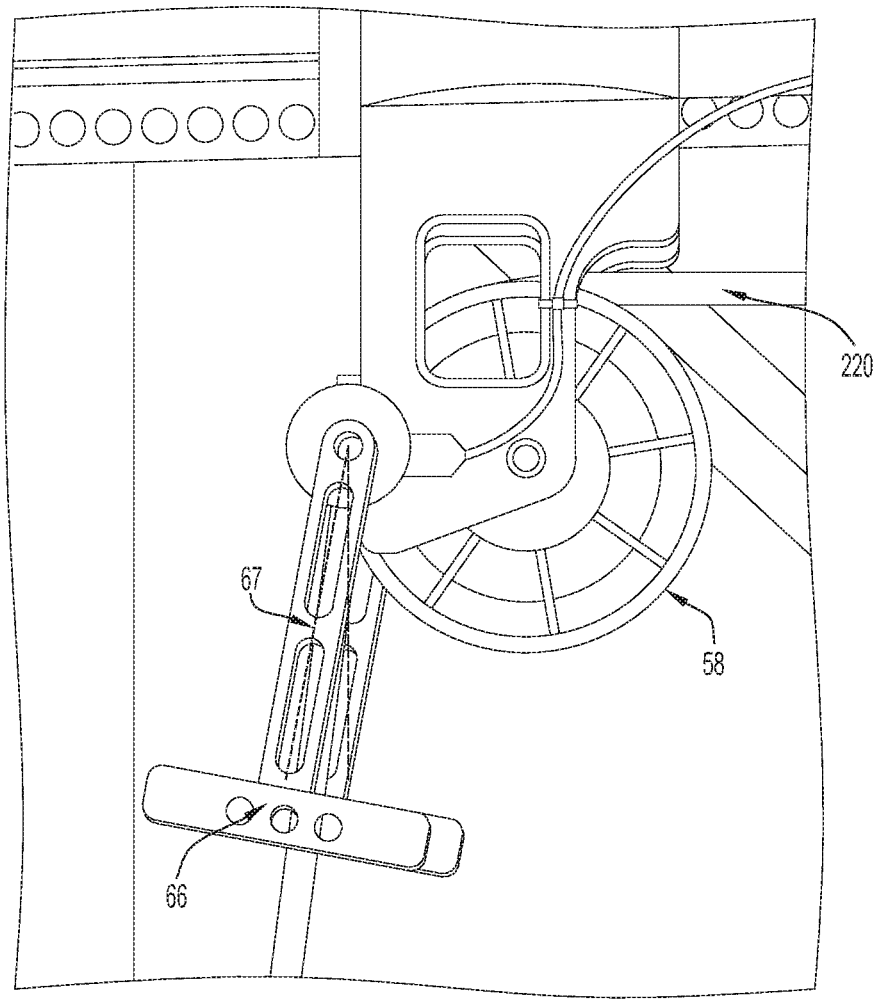

Referring to FIGS. 15 and 16, the unloading rope 220 feeds down to the patient through a pivoting arm 66, where the angle 67 of the arm 66 is measured using a precision potentiometer 65 (FIGS. 15 and 16). The unloading rope 220 is connected to the subject's harness and descends through or proximate to the arm 66. A computer closely monitors the angle of the pivoting arm relative to a vertical direction by reading the voltage of the potentiometer 65, and if the arm 66 is not vertical (such as shown in FIG. 15), the computer or controller turns on the trolley motor and drives the trolley 30 either forward or backward in order to make the angle zero (e.g. the unloading rope hanging vertical implying the trolley is directly over the subject's head). This adjustment process continues until the arm 66 is again vertical. Thus, as the subject walks, the rope 220 causes the pivoting arm 66 to pivot, which is measured by the potentiometer 65. In one embodiment, when the potentiometer or sensor 65 detects movement in a forward direction relative to the trolley, the drive mechanism is activated to cause movement of the trolley in the forward direction, and when the sensor detects movement in a rearward direction relative to the trolley, a braking mechanism is activated to retain the trolley in a particular position.

Referring to FIG. 15, the control system of the body-weight support system 10 according to the present disclosure includes a force sensor 64 that measures the force being applied to the rope 220.

Now, an embodiment of an unloading system of the body-weight support system according to the present disclosure is described. In this embodiment, the unloading system 200 has two main components: the winch and the spring-based dynamic unloading system.

A function of the winch is to raise and lower the subject into or out of a sitting position, or in some cases, bring a person up from or lower a person to the floor. The winch sub-assembly consists of a DC brushless motor, a harmonic drive gear head (80:1), and a winch drum spooled with approximately twelve feet of rope. In an alternative embodiment, the drive gear head may have a 100:1 ratio.

Figure 17:
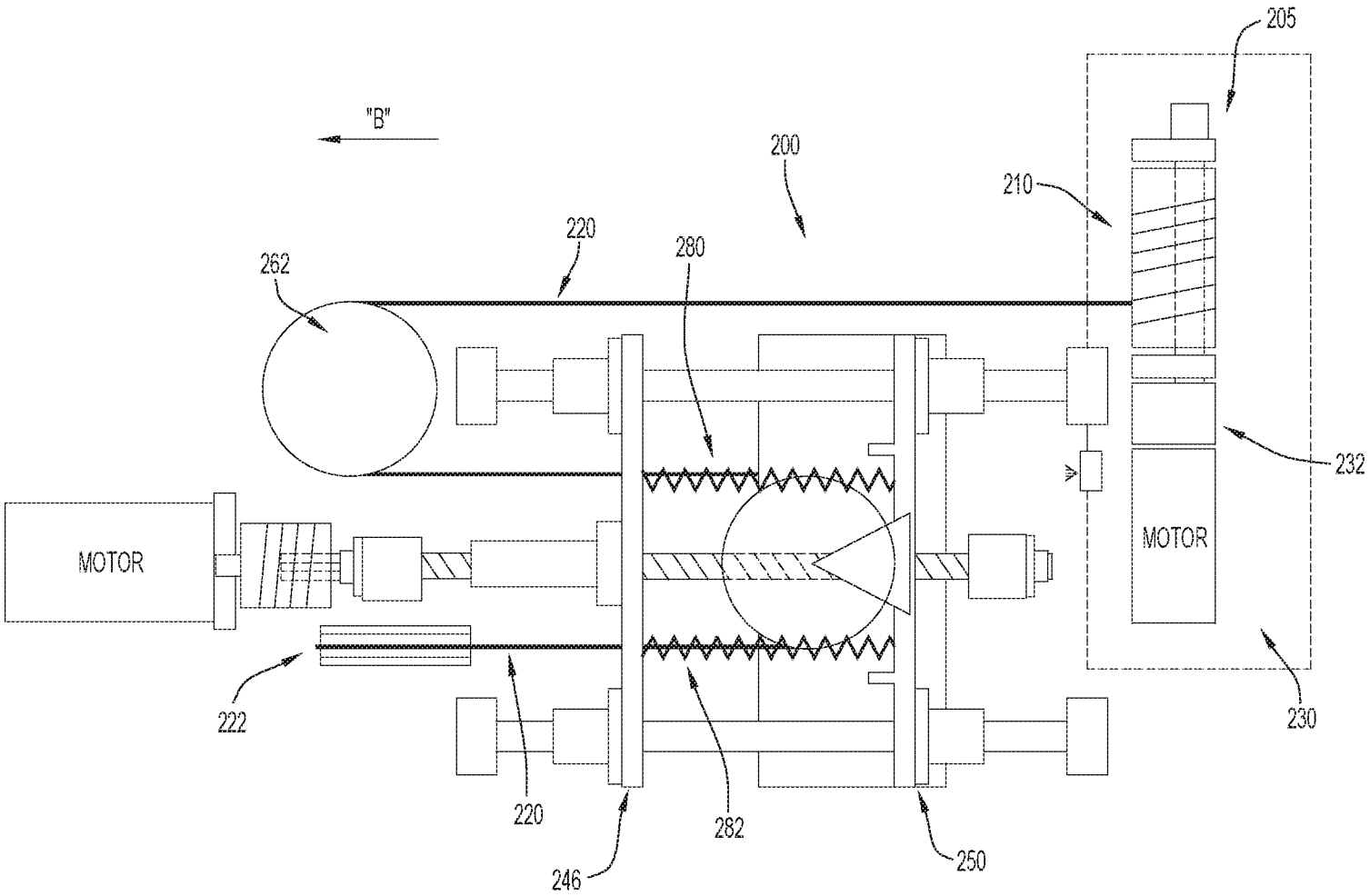
FIG. 17 is a schematic view of some of the components of the body-weight support system, according to example embodiments.

Referring to FIG. 17, the winch sub-assembly 205, which is shown inside the broken or dashed lines, allows large lengths of rope 220 to be spooled out or reeled in, which in turn, is used to raise or lower a patient from/to the floor or from/to a sitting position.

The unloading system 200 is the portion of the body-weight support system that raises and lowers the subject, and also provides constant rope tension (e.g. constant body-weight support). The unloading system 200 is mounted below the trolley 30, allowing it to move along the track 40. On the unloading system, a winch drum 210 is spooled with rope 220, which in one embodiment can be at least twelve feet of rope. The rope 220 can be an 8 mm rope. The rope 220 can be let out to lower the subject or wrapped up to raise the subject from the floor or their wheelchair. A DC motor 230 controls the function of the winch. Once the subject is in a standing position, the therapist can engage the constant body-weight support system 200. In this capacity, constant rope tension is maintained by two die-springs 280 and 282 pressing against the pulley plate 250 to which the subject is attached. As the subject walks, a DC motor 230 automatically maintains the spring length constant for springs 280 and 282, which results in constant rope tension. Sensors monitor the amount of unloading force and the subject's vertical position. The springs can be referred to as elastic members.

Now the operation of the winch is described. In one embodiment, the winch motor 230 turns at a constant speed, controlled by computer software, which is reduced by the harmonic drive by 80 times since an 80:1 gear ratio is utilized. The torque developed at the output of the harmonic drive is 80 times that of the motor due to this gear ratio. In an alternative embodiment, the speed can be reduced by the harmonic drive by 100 times if a 100:1 gear ratio is utilized. In other embodiments, different gear ratios can be used.

Since the harmonic drive 232 is coupled directly to the winch drum 210, the winch drum 210 turns at the same speed as the harmonic drive 282. As the winch turns in one direction, rope 220 is unwound from the winch drum 210 according to the path shown in FIG. 17 by arrow "B." As a result, the position of the spreader bar 302 and consequently the subject is lowered. If the winch turns in the opposite direction, rope 220 is wound onto the drum 210, effectively raising the position of the spreader bar 302 and consequently the subject (see FIGS. 18 and 19). A multi-turn potentiometer 206 is mounted to the end of the winch drum 210 that monitors the height of the spreader bar (or equivalently the subject). The vertical range of the spreader bar 302 is monitored in the software so that the control system always knows the vertical position of the subject.

Under normal operation, once the subject is raised to a standing position, the motor is turned off and maintains the current winch position using an internal motor brake. The winch is mainly used to raise and lower patients at the beginning and end of trainings, and also to pick up rope slack (or let rope out) if subjects are negotiating stairs or performing sit-to-stand maneuvers where a large vertical excursion is required. This is described more below. In one implementation, by using the current motor-harmonic drive, the winch can produce approximately 420 lbs of rope tension at a speed of 12.6 inches per second.

According to the gait training via perturbations techniques described in greater detail below, winch motor 230 and winch drum 210 may be utilized to initiate perturbations to provide gait training for a subject or patient. For example, in response to controller 510 of FIG. 25, winch motor 230 may initiate turning of winch drum 210 to increase the tension in rope 220. If the trolley is offset from the subject or patient in a horizontal direction, this increase in tension of rope 220 will result in a horizontal force or perturbation being applied to the patient or subject to which body weight support was previously being provided.

According to other example embodiments, winch motor 230 and drum 210 may be utilized to initiate a "negative" perturbation to the patient, as also described in more detail below. As used herein, a "negative" perturbation refers to a perturbation via a decrease in the rope force applied to the patient. For example, a patient who is standing or ambulating while receiving body weight support may experience a perturbation if the body weight support applied thereto is decreased. Accordingly, in response to controller 510 of FIG. 25, winch motor 230 may initiate turning of winch drum 210 to decrease the tension in rope 220 to apply a negative perturbation to the patient.

While the winch described above allows subjects to be raised and lowered from the floor and their wheelchairs, the spring-based-unloading system 200 controls the tension in the rope 220. The spring-based system can be referred to as a "series-elastic actuator." The overall concept of a spring-based system is that a spring compressed by some length, dx, will produce a force k*dx according to Hooke's Law, where k is the spring's stiffness. In order to maintain constant force, a motor is used to maintain the length of the spring at some fixed amount of compression. A detailed discussion of the operation of the spring-based unloading system will be presented below. First, a description of the parts of the system will be presented.

Figure 20A:
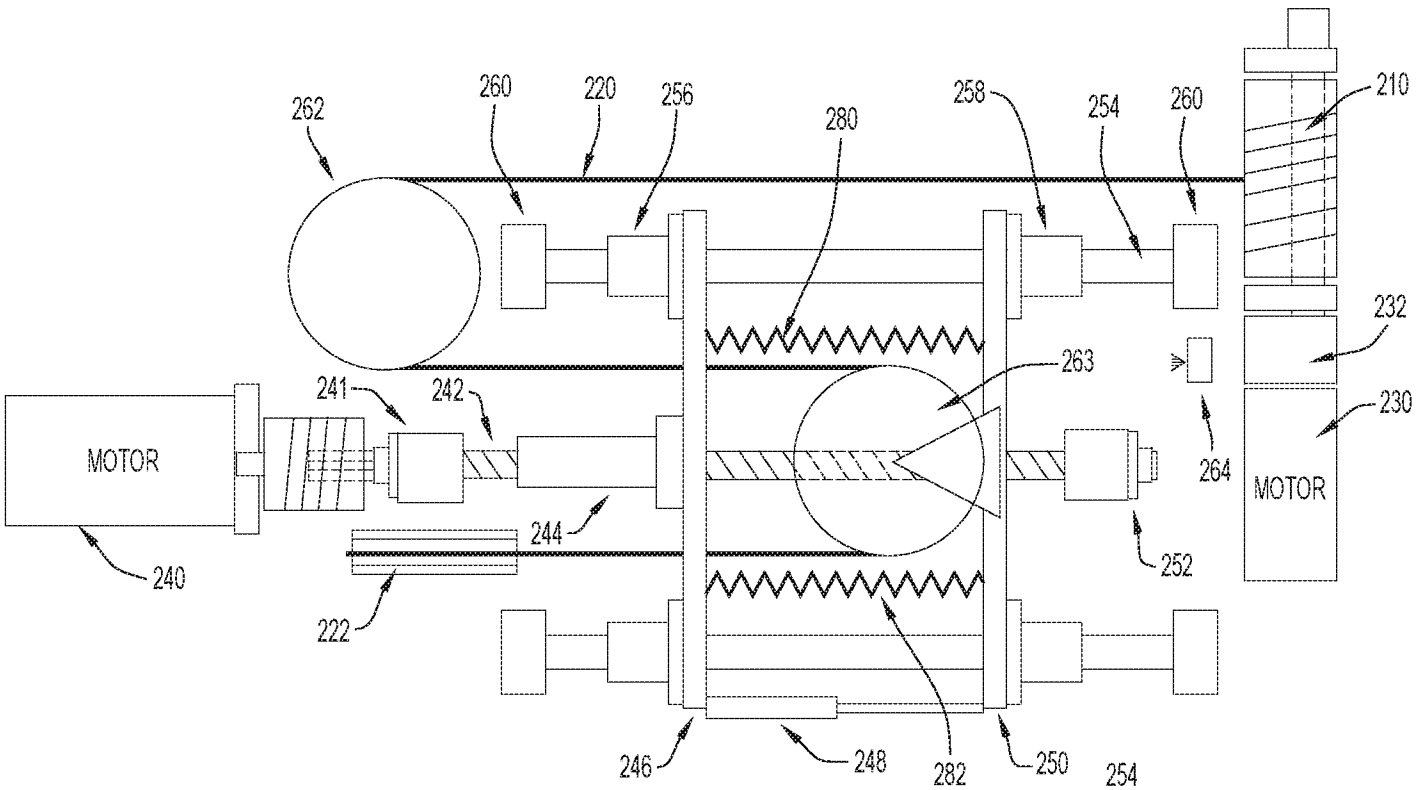
FIG. 20A is a schematic view of some of the unloading system components, according to example embodiments.

Referring to FIG. 20A, in this embodiment, the unloading system 200 includes two 16 inch hardened steel rods 254 spaced approximately eight inches apart in parallel, which are mounted to an aluminum plate supported by end blocks 260. Precision bearings 256 and 258 that are pressed into two plates, the pulley plate 250 and the ball-screw plate 246, allow the plates 246 and 250 to slide freely along the hardened rods 254. The pulley plate 250 has a 3.5 inch pulley 263 mounted to it which the unloading rope 220 is wound around.

The ball-screw motor 240 is coupled directly to a ball-screw 242, which has a ball-screw support block 241 and 252 mounted on either end. A ball-screw nut 244 is rigidly connected to the ball-screw plate 246. Two heavy-duty springs 280 and 282 reside between the two plates 246 and 250. A linear encoder 248 is mounted onto the ball-screw plate 246 and it measures the length of the springs 280 and 282. In this embodiment, an ultrasonic distance sensor 264 measures the distance between the pulley plate 250 and the rod support blocks 260. In one embodiment, a portion of the linear encoder 248 is mounted on the ball-screw plate 246 and another portion of the linear encoder 248 is mounted on the pulley plate 250.

Figure 21:
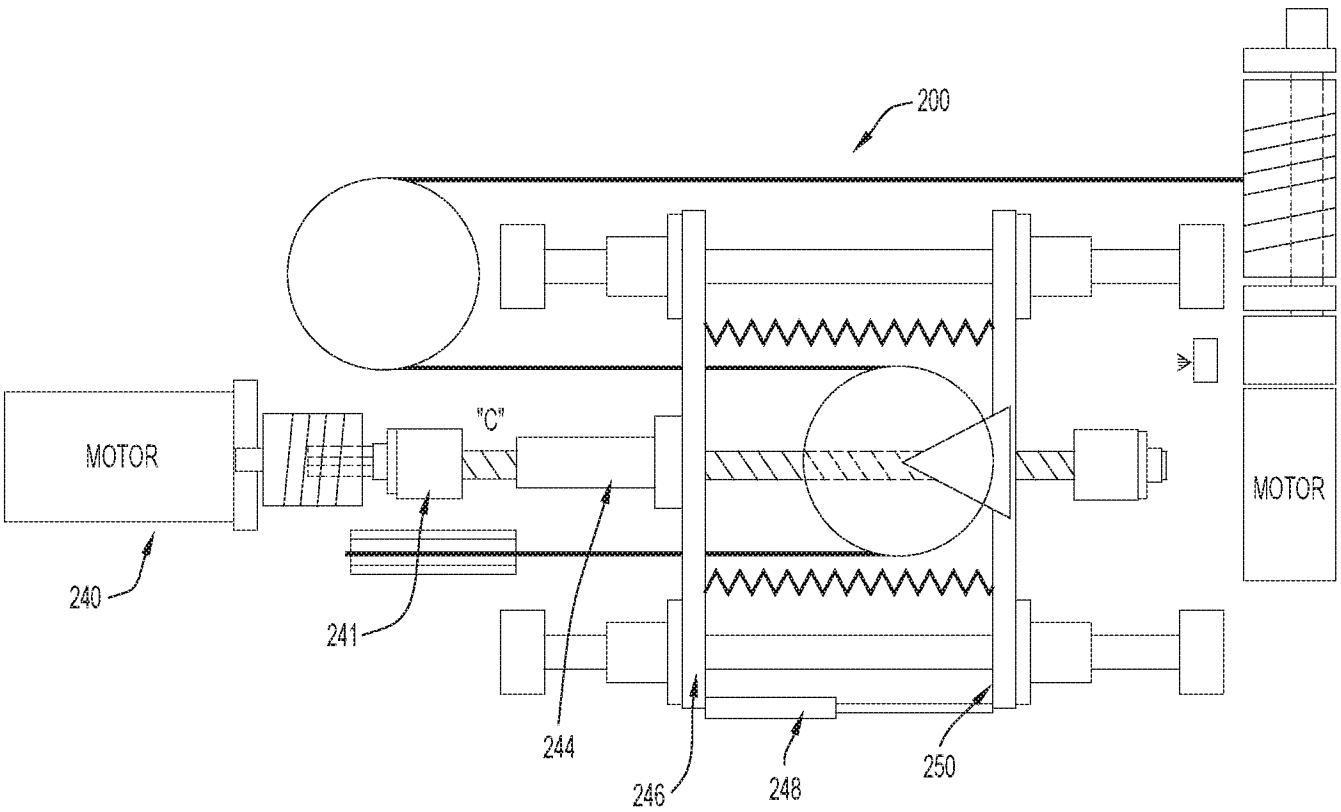
FIGS. 21-24 are schematic views illustrating the operation of the body-weight support system, according to example embodiments.

In the static state, the rope 220 comes off the winch drum 210, wraps around the fixed re-director pulley 262, around the pulley-plate pulley 263, over the drop-down pulley 222 and then down to the subject (see FIGS. 20A and 21). To apply tension in the rope 220, the ball-screw motor 240 turns the ball-screw 242 which in turn causes the ball-screw nut 244 to advance the ball-screw plate 246 toward the pulley plate 250. As a result, this movement causes the springs 280 and 282 to compress, causing a force against the pulley plate 250: F=k*dx (see FIG. 22).

The ball-screw plate 246 moves at a slow and constant velocity towards the pulley plate 250, compressing the springs 280 and 282 at a constant rate. The controller running on the computer monitors the tension in the rope 220 using a single-axis force sensor so that the springs 280 and 282 are compressed until the desired magnitude of unloading force is achieved. In one embodiment, the maximum rope tension is 150 lbs. In other embodiments, rope having different properties can be used.

As the subject walks, the pulley plate 246 will move back and forth. In order to maintain the force in the rope 220 constant, the spring deflection, dx, must remain constant. The linear encoder 248 measures the instantaneous length of the springs 280 and 282 and if the dimension "dx" varies, the ball-screw motor 240 turns on and moves the ball-screw plate 246 to the left or to the right in order to maintain the spring deflection (dx) at the desired level of compression (see FIGS. 23 and 24). The pulley plate 250 moves back and forth along the direction of arrow "A" in FIG. 24 as the subject walks. The force sensor is also monitored continuously so that if the average rope force is too low, the springs 280 and 282 are compressed, or if the force is too high, the springs 280 and 282 are uncompressed.

In the event that a subject traverses obstacles such as ramps or stairs, the pulley plate 250 may move a significant amount. The ultrasonic sensor measures the location of the pulley plate 250 with respect to the rod support blocks 260. If either the ball-screw plate 246 or the pulley plate 250 moves too close to the rod support blocks 260, the winch motor 230 will turn on and either let rope 220 out (in the case when the ball-screw plate 246 is too close to the rod support blocks 260 shown on the left ends of rods 254 in FIG. 20A) or spool the rope 220 up (in the case when the pulley plate 250 is too close to the rod support blocks 260 shown on the right ends of rods 254 in FIG. 20A). During this time, the linear encoder 248 continues to measure the spring length and causes the ball-screw motor 240 to be activated if the desired amount of spring compression varies.

According to the gait training via perturbations techniques described in greater detail below, ball-screw motor 240 may be utilized to initiate perturbations to provide gait training for a subject or patient. For example, in response to controller 510 of FIG. 25, ball-screw motor 240 may turn on and move the ball-screw plate 246 to the left or to the right in order to increase the tension in rope 220. If the trolley is offset from the subject or patient in a horizontal direction, this increase in tension of rope 220 will result in a horizontal force or perturbation being applied to the patient or subject to which body weight support was previously being provided.

According to other example embodiments, ball-screw motor 240 may be utilized to initiate a negative perturbation to the patient, as also described in more detail below. Accordingly, in response to controller 510 of FIG. 25, ball-screw motor 240 may turn on and move the ball-screw plate 246 to the left or to the right in order to decrease the tension in rope 220 to apply a negative perturbation to the patient.

Figure 22:
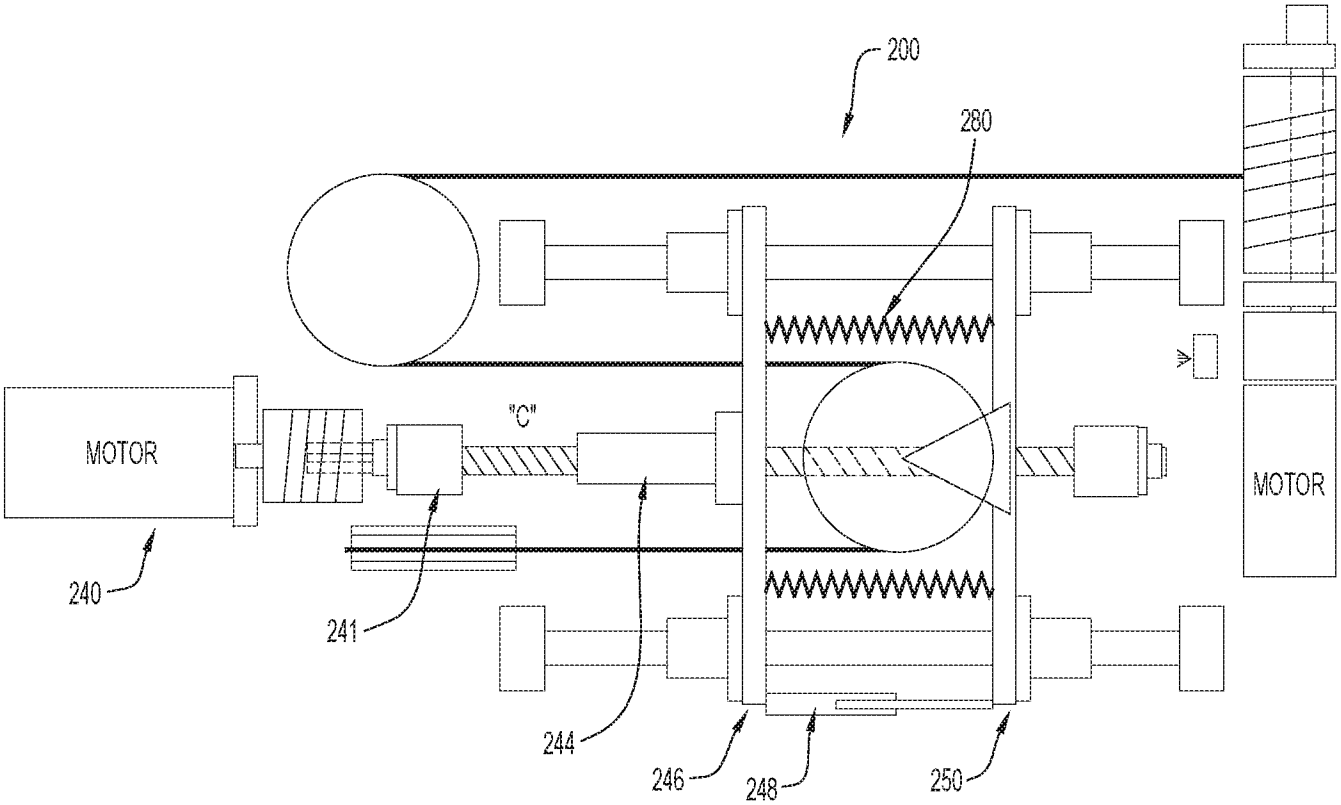

Referring to FIG. 21, the distance between the ball-screw support block 241 and the ball-screw nut 244 is illustrated as "C." In FIG. 22, the ball-screw motor 240 is activated to move the ball-screw plate 246 along the direction of arrow "D." As a result, the distance "C" between the support block 241 and the ball-screw nut 244 increases. Similarly, the distance between the ball-screw plate 246 and the rod support blocks 260 increases.

Figure 23:
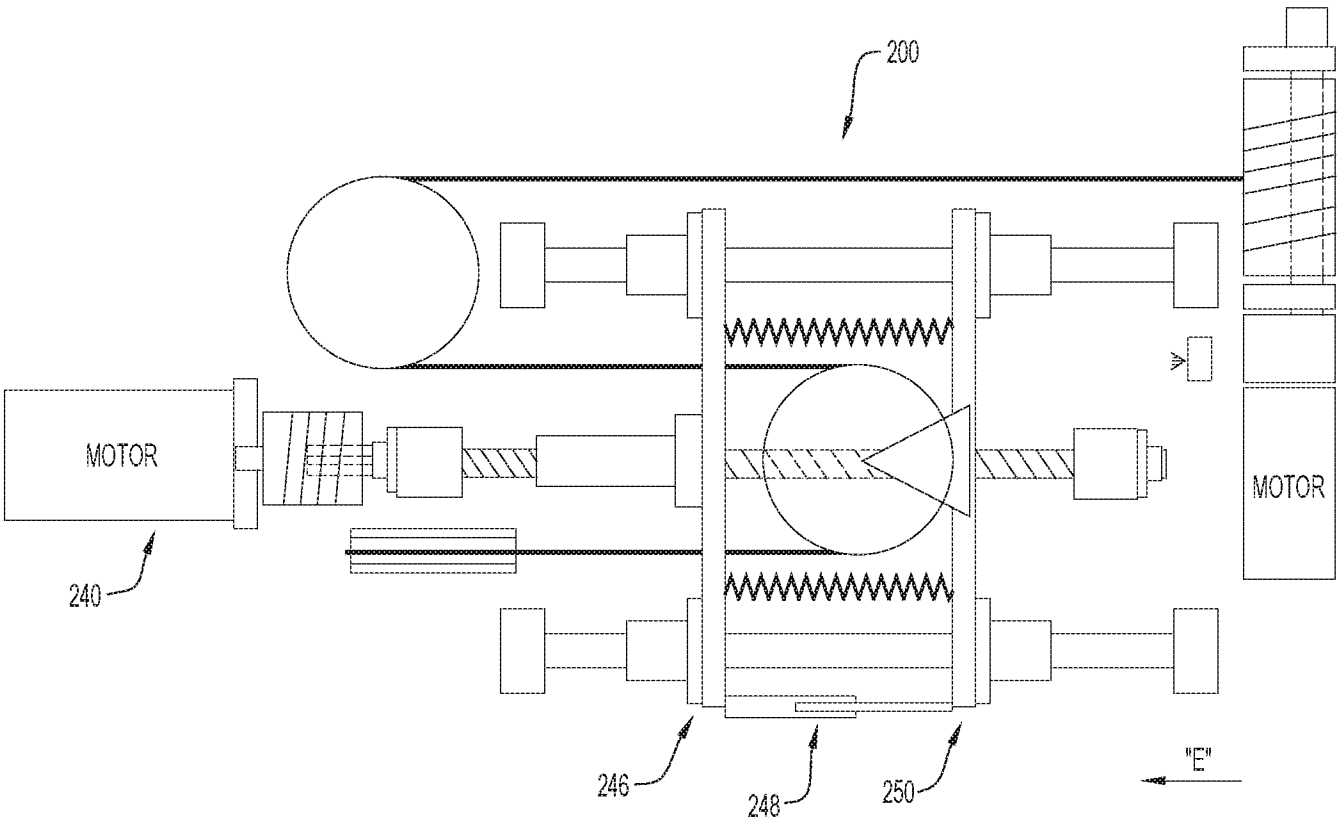
Figure 24:
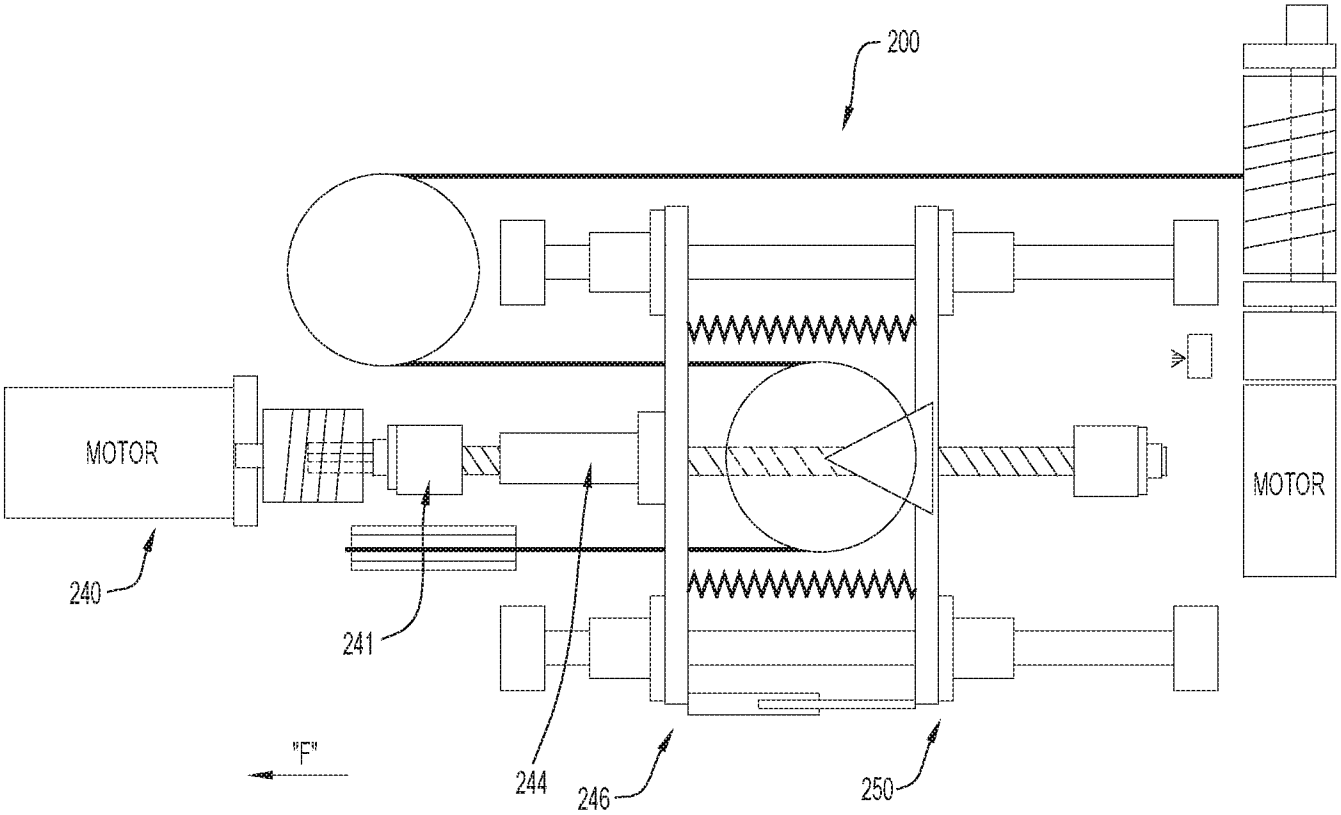

Referring to FIG. 23, the ball-screw motor 240 has been activated and the ball-screw plate 246 and the pulley plate 250 are moved along the direction of arrow "E." As a result, the length of the rope 220 extending downwardly from the support system 200 increases, thereby lowering the spreader bar 302. Referring to FIG. 24, the ball-screw motor 240 is further activated and the ball-screw plate 246 and the pulley plate 250 are moved along the direction of arrow "F."

Figure 20B:
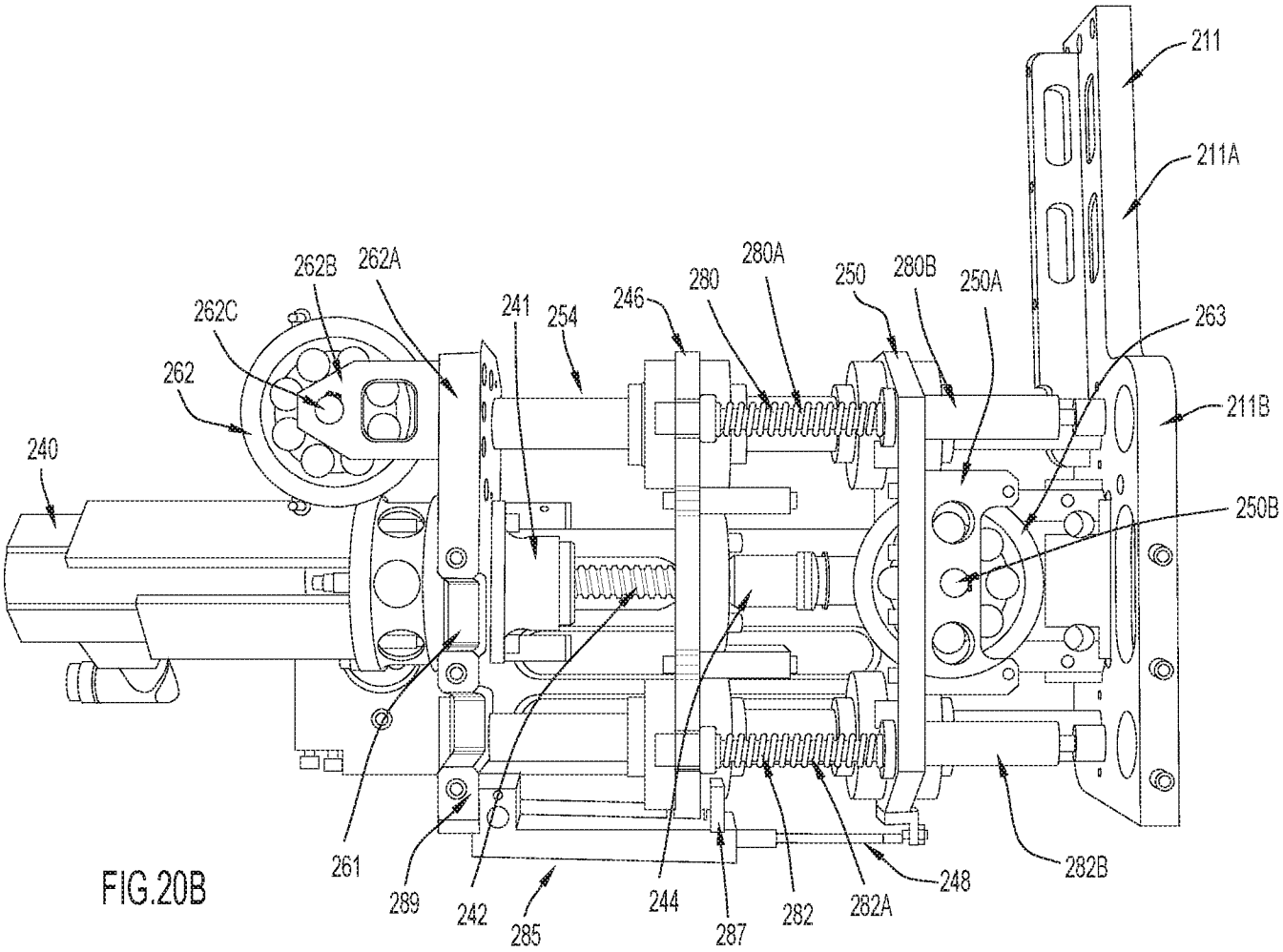
FIG. 20B is a top view of an alternative unloading system, according to example embodiments.

Referring to FIG. 20B, an alternative embodiment of an unloading system according to the present disclosure is illustrated. Some of the components in the unloading system illustrated in FIG. 20B are similar to components in the unloading system illustrated in FIGS. 20A and 21-24. Accordingly, like reference numerals are used to designate like components.

As illustrated, the ball-screw drive 240 is supported on a base plate 261 and is configured to rotate the ball-screw 242. The ball-screw 242 extends from support block 241 and moves ball-screw nut 244 as it rotates. Movement of the ball-screw nut 244 along the ball-screw 242 causes movement of the ball-screw plate 246. As shown, spring 280 is mounted between plates 246 and 250. Spring 280 is mounted on a rod 280A that extends therethrough and that provides lateral stability to the spring 280. Rod 280A is coupled to rod 280B. Similarly, spring 282 is mounted on a rod 282A that extends therethrough and that provides lateral stability to the spring 282. Rod 282A is coupled to rod 282B. Linear encoder 248, which detects the distance between plates 246 and 250, is illustrated as well.

In this embodiment, the base plate 261 includes a mounting portion 262A to which a pair of supports 262B is coupled (only one support 262B is shown in FIG. 20B). Pulley 262, described above, is rotatably mounted on an axle 262C that has ends that are mounted in an opening in each of the supports 262B.

Referring to FIG. 20B, the pulley plate 250 includes a pair of supports 250A coupled thereto (only one support 250A is shown in FIG. 20B). Each of the supports 250A includes a hole or opening in which an end of an axle 250B is inserted. Pulley 263 is rotatably mounted on the axle 250B. The unloading system also includes a mounting plate 211 with a mounting portion 211A to which the winch drum 210 is rotatably mounted. The mounting plate 211 also includes a portion 211B to which ends of the support rods 254 are coupled.

In this embodiment, the unloading system includes a sensor 285 that measures the distance between the base plate 261 and the ball-screw plate 246, which in turn allows for the positions of the ball-screw plate 246 and the pulley plate 250 to be calculated and determined. In one implementation, the sensor 285 is an ultrasonic sensor that includes an emitter 289 and a reflecting plate 287. The emitter 289 is coupled or mounted to the base plate 261. The reflecting plate 287 is coupled or mounted to the ball-screw plate 246. Once the positions of the emitter 289 and the reflecting plate 287 are calibrated with the control system, the sensor 285 can determine the position of the ball-screw plate 246 and in turn, the pulley plate 250. In other embodiments, the sensor 285 can have a different structure or utilize different components.

In normal operation, the springs 280 and 282 compress and the ball-screw plate 246 and the pulley plate 250 move back and forth as a unit. If the lengths of the springs 280 and 282 remain constant, the force on the springs does as well. The ball-screw plate 246 and the pulley plate 250 can move back and forth in the area between the base plate 261 and the mounting plate 211, as shown in FIG. 20B. For a large change in vertical excursion, such as when a subject steps off a stair or stands up, plates 246 and 250 can rapidly approach one end of the area between base plate 261 and mounting plate 211. When the plates 246 and 250 engage one end of the area, the plates 246 and 250 can bottom out and be difficult to move. The control system includes an algorithm that is used to center the ball-screw plate 246 and the pulley plate 250 in the middle region along the rails or support rods 254 and away from the ends of the rods 254. If one of the plates 246 and 250 runs into an end, the ball-screw motor 242 cannot adjust the spring length appropriately and the force on the rope 220 changes. By controlling the position of the ball-screw plate 246 and the pulley plate 250, the unloading system allows for large changes in vertical position of the subject while simultaneously keeping the force on the system and the rope 220 constant.

Accordingly, the sensor 285 monitors where the two-plate unit (including the ball-screw plate 246 and the pulley plate 250) is located along the support rods or rails 254. If the ball-screw plate 246 and the pulley plate 250 move too close to one end of the travel area, the controller turns on the winch motor 230 which causes the winch 210 to rotate. In the case where the subject moves downwardly quickly, the two-plate unit can move too close to the end of the area proximate to the base plate 261. In this scenario, the winch motor 230 causes the winch 210 to rotate in the direction in which rope 220 is let out from the winch 210 and around pulley 263. Movement of the rope 220 in that direction permits the ball-screw plate 246 and the pulley plate 250 to be re-centered in the area between base plate 261 and mounting plate 211. At the same time as the activation of the winch motor 230, the ball-screw motor 242 is activated to maintain the length of the springs 280 and 282 constant, which in turn keeps the force being unloaded by the unloading system constant.

In the case where the subject moves upwardly quickly, the two-plate unit moves too close to the end of the area proximate to the mounting plate 211. In this scenario, the winch motor 230 causes the winch 210 to rotate in the direction in which rope 220 is pulled up toward the trolley and wound onto the winch 210. Movement of the rope 220 in that direction permits the ball-screw plate 246 and the pulley plate 250 to be re-centered in the area between base plate 261 and mounting plate 211. At the same time as the activation of the winch motor 230, the ball-screw motor 242 is activated to maintain the length of the springs 280 and 282 constant, which in turn keeps the force being unloaded by the unloading system constant.

Figure 25:
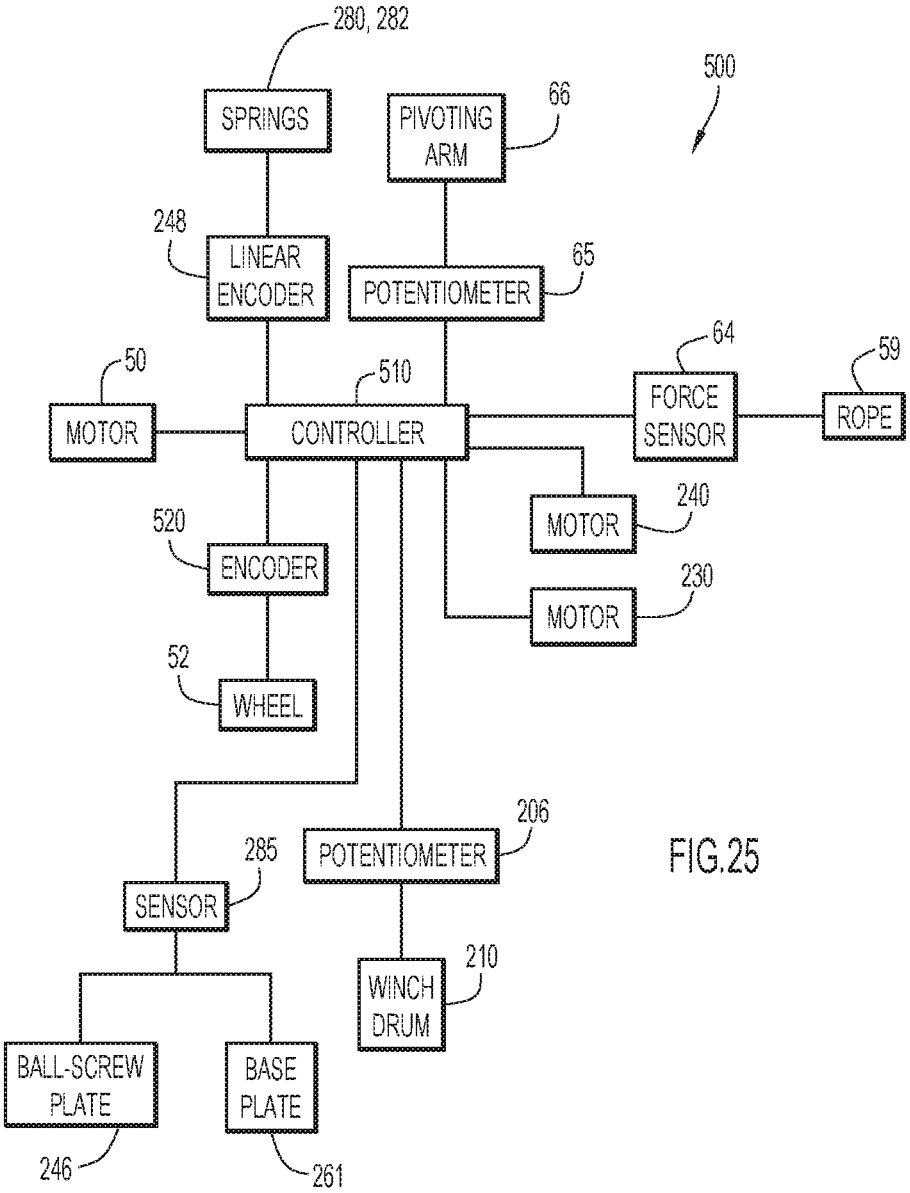
FIG. 25 is a schematic block diagram a control system of a body-weight support system, according to example embodiments.

The system described above is controlled via a standard computer, such as a personal computer or PC, that contains data acquisition cards which acquire data from the system's sensors. The system described above may also be controlled by portable computing devices (e.g., laptop computers), smart devices (e.g., smart phones) or tablet computing devices. An exemplary embodiment of a control system is illustrated in FIG. 25. In this embodiment, the control system 500 includes a controller 510. Controller 510 may be embodied an apparatus as described in greater detail below with reference to FIG. 59.

Controller 510 that is configured to receive various inputs from the sensors or detectors of the system. Some exemplary sensors on the device include an linear encoder 248 which measures the spring length of the springs 280 and 282, a free-wheel encoder 520 which measures the movement of the trolley 30 along the rail 40, a multi-turn potentiometer 206 which measures the winch drum 210 position, a precision potentiometer 65 which measure the pivoting arm angle 67 (for the trolley controller) of arm 66, and a single-axis force sensor 64 which measures the tension in the rope 220. Finally, the control system also includes sensor 285 that is configured to determine the distance between the ball-screw plate 246 and the base plate 261. In one embodiment, all of these sensors are in communication with the controller or a computer through data acquisition boards and are sampled a high rates (e.g. 1000 Hz). The system 500 includes the drive motor 50, the winch motor 230, and the ball-screw motor 240. Each of the motors 50, 230, and 240 is controlled based on the inputs from the corresponding sensors.

Figure 26:
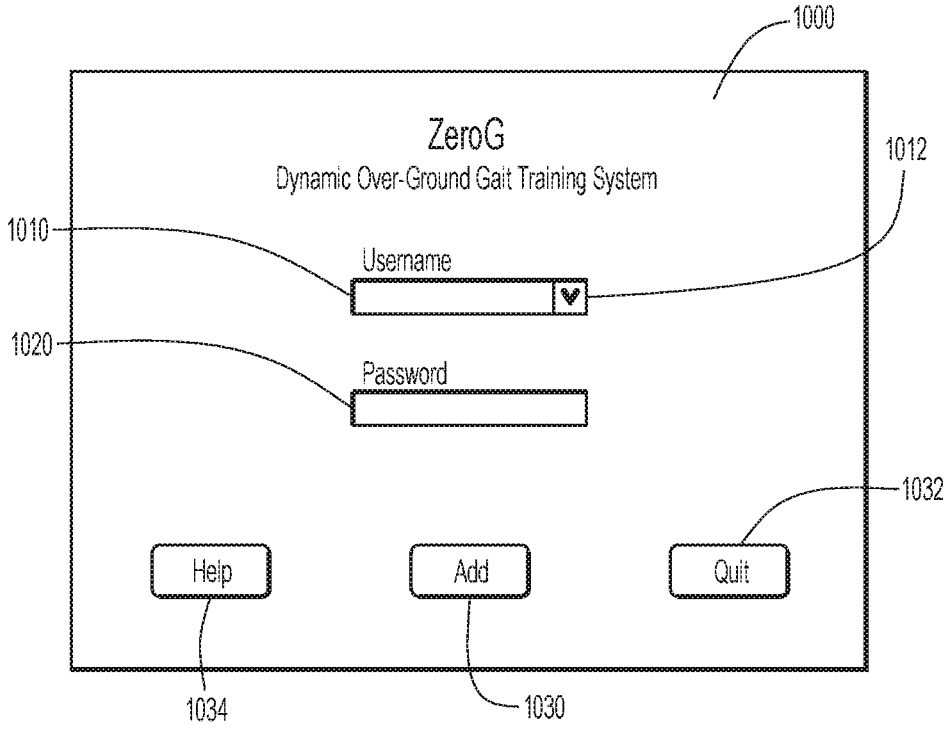
FIGS. 26-38 are user interfaces that can be used with the body-weight system, according to example embodiments.
Figure 27:
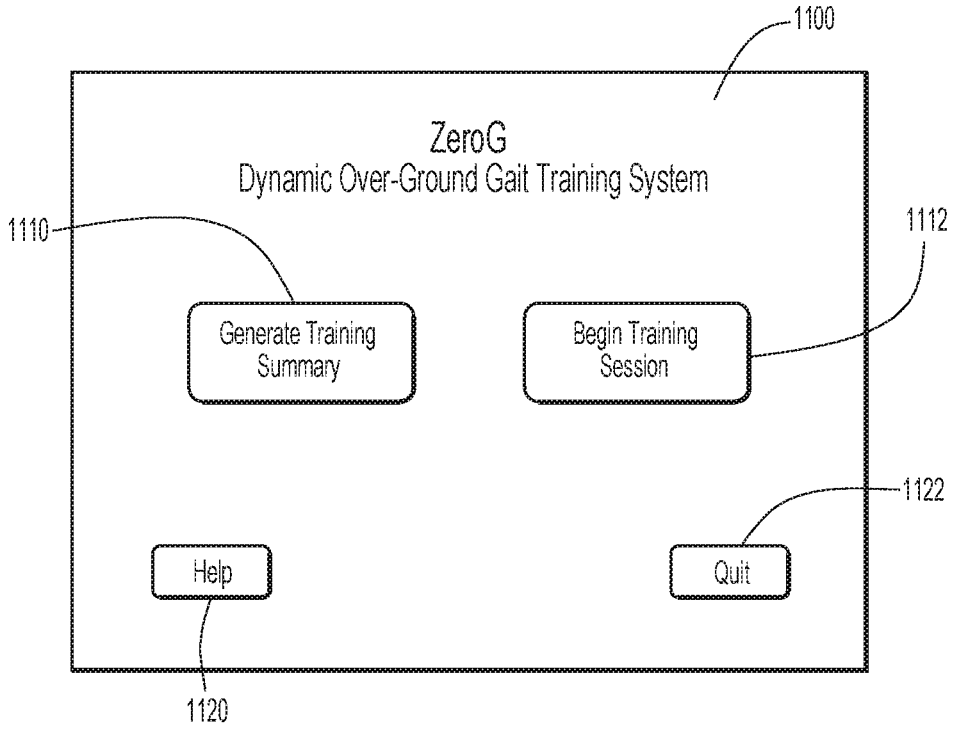

As mentioned above, the body-weight support system according to the present disclosure can be used with a graphical user interface. One exemplary interface system is illustrated in FIGS. 26-37. While FIGS. 26-27 illustrate various screens that can be used with the system, it is to be understood that the screens may have any configuration and may include different features or components than those illustrated herein. The buttons on the interfaces can be referred to alternatively as inputs or input mechanisms.

Referring to FIG. 26, an initial screenshot or interface is illustrated. Interface 1000 is an introductory screen in which a therapist or other caregiver enters or logs on to the system. An entry field 1010 in which the therapist enters his or her name is provided along with a corresponding drop down arrow 1012 that can be selected to access pre-entered information, such as various names. An entry field 1020 is provided in which the user can enter a password. Several buttons are provided for additional inputs by a user. An "Add" button 1030 can be selected to add a new user to the database of users. A "Quit" button 1032 can be selected to end the entering or logging on process. A "Help" button 1034 can be selected when assistance is needed or desired.

Referring to FIG. 27, another interface or screen 1100 is illustrated. Interface 1100 includes a "Generate Training Summary" button 1110 that can be selected by a user to cause the computer system to generate an output based on the detected data. For example, when a user selects button 1110, an output in the form of a graph, such as the graph illustrated in FIG. 38, can be generated. Alternatively, when a user selects button 1110, an interface such as interface 1900 can be displayed and subsequently used as described below. Interface 1100 also includes a "Begin Training Session" button 1112 that can be selected by a user to start a new training session for a subject. If button 1112 is selected, the next user interface can be similar to interface 1120 illustrated in FIG. 28. Referring back to FIG. 27, a "Help" button 1120 and a "Quit" button 1122 can be provided as well.

Figure 28:
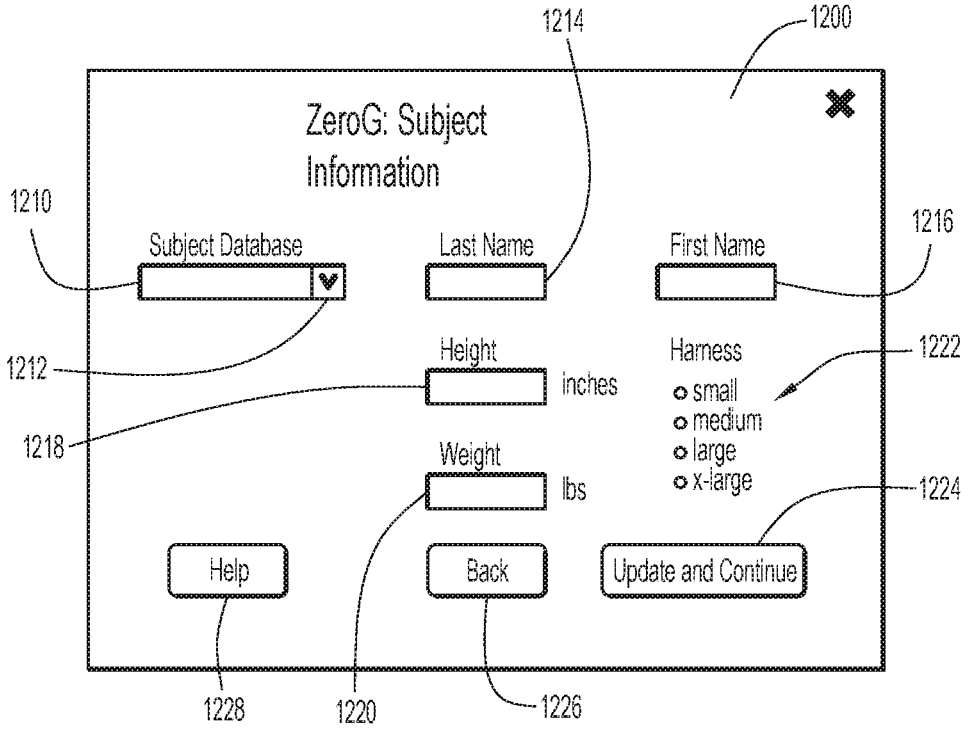

Referring to FIG. 28, an exemplary interface for the start of a new training session is illustrated. Interface 1200 includes an entry field 1210 and associated drop-down arrow 1212 that allows a user to enter a new database or select an existing database. Interface 1200 includes entry fields for the subject's "Last Name" (see field 1214), "First Name" (see field 1216), "Height" (see field 1218), and "Weight" (see field 1220). Interface 1200 also includes a harness selection area 1222 which sets forth various sizes of harnesses and enables a user to select therefrom. When the foregoing information has been entered by a user, the "Update and Continue" button 1224 can be selected by a user. Interface 1200 also includes a "Back" button 1226 and a "Help" button 1228. In different embodiments, additional or alternative fields can be provided in interface 1200 in which other information relating to the subject can be entered.

Figure 29:
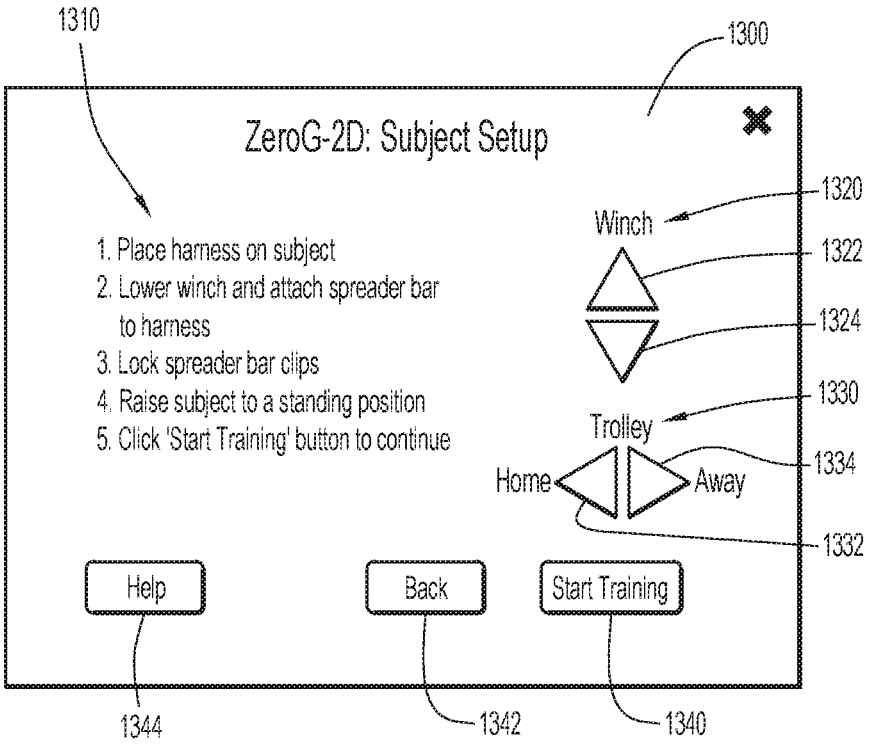

Referring to FIG. 29, an interface or screen associated with the setting up of a subject is illustrated. In this embodiment, the interface 1300 includes an instruction section 1310 that sets forth the various steps. Interface 1300 includes a Winch section 1320 that includes an up button 1322 and a down button 1324. The user can raise or lower the spreader bar 302 by way of selecting the corresponding up button 1322 or down button 1324 that controls the movement of the winch 210. Similarly, the interface 1300 includes a Trolley section 1330 that includes a home button 1332 and an away button 1334 that can be selected by the user to move the trolley in the desired direction. Once the winch 210 and the trolley 30 have been moved to their desired positions, the user can select the "Start Training" button 1340. Interface 1300 also includes a "Back" button 1342 and a "Help" button 1344.

Figure 30:
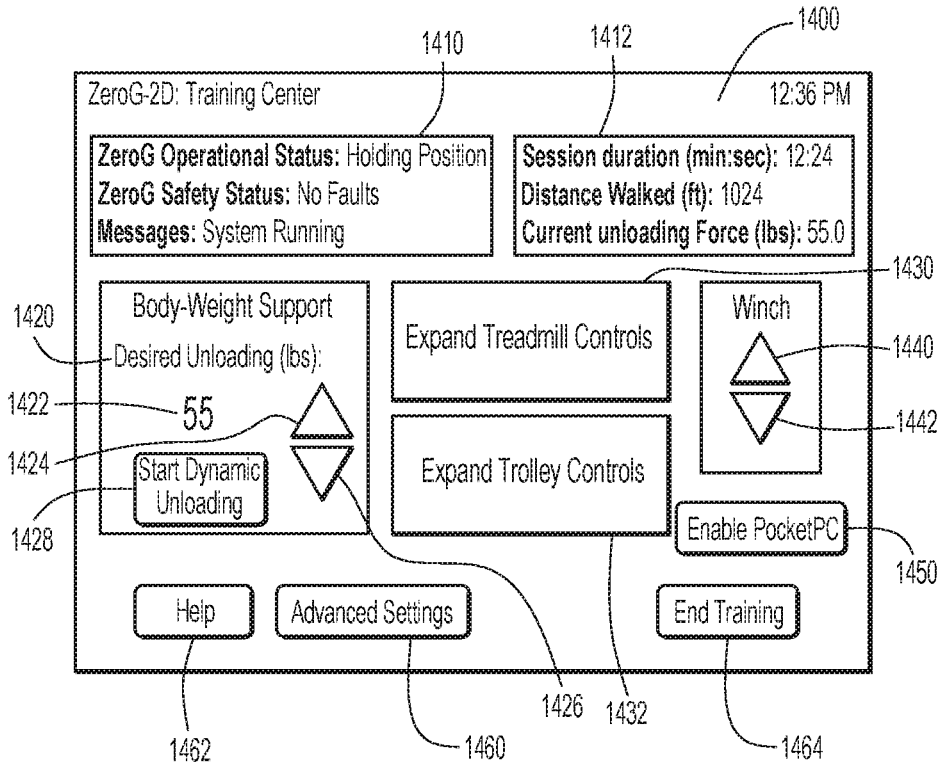

Referring to FIG. 30, an exemplary interface of a training center is illustrated. In this embodiment, the interface 1400 includes two informational sections 1410 and 1412 that provide information relating to the current training session. In other embodiments, the informational sections 1410 and 1412 can include different information than that shown in FIG. 30. Interface 1400 includes a body-weight support portion 1420 in which the desired unloading can be selected. The particular unloading amount in the unit of lbs is indicated by indicia 1422, which in this example is 55 lbs. In other embodiments, the units can be changed to kilograms or other unit of measure. Up and down buttons 1424 and 1426 respectively can be selected by the user to change the desired unloading as indicated by indicia 1422 accordingly. Once the desired unloading amount is correct, the user can select the "Start Dynamic Unloading" button 1428. Interface 1400 includes other inputs or buttons that the user can select. As shown in FIG. 30, a button 1430 entitled "Expand Treadmill Controls" is provided that enables a user to see a more detailed view of the controls for the treadmill feature of the system (see interface 1500 illustrated in FIG. 31 for example, which is described below). In addition, interface 1400 includes a button 1432 entitled "Expand Trolley Controls" which enables a user to see a more detailed view of the controls of the trolley of the system (see interfaces 1600 and 1700 illustrated in FIGS. 32 and 33 for example, which is described below).

Referring back to FIG. 30, a Winch control section with an up button 1440 and a down button 1442 is provided. In addition, a button 1450 entitled "Enable PocketPC" is provided which allows a user to activate a wireless device, such as a handheld device, to operate the system therewith. Interface 1400 also includes an "Advanced Settings" button 1460, a "Help" button 1462, and an "End Training" button 1464.

Figure 31:
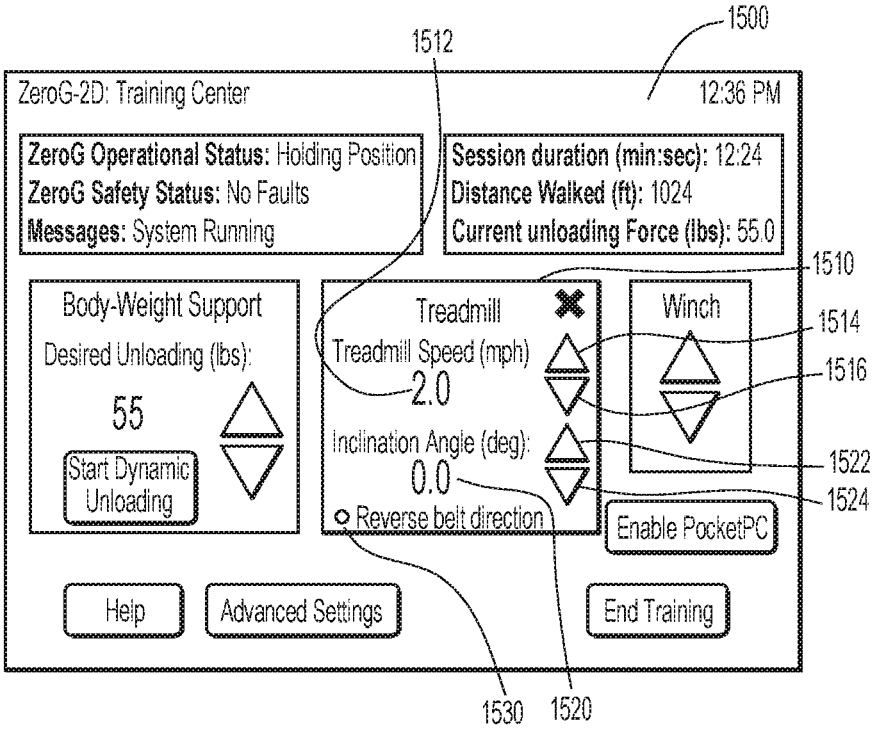

Referring to FIG. 31, an interface 1500 that has expanded Treadmill controls is illustrated. Interface 1500 is an exemplary interface that may be used with the system when a user selects the "Expand Treadmill Controls" button 1430 in interface 1400. For simplicity of the description, only the differences between interface 1500 and interface 1400 are described with respect to FIG. 31.

Interface 1500 includes a treadmill control section 1510 with an indicator or indicia 1512 that illustrates the current speed of the treadmill with which the body-weight support system is being used. While indicator 1512 is illustrated in units of mph, alternative units such as kilometers per hour may be in alternative systems. Up and down buttons 1514 and 1516, respectively, can be selected by a user to vary the treadmill speed as desired. In addition, the angle of inclination of the treadmill is shown by indicator 1520 in units of degrees. Buttons 1522 and 1524 can be selected by the user to increase or decrease the angle of inclination as desired. A user input 1530 for reversing the direction of the travel of the belt of the treadmill is also provided.

Figure 32:
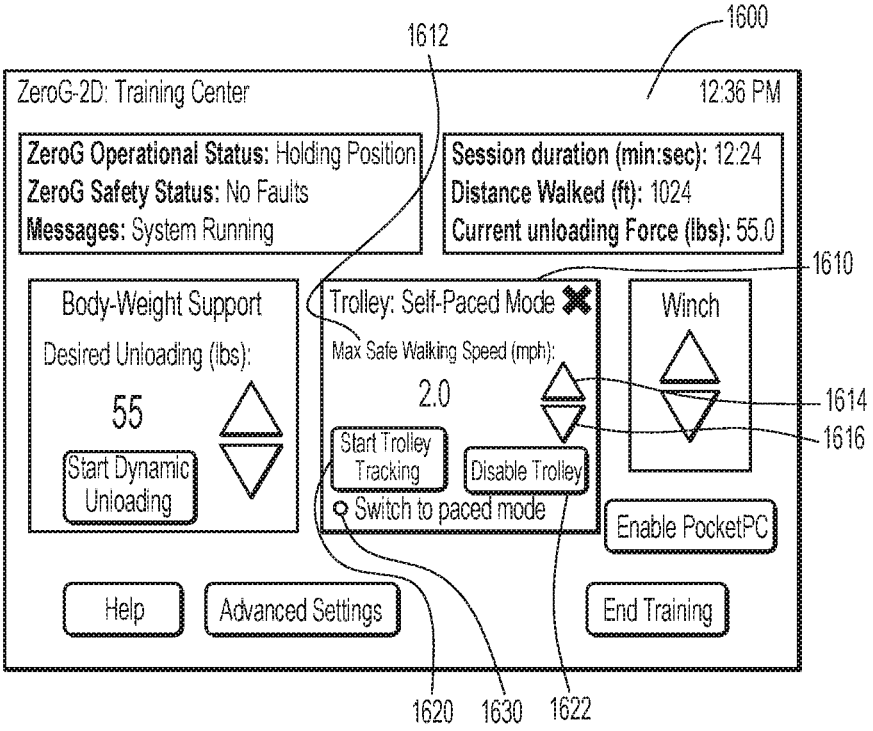

Referring to FIG. 32, an interface 1600 that has expanded Trolley controls is illustrated. Interface 1600 is an exemplary interface that may be used with the system when a user selects the "Expand Trolley Controls" button 1432 in interface 1400. For simplicity of the description, only the differences between interface 1600 and interface 1400 are described with respect to FIG. 32.

Interface 1600 includes a trolley control section 1610 with an indicator or indicia 1612 that illustrates the current speed of the treadmill with which the body-weight support system is being used. While indicator 1612 is illustrated in units of mph, alternative units such as kilometers per hour may be in alternative systems. In this embodiment, the trolley is operating in a self-paced mode. Up and down buttons 1614 and 1616, respectively, can be selected by a user to vary the treadmill speed as desired. The trolley control section 1610 includes a "Start Trolley Tracking" button 1620 and a "Disable Trolley" button 1622. A user input 1630 for switching the mode of trolley control to a paced mode is also provided. The "X" in the top right corner of the trolley control section 1610 can be selected by a user to close the trolley control section 1610 and return to interface 1400.

Figure 33:
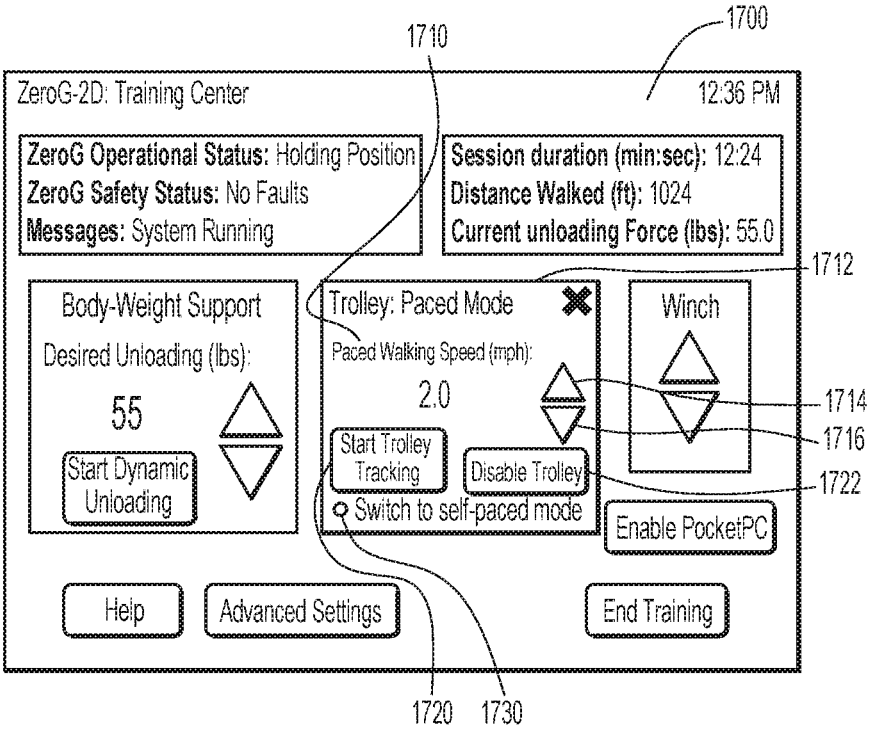

Referring to FIG. 33, an interface 1700 that has expanded Trolley controls different than the controls shown in interface 1600 is illustrated. Interface 1700 is an exemplary interface that may be used with the system when a user selects the "Expand Trolley Controls" button 1432 in interface 1400. For simplicity of the description, only the differences between interface 1700 and interface 1400 are described with respect to FIG. 33.

Interface 1700 includes a trolley control section 1710 with an indicator or indicia 1712 that illustrates the paced walking speed of the treadmill with which the body-weight support system is being used. While indicator 1712 is illustrated in units of mph, alternative units such as kilometers per hour may be in alternative systems. In this embodiment, the trolley is operating in a paced mode. Up and down buttons 1714 and 1716, respectively, can be selected by a user to vary the treadmill speed as desired. The trolley control section 1710 includes a "Start Trolley Tracking" button 1720 and a "Disable Trolley" button 1722. A user input 1730 for switching the mode of trolley control to a self-paced mode is also provided.

Figure 34:
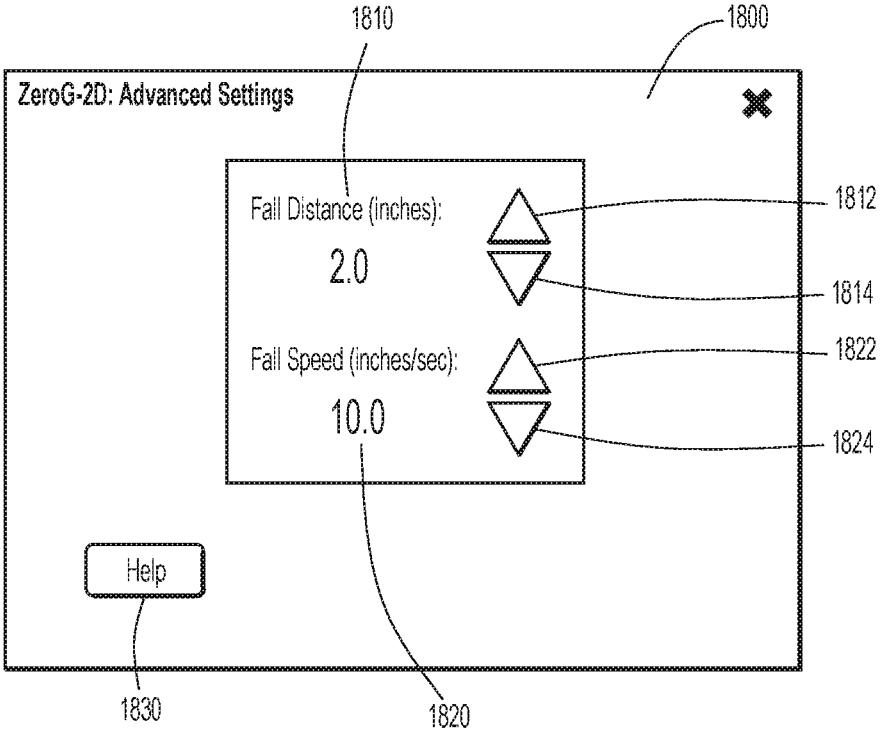

Referring to FIG. 34, an interface 1800 that sets forth "Advanced Settings" controls is illustrated. Interface 1800 is an exemplary interface that may be used with the system when a user selects the "Advanced Settings" button 1460 in interfaces 1400, 1500, 1600, or 1700.

Interface 1800 includes an indicator or indicia 1810 that identifies the selected fall distance limit for the subject using the body-weight support system. While the fall distance limit in indicator 1810 is identified in inches, alternative units such as centimeters may be in alternative systems. Interface 1800 includes buttons 1812 and 1814 that can be selected by a user to increase or decrease the fall distance as desired. Interface 1800 also includes a fall speed section with a fall speed indicator 1820 that identifies the desired fall speed of the patient. While the indicator 1820 is in units of inches per second, in other embodiments, the indicator 1820 can be in units of centimeters per second or other similar units. Interface 1800 includes buttons 1822 and 1824 that can be selected by a user to increase or decrease the fall speed as desired. A user input 1830 entitled "Help" can be provided as well.

Figure 35:
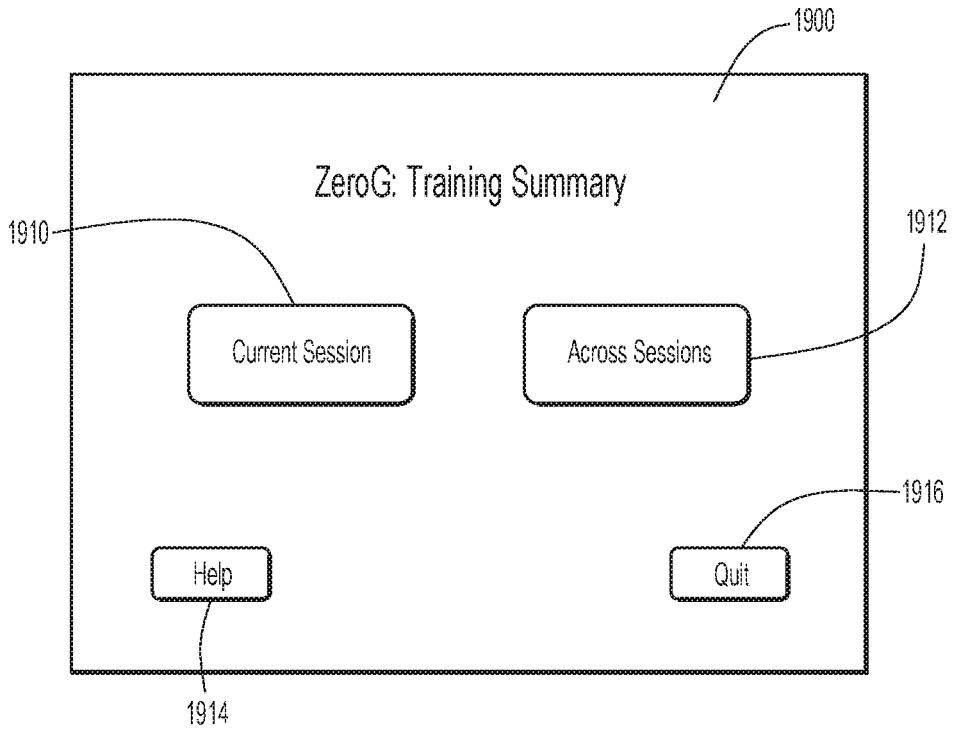

Referring to FIG. 35, an interface 1900 relating to training summaries is illustrated. Interface 1900 is an exemplary interface that may be used with the system when a user selects the "Generate Training Summary" button 1110 in interface 1100. In other embodiments, interface 1900 can be reached upon the selection of a different button or input mechanism or the natural progression of the program upon the completion of a training summary.

Interface 1900 includes a "Current Session" button 1910 and an "Across Sessions" button 1912 that can be selected by a user to identify the data and training session(s) that are to be the basis for the training summary to be generated. Activation of the "Across Sessions" button 1912 causes data from multiple training sessions to be used in the summary. Interface 1900 includes a "Help" button 1914 and a "Quit" button 1916 as well.

Figure 36:
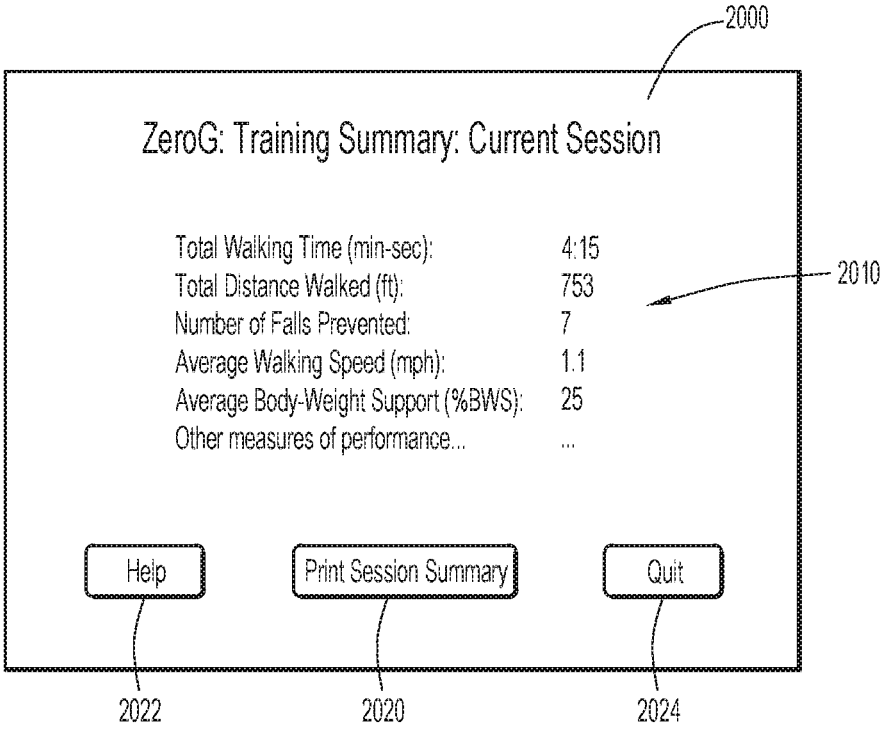

Referring to FIG. 36, an interface 2000 relating to a training summary based on a current session is illustrated. Interface 2000 is an exemplary interface that may be used with the system when a user selects the "Current Session" button 1910 in interface 1900 as described above relative to FIG. 35. In other embodiments, interface 2000 can be reached upon the selection of a different button or input mechanism or the natural progression of the program upon the completion of a training session.

Interface 2000 includes a data section 2010 that identifies various parameters or measurements of the training session. In this data section 2010, data or results relating to total walking time, total distance walked, number of falls prevented, average walking speed, and average body-weight support are displayed. In other embodiments, other types and units of data may be tracked by the system and displayed in data section 2010. Interface 2000 includes a "Print Session Summary" button 2020 that can be selected to print the data associated with the current training session. Interface 2000 also includes a "Help" button 2022 and a "Quit" button 2024.

Figure 37:
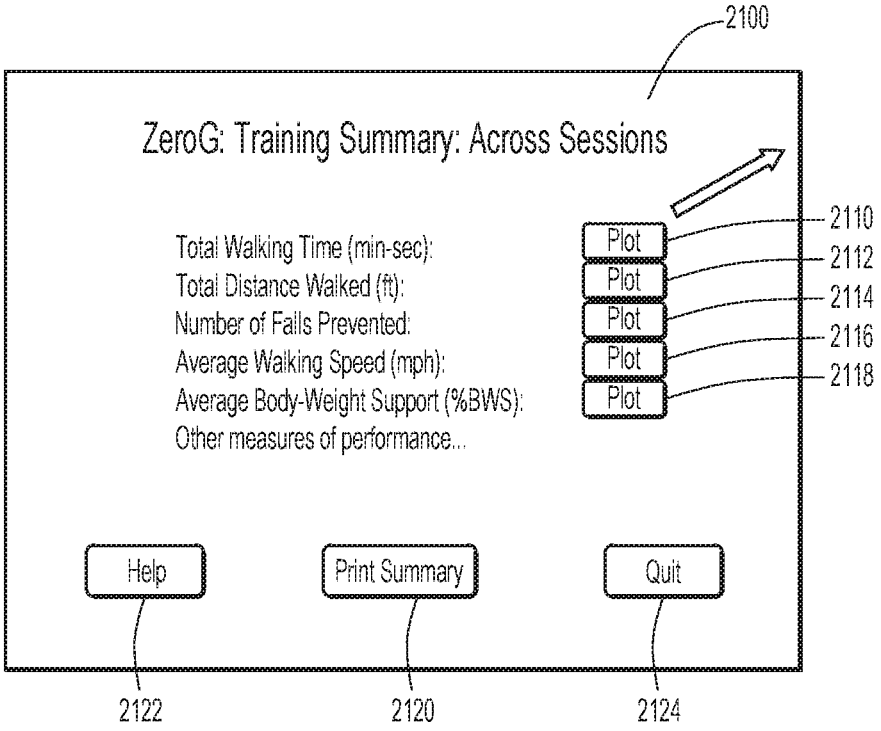

Referring to FIG. 37, an interface 2100 relating to a training summary based on multiple training sessions is illustrated. Interface 2100 is an exemplary interface that may be used with the system when a user selects the "Across Sessions" button 1912 in interface 1900 as described above relative to FIG. 35. In other embodiments, interface 2100 can be reached upon the selection of a different button or input mechanism or the natural progression of the program upon the completion of a training session.

Interface 2100 includes a section that identifies the various parameters or measurements of the training sessions that can be processed and output to the user. In this embodiment, data or results relating to total walking time, total distance walked, number of falls prevented, average walking speed, and average body-weight support can be selected and subsequently displayed. In other embodiments, other types and units of data may be tracked by the system and displayed.

Interface 2100 includes several "Plot" buttons 2110, 2112, 2114, 2116, and 2118, each of which is associated with a particular parameter or data measurement for the training sessions. Depending on the particular "Plot" button selected by the user, a different output is generated and displayed. Interface 2100 includes a "Print Summary" button 2120 that can be selected to print the summary associated with the training sessions. Interface 2100 also includes a "Help" button 2122 and a "Quit" button 2124.

Figure 38:
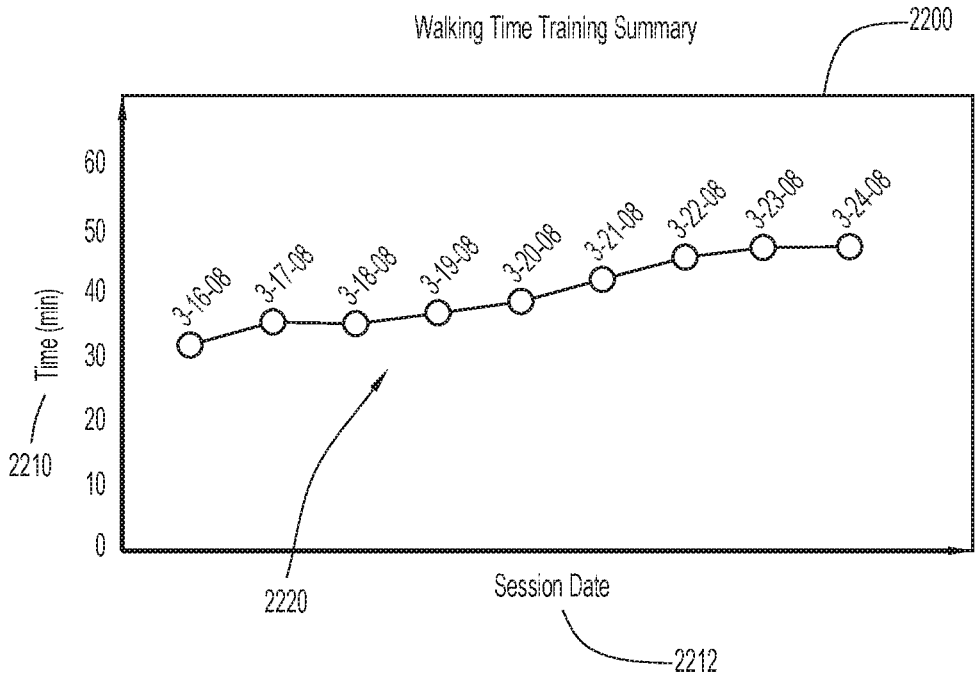

Referring to FIG. 38, an interface 2200 showing a plotted training summary across sessions is illustrated. Interface 2200 is an exemplary interface that may be used with the system when a user selects the "Plot" button 2110 in interface 2100 as described above relative to FIG. 37. If any of the other "Plot" buttons 2112, 2114, 2116, or 2118 is selected, a similar training summary plot can be generated with the appropriate units.

Interface 2200 includes the measured data 2210 along one axis and the session date along another axis 2212. In other embodiments, the session date can be replaced with other units of time, such as session time. Referring to FIG. 38, a line output 2220 is generated based on the time data on particular dates. The graph may include a title indicating the particular training session data, which in this example is "Walking Time Training Summary."

Figure 39:
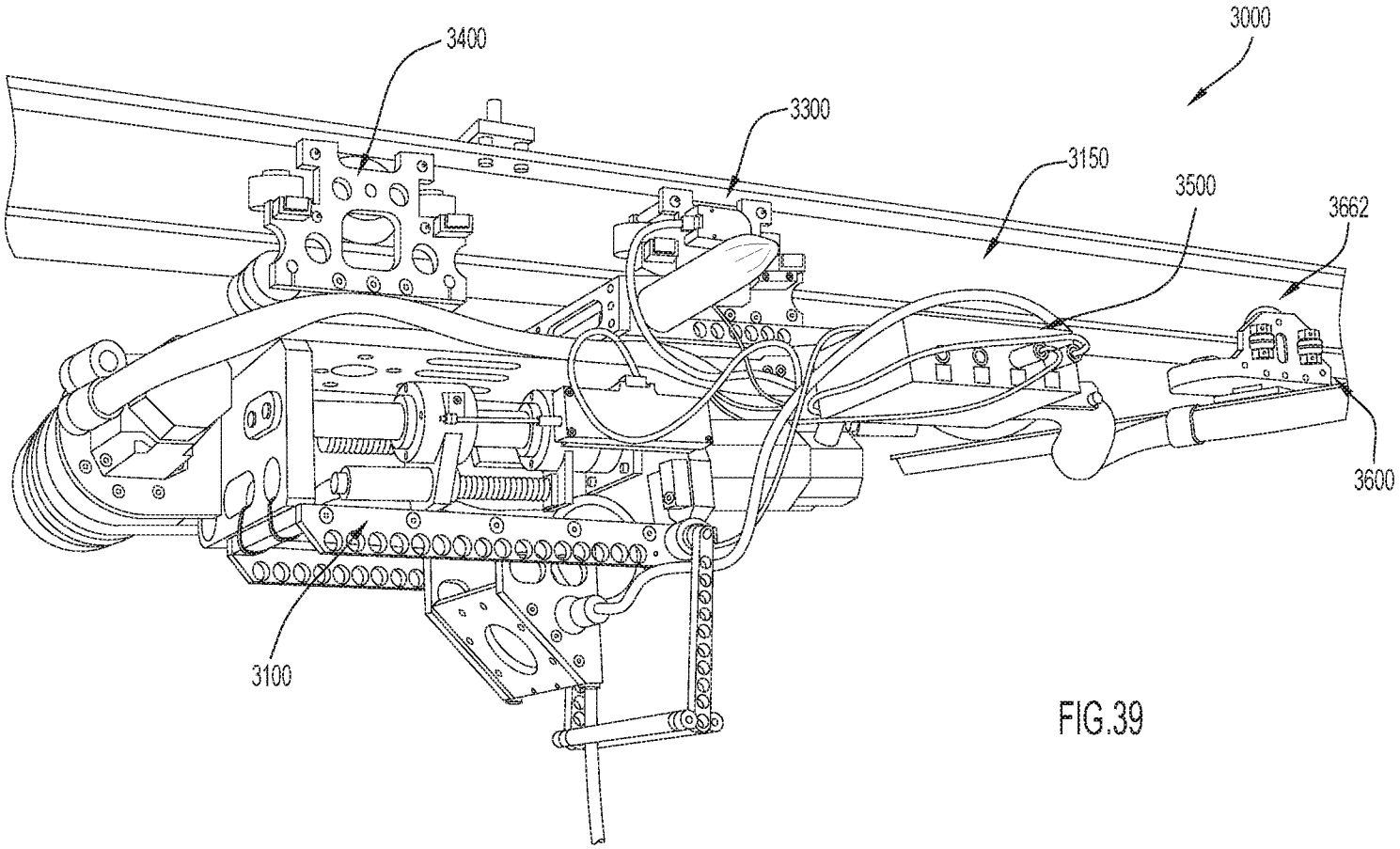
FIG. 39 is a perspective view of an alternative body-weight support system, according to example embodiments.
Figure 45:
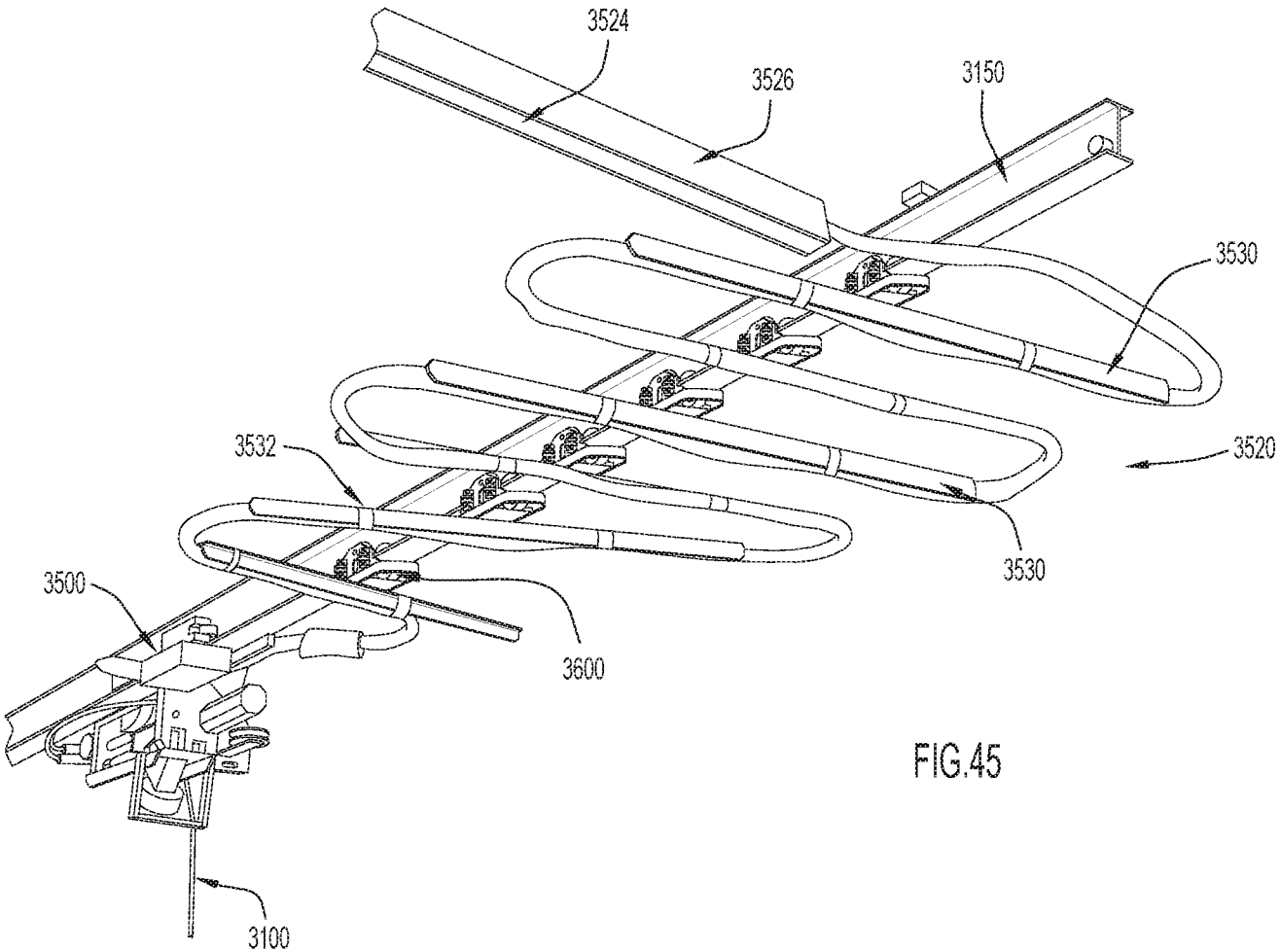
FIG. 45 is a perspective view of the body-weight support system illustrated in FIG. 39 mounted on a track, according to example embodiments.
Figure 46:
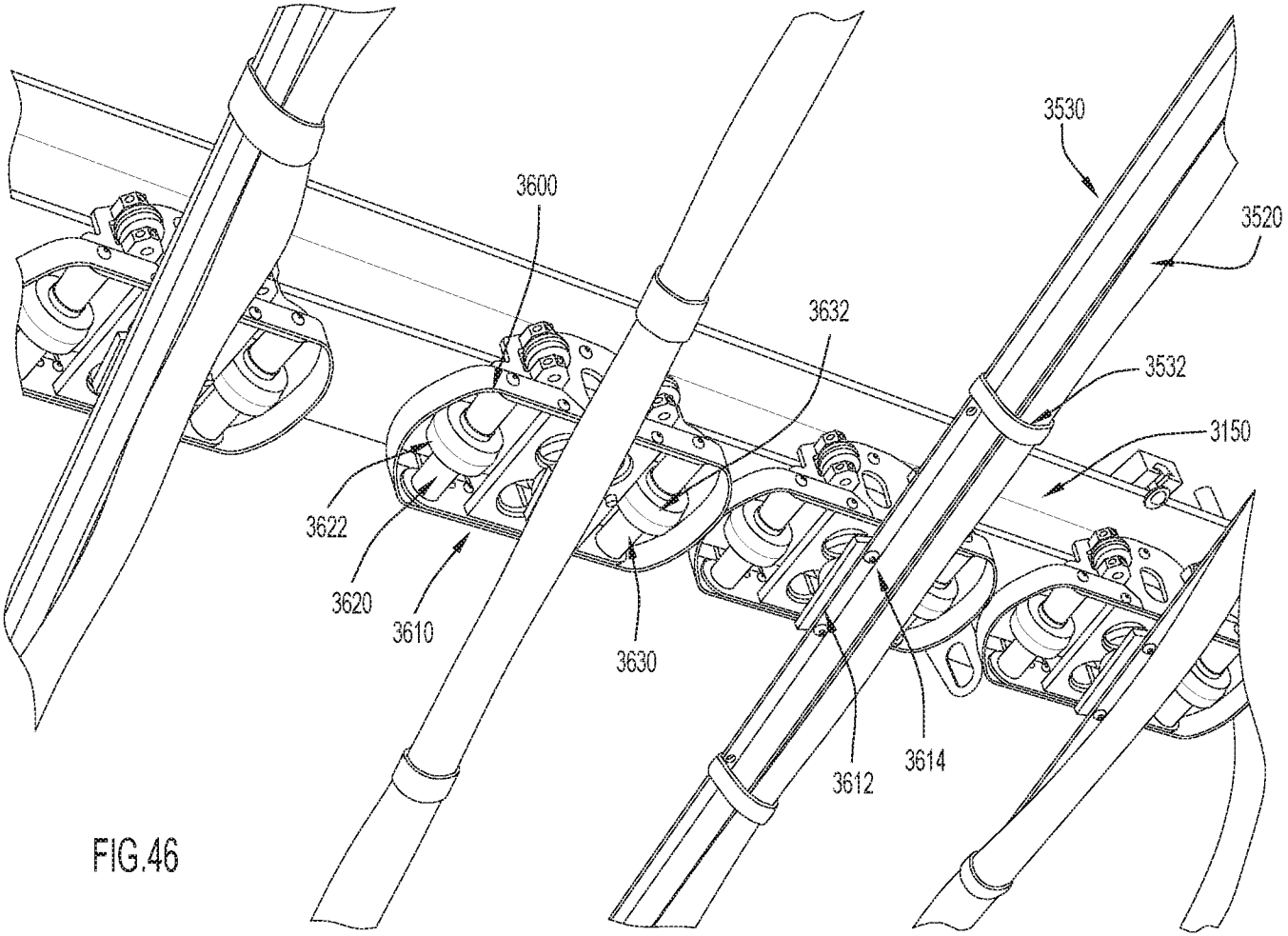
FIG. 46 is a close-up bottom view of the cables and festoons of the body-weight support system illustrated in FIG. 45, according to example embodiments.

An alternative embodiment of a body-weight support system is illustrated in FIGS. 39-46. In this embodiment, the body-weight support system 3000 includes a trolley 3100 that is movably mounted to a track 3150 as shown in FIG. 39. Rotatably coupled to the trolley 3100 are pivoting wheel assemblies 3400 and 3300, each of which is described in detail below. Also mounted to the trolley 3100 is an electrical housing 3500 to which various cables, wires or other communication links 3520 are connected. As shown in FIGS. 45 and 46, the cables or wires 3520 are coupled to multiple festoons 3600 that are slidably mounted to the track 3150 and movable by way of wheels 3662.

Figure 40:
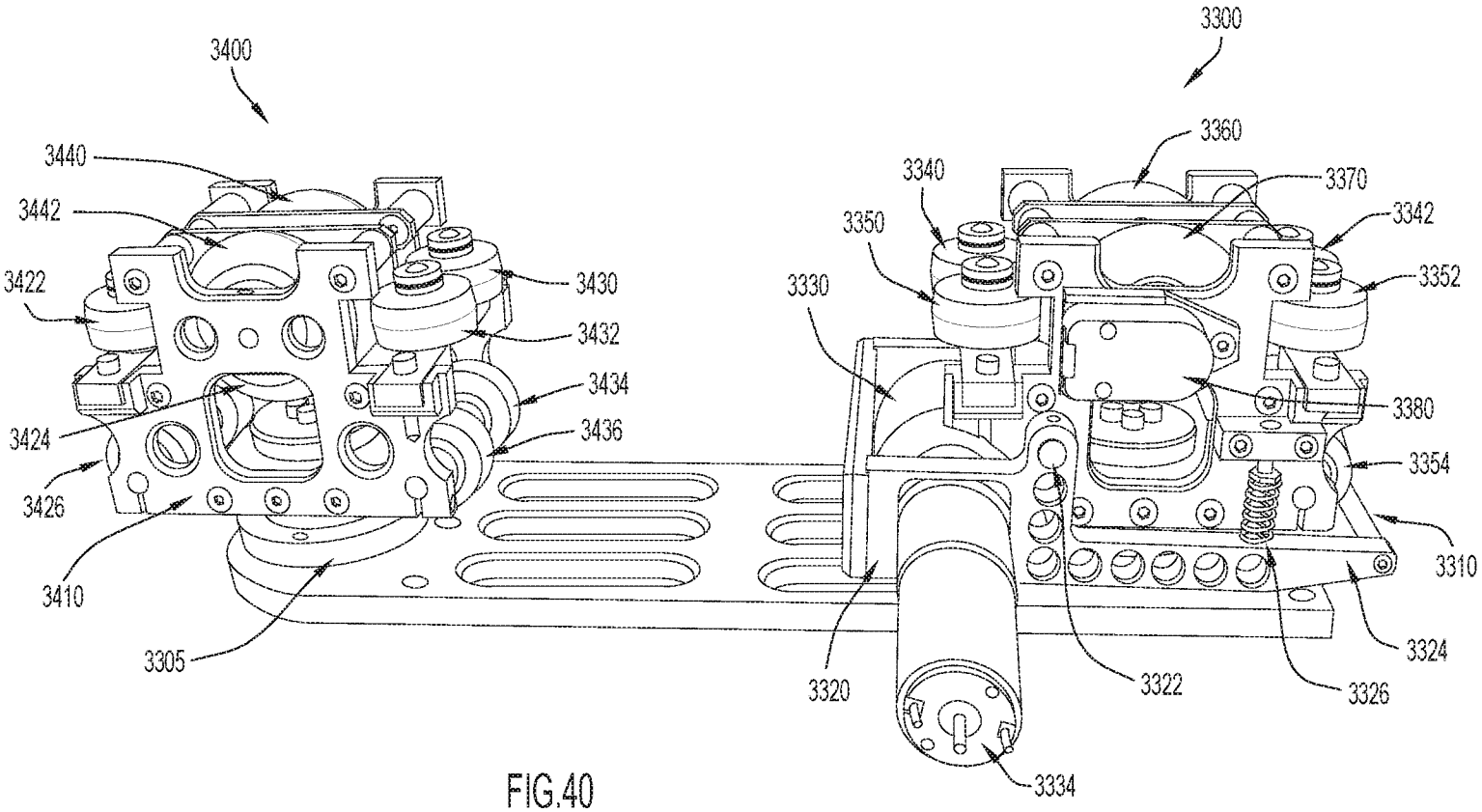
FIG. 40 is a perspective view of some of the components of the body-weight support system illustrated in FIG. 39, according to example embodiments.

Referring to FIG. 40, a bottom perspective view of some of the components of the trolley 3100 are illustrated. In this embodiment, the trolley 3100 includes a base 3305 to which pivoting wheel assemblies 3400 and 3300 are rotatably mounted on bearings 3306 (see FIG. 44). Pivoting wheel assembly 3400 is a passive assembly that includes a housing 3410 and several wheels mounted to the housing 3410 that contact different surfaces of the track 3150.

Figure 42:
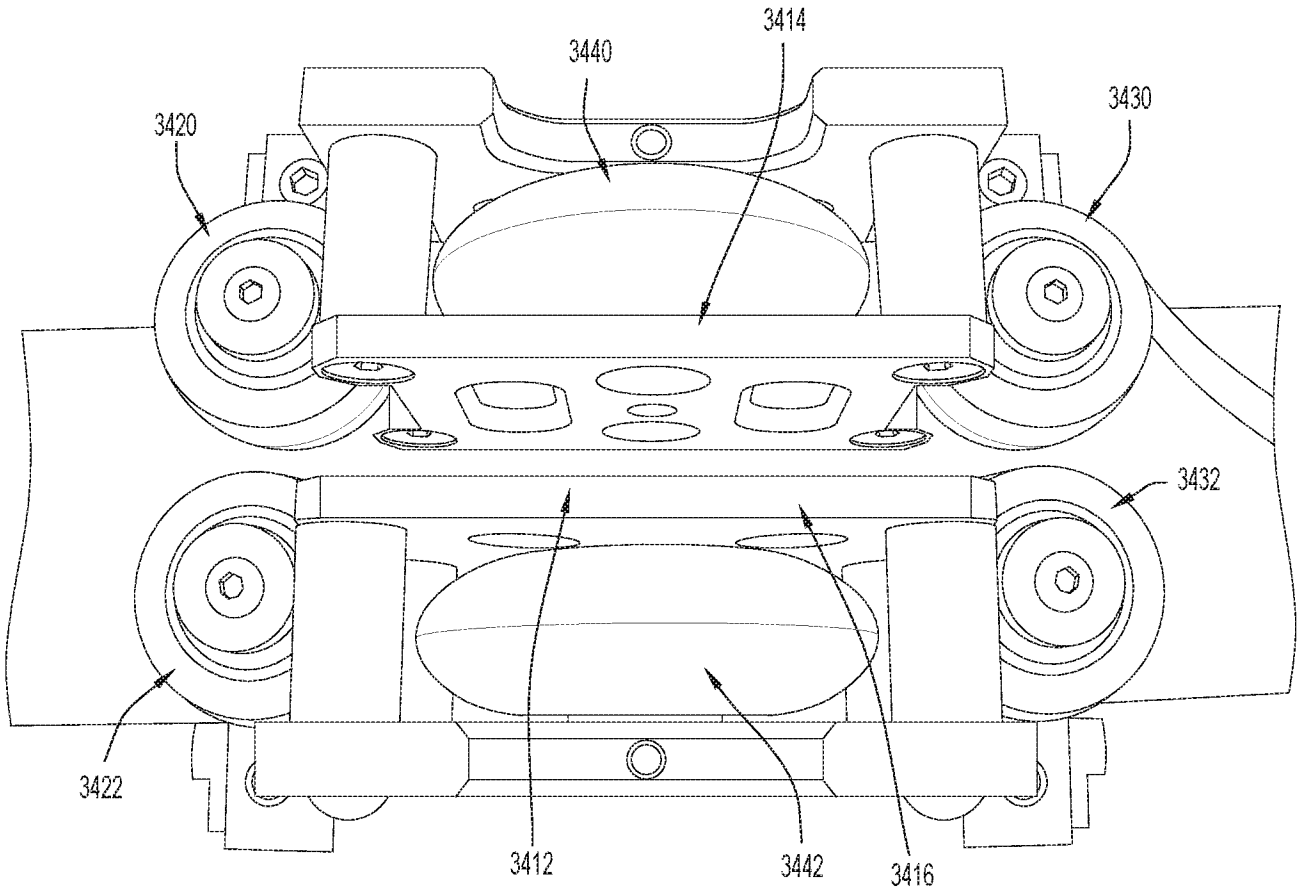
FIG. 42 is a close-up view of some of the wheels and associated mounting structures of the body-weight support system illustrated in FIG. 39, according to example embodiments.
Figure 43:
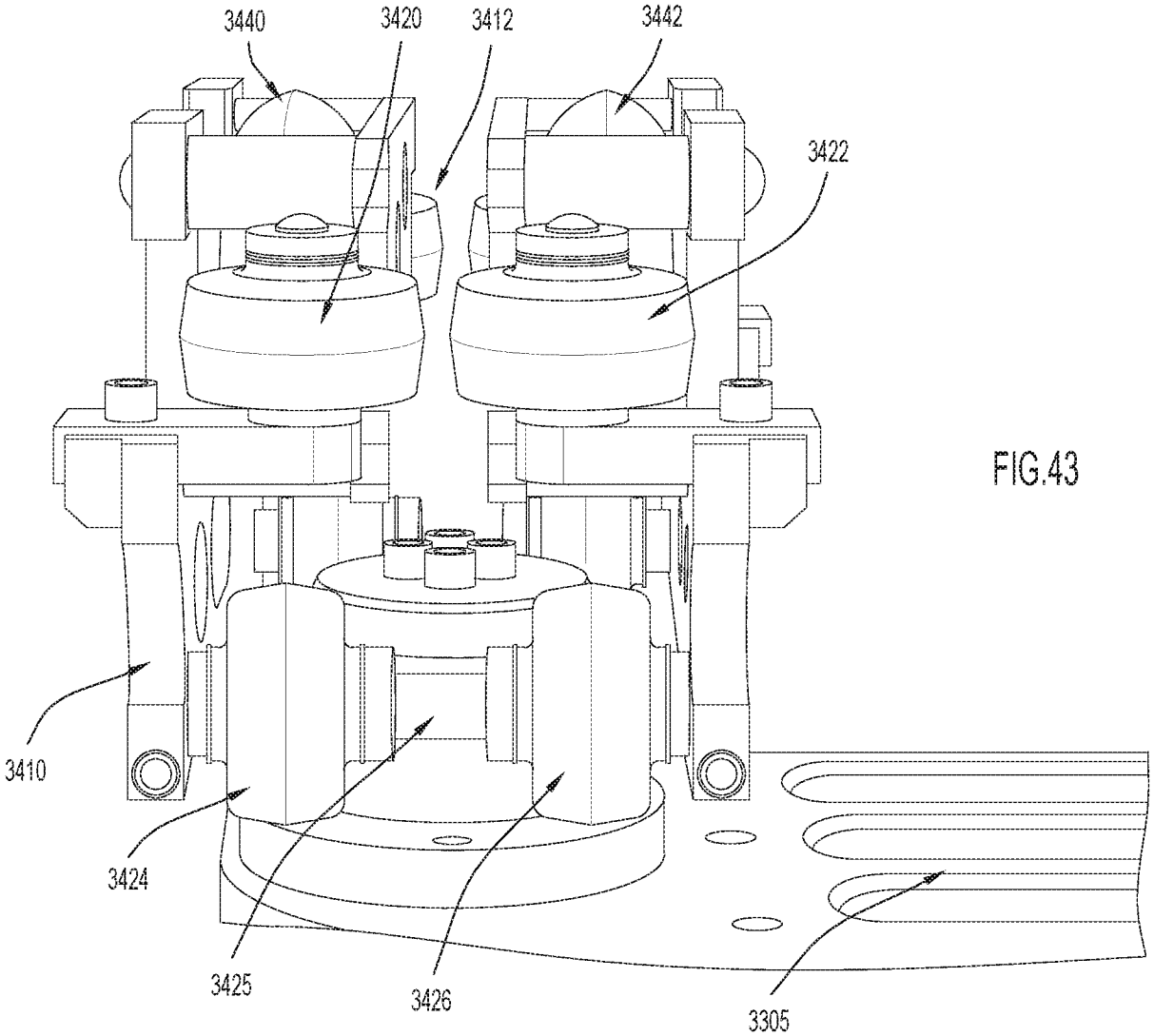
FIG. 43 is an end view of the wheels and associated mounting structures illustrated in FIG. 42, according to example embodiments.
Figure 44:
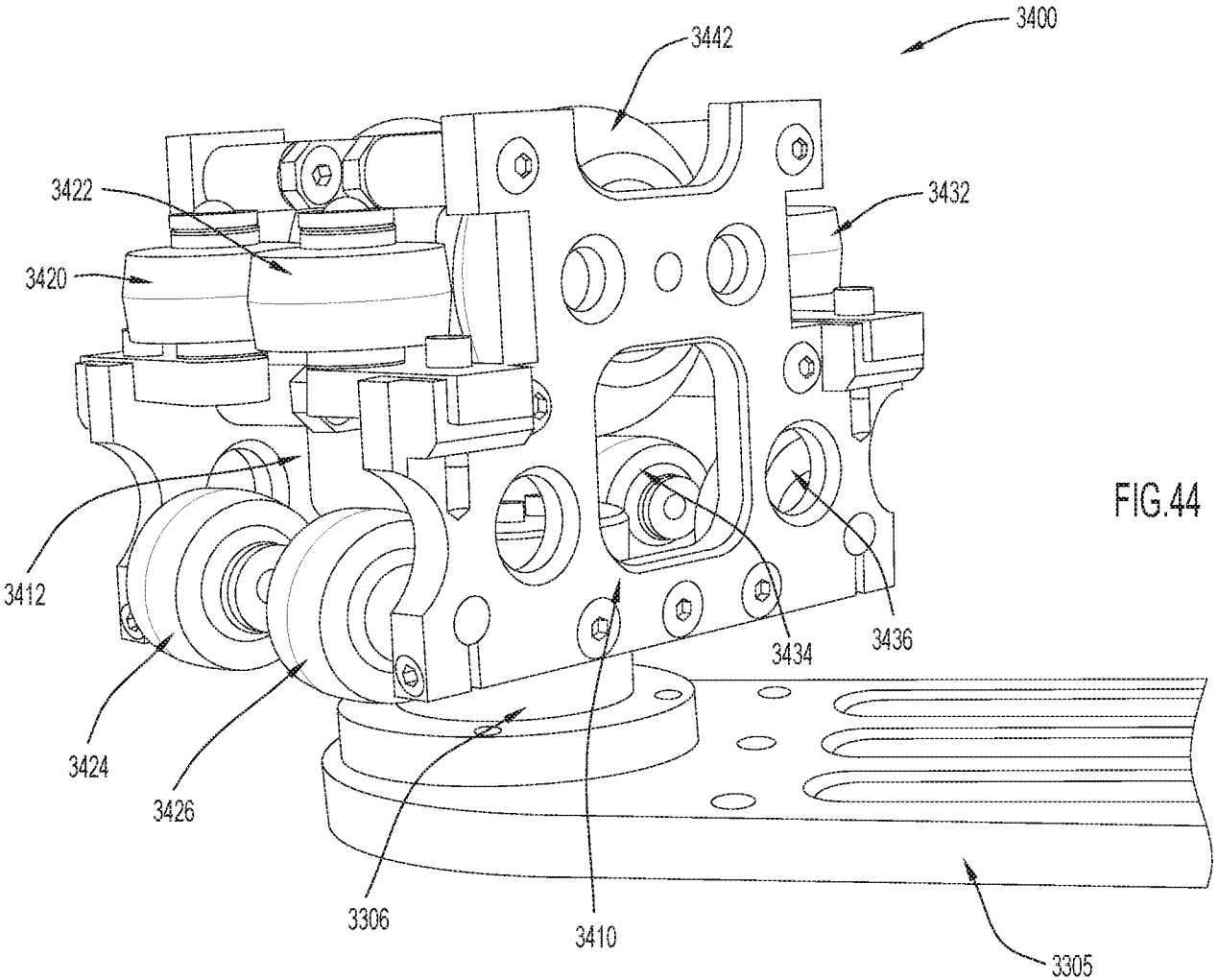
FIG. 44 is a perspective view of a trolley wheel assembly of the body-weight support system illustrated in FIG. 39, according to example embodiments.

Referring to FIGS. 40 and 42-44, pivoting wheel assembly 3400 includes wheels 3440 and 3442 that rest on the upper inner surface of the lower flange of the track 3150 (such as on top of flange 46C). Pivoting wheel assembly 3400 also includes wheels 3430 and 3432 and wheels 3420 and 3422 that roll on the web of the I-beam track to provide lateral stability. Pivoting wheel assembly 3400 also includes wheels 3424 and 3426 and wheels 3434 and 3436 that are configured to roll on the bottom of the lower flange of the I-beam to provide stability in the vertical direction. As shown in FIG. 43, wheels 3424 and 3426 are rotatably mounted on an axle 3425.

Referring to FIGS. 42 and 43, the housing 3410 includes two housing portions 3414 and 3416 that define therebetween a channel 3412. The channel 3412 is configured to slidably receive the web or middle portion of the I-beam track 3150 (such as track portion 46B described above).

Figure 41:
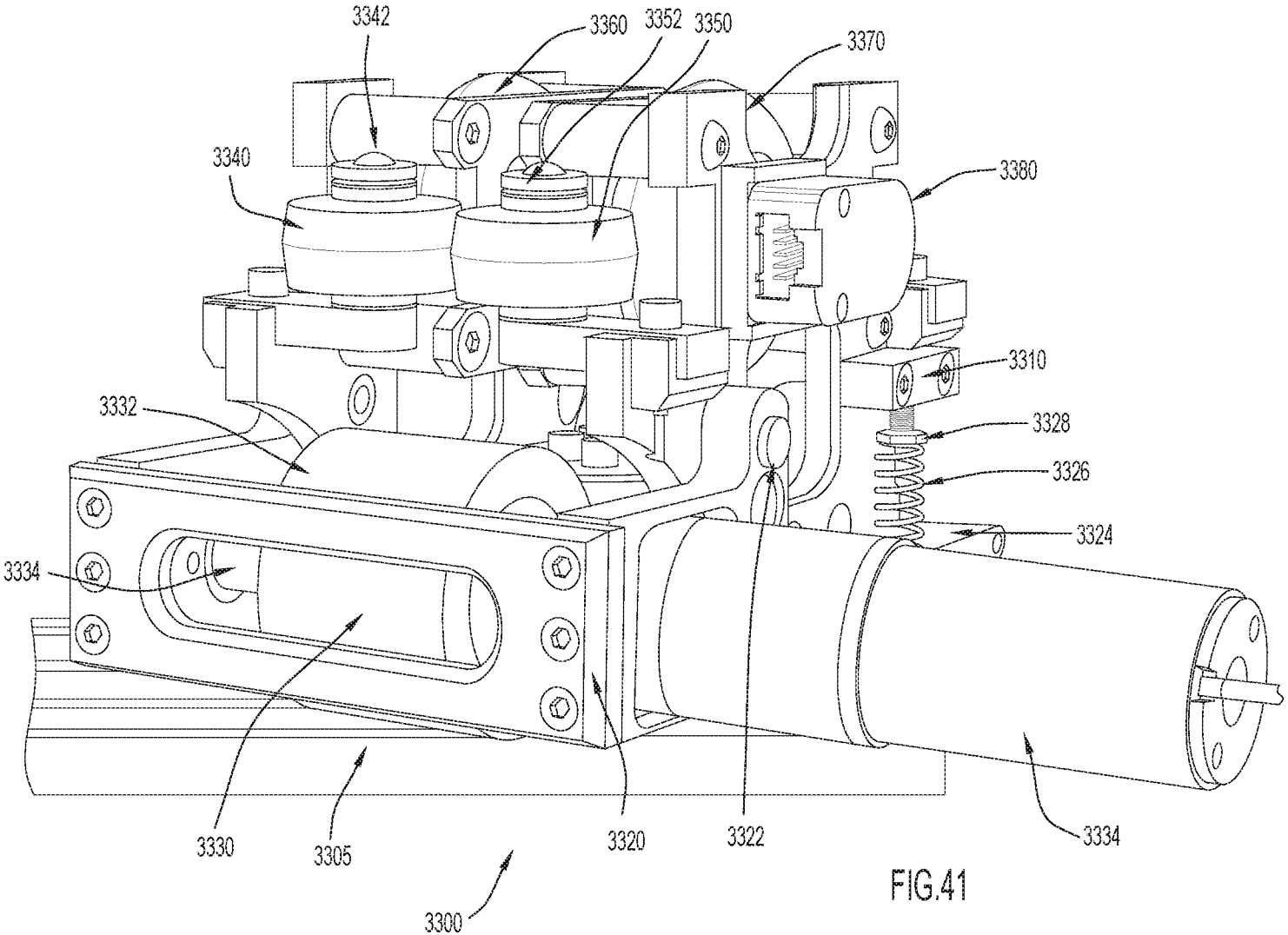
FIG. 41 is a close-up view of some of the components of the body-weight support system illustrated in FIG. 39, according to example embodiments.

Referring to FIGS. 40 and 41, pivoting wheel assembly 3300 is illustrated. Pivoting wheel assembly 3300 is rotatably mounted to the base 3305 of the trolley 3100 by a bearing. Pivoting wheel assembly 3300 is different from pivoting wheel assembly 3400 in that assembly 3300 includes a trolley motor 3334 that is coupled to a drive wheel 3330 that engages the track 3150 to move the trolley 3100 along the track 3150. As shown in FIG. 41, the drive wheel 3330 includes an outer surface 3332 and is rotatably mounted on an axle 3334. The drive wheel 3330 is mounted in a drive wheel body 3320 that is pivotally mounted to the housing 3310 by an axle 3322. On each side of the drive wheel body 3320 there is a spring 3326 that engages an upper end or limit 3328 (see FIG. 41) and exerts a downward force on end or portion 3324 of the drive wheel body 3320 so that the drive wheel 3330 is forced into contact with the track 3150.

Referring to FIGS. 40 and 41, pairs of upper wheels 3340 and 3350 and upper wheels 3342 and 3352 and lower wheels (only 3354 is visible) are used in combination with support wheels 3360 and 3370 to engage various surfaces of the I-beam track and provide vertical and lateral support for the pivoting wheel assembly 3300 and the trolley 3100. An encoder 3380 is mounted on the axle that supports wheels 3360 and 3370. The encoder 3380 is configured to measure the distance walked by the subject, the speed of walking, and other data.

Referring to FIGS. 45 and 46, an embodiment of a cable support system is illustrated. As shown, the trolley 3100 is movably mounted on the track 3150. The trolley 3100 includes an electrical housing 3500 to which cables, wires, and/or other communication links 3520 can be coupled. The cables 3520 are bundled together and coupled to support arms 3530 using a fastener 3532 such as a combination of a hook-type material and a loop-type material. Fasteners 3532 are used to secure the cables 3520 to the support arms 3530.

Each support arm 3530 is pivotally coupled to a festoon 3600 that is slidably mounted on the track 3150. As the trolley 3100 moves in a direction along the track 3150, the trolley 3100 pulls on the cables 3520 in the same direction. Initially, the festoon 3600 closest to the trolley 3100 begins to move and as the trolley 3100 continues to move, the next festoon 3600 begins to move. Continued movement of the trolley 3100 causes additional festoons 3600 to move. Movement of the trolley 3100 in the opposite direction causes the festoons to move in that opposite direction as well. The support arms 3530 provide support stiffness to the cables 3520. In addition, the support arms 3530 maintain the cables 3520 in a substantially horizontal plane which prevents the cables 3520 from becoming tangled and in the way of the patient. At the end of the festooning system, the cables 3520 pass through a support member 3524 that defines a channel 3526.

Referring to FIG. 46, the festoons and cable mounting structure are illustrated in greater detail. Each festoon 3600 includes a body 3610 with an axle 3620 on which a wheel 3622 is mounted and an axle 3630 on which a wheel 3632 is mounted. Wheels 3622 and 3632 are disposed so that they engage the lower surface of the I-beam track 3150. An upper wheel 3662 is located on each side of the I-beam track 3150.

Support arm 3530 can be coupled to a rotatably mounted plate 3612 using fasteners 3614. The rotatably mounting of the support arm 3530 facilitates the rotation of the support arm 3530 as the corresponding festoon 3600 moves.

In various embodiments of the present disclosure, any combination of components can be used as part of or with the trolley. In addition, any combination of sensors or detectors can be used with the controller to determine the appropriate feedback and inputs to control the movement of the trolley.

The techniques of the present disclosure also provide for the application of perturbations to a subject as they are stationary or performing a dynamic task, such as walking, side stepping, etc., via the trolley of a body weight support system. The direction and strength of the perturbation may be altered within the software controlling the dynamic body weight support system, and may depend upon the task being performed by the patient or subject, if any. The strength and duration of such perturbations may be determined by the software such that the perturbations provide a strong yet brief force to the subject. While it is likely that some of these perturbations may destabilize the subject, the advantage of using a body weight support system to initiate the perturbation is that the system may protect the subject against falls caused by the perturbations. Specifically, the dynamic body-weight support features and fall prevention techniques described above may be implemented immediately after the initiation of a perturbation to catch the patient in the event that the perturbation induces a fall. Applying perturbations to individuals known to have deficits in balance and postural control will lead to improvements in stepping responses, which has been shown to reduce future fall risk in such individuals.

The techniques of the present disclosure may be implemented through example embodiments in which the perturbations are applied to the patient through a harness, such as the harness assemblies discussed above and as illustrated in FIG. 3. Through the use of a harness, the techniques of the present disclosure may provide a "whole body perturbation." For example, through the use of such a harness system, the perturbation may be applied to the center of mass of the patient.

The perturbation techniques of the present disclosure may be particularly applicable to Parkinson's Disease (PD) patients. PD patients are typically at an elevated risk for falls. It has been shown that postural stability can be improved with proper training, such as that provided by the perturbation techniques of the present disclosure. Accordingly, the techniques of the present disclosure may have beneficial effects for individuals, such as PD patients, who exhibit postural instability.

Research, such as that provided in Boonsinsukh, R., et al., "A cane improves postural recovery from an unpracticed slip during walking in people with Parkinson disease," Physical therapy, 2012. 92(9): p. 1117-1129 (the contents of which are incorporated herein by reference), shows that people with PD gradually decrease lateral Center of Mass (COM) displacement across slip exposures. Other research has demonstrated that with postural perturbation training in the laboratory, people may improve the quality of the recovery step after perturbation, both in healthy aging individuals and in individuals with PD.

Despite research showing that inadequate postural responses are the most common reason for falls, and that postural responses can be improved with training, practicing postural response motor skills during rehabilitation has not been routinely performed. The fundamental limitation with training postural responses is safety. The majority of research on postural responses have been done during quiet standing, rather than during walking, and most laboratory setups are equipped to deliver a perturbation while a person is standing quietly on a force plate. However, most falls occur during ambulation. Balance strategies during gait (e.g., while ambulating) are task specific and vary according to age and gait speed. Effective balance reactions are essential for avoiding falls, but are not regularly measured or practiced by physical therapists. Until the discovery of the techniques of the present disclosure, there were no available technologies that could deliver appropriately sized perturbations in a safe and consistent way during ambulation.

The techniques of the present disclosure may remove these translational barriers. First, the techniques of the present disclosure provide advanced fall protection algorithms so that if a person loses their balance at any time during the training, the system stops their descent and prevents injuries. Second, the trolley tracking and dynamic body-weight support control algorithms used in the present disclosure have been developed to apply well-controlled, repeatable perturbations of adjustable magnitude and direction. These trolley tracking and dynamic body-weight support control algorithms provide clinicians the opportunity to develop clinical protocols for treating patients with balance deficits.

The techniques of the present disclosure may also utilize wearable sensors that may be used to measure one or more of position, velocity, and/or acceleration of body segments, such as the sensors provided by APDM Wearable Technologies (Portland, Oreg.), into the techniques provided for herein to accurately assess balance responses and related fall risks. The techniques of the present disclosure provide for a protocol that improves balance responses and reduces fall risk with a technology that allows for the safe and repeatable delivery of such an intervention.

An example embodiment of the system utilized in the present techniques is illustrated in FIG. 2, in which a robotic dynamic body-weight support system 10, that includes a motorized overhead trolley 30, rides along an overhead track 40. The patient wears a harness, which in turn is connected to the system 10 via rope or tether 220. The system 10 provides patients with constant levels of body-weight support and prevents falls by monitoring the patient's position and velocity at 1000 times per second. While the specific techniques for providing constant levels of body-weight support disclosed herein may be used in conjunction with the perturbation techniques described below, other means of providing constant body weight support may be paired with the perturbation techniques described herein.

The active overhead trolley 30 drives the system along the overhead track 40, automatically following the patient as they move so that they only feel the vertical unloading force. When using system 10, patients may practice over ground gait and balance exercises in a safe, controlled manner. FIG. 2 illustrates the use of festoons 326 as providing power to system 10, but according to other example embodiments, a powered conductor incorporated into track 40 or a powered rail (not shown) running parallel to track 40 may provide power to system 10.

The patient tracking algorithm may be used to control the position of overhead trolley 30 as a function of the position of the human and the desired task. The angle of the rope 220 is measured with a high precision potentiometer mounted to a small pivoting arm the rope 220 passes through as it exits the system. For example, the rope 220 passes through pivoting arm 66, where the angle of the arm 66 is measured using a precision potentiometer 65 (see, .e.g., FIGS. 15 and 16). As will be described in greater detail below, the overhead trolley 30 may be configured to initially provide patient body-weight support and tracking such that the trolley 30 remains substantially above the patient, such as substantially above the center of mass of the patient. For example, the trolley 30 may be arranged above the patient so that the force provided by rope 220 is substantially all vertical and acts substantially on the center of mass of the patient.

According to other example embodiments, trolley 30 may be configured to initially provide no or very little body weight support to the patient. According to such example embodiments, trolley 30 may only provide sufficient tension to rope 220 to permit trolley 30 to track the location of the patient. Or, if the operator of trolley 30 instructs the patient to remain in one location, trolley 30 may be operated so that rope 220 provides essentially no body weight support to the patient. Accordingly to such example embodiments, the initiation of a perturbation may result in trolley 30 causing rope 220 to provide a horizontal force to the patient. Subsequent to the horizontal force, trolley 30 may be configured to provide the body weight support techniques as described above, or provide no body weight support if the patient is not destabilized by the horizontal perturbation force.

Upon the initiation of a perturbation, the trolley 30 will move relative to the patient (i.e., the trolley 30 will move to a position offset from the patient in a horizontal direction) such that it is horizontally displaced from the patient along track 40. Once sufficiently displaced or offset, the unloading force provided by rope 220 is increased. Because trolley 30 is horizontally displaced from the patient, the increase in unloading force causes the patient to experience a horizontal force or perturbation. If the perturbation is sufficiently strong, it will induce the patient to take compensatory action, such as the above-described recovery steps. If the perturbation induces a fall, the fall prevention techniques described above may be implemented by system 10 to arrest the patient's fall. If the perturbation does not induce a fall, system 10 will recommence the body-support and patient tracking techniques being implemented prior to the perturbation.

Figure 47:
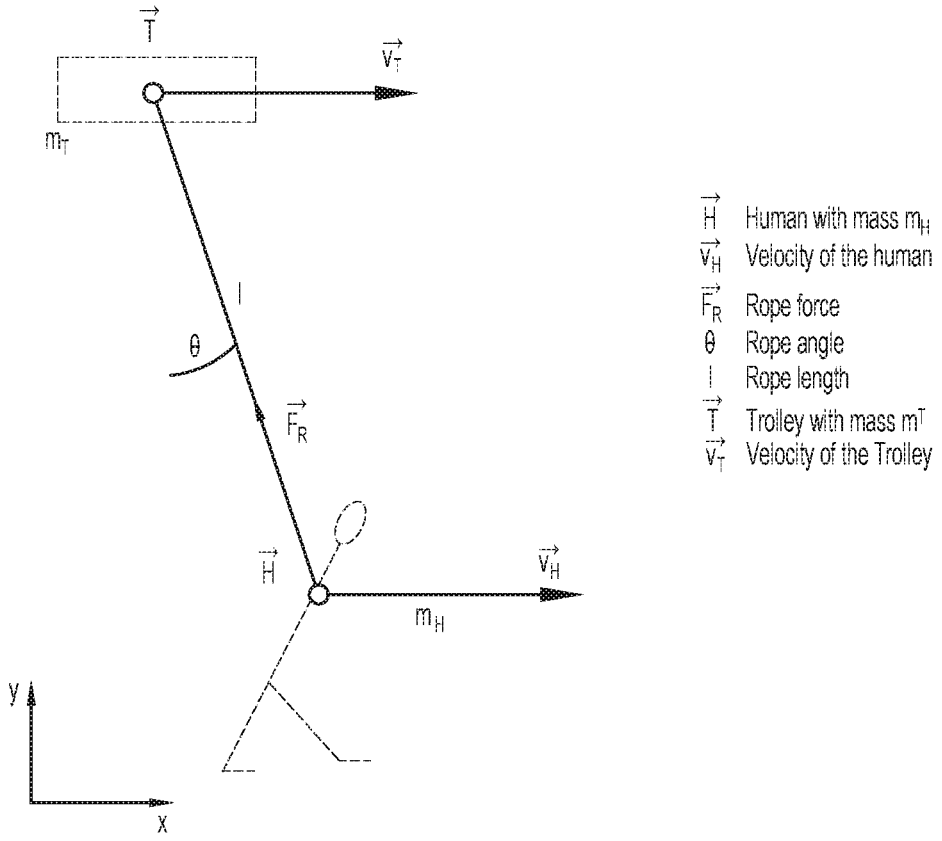
FIG. 47 is a force diagram of a dynamic body-weight support system providing gait training via perturbations, according to example embodiments.

With reference now made to FIG. 47, depicted therein is a force diagram illustrating the horizontal and vertical components of the rope force $F_R$ applied to the patient or subject. For over-ground walking, the vertical proportion of the rope force $F_{Ry}=\cos(\theta)F_R$ acts onto the patient, providing constant levels of dynamic body-weight support. For perfect tracking, i.e., when the trolley remains directly over the patient, the horizontal proportion of the rope force will disappear. Specifically, the horizontal position of the trolley $x_T$ will equal the horizontal position of the patient or human $x_H$. The resulting rope angle θ will be zero.

The horizontal component of the rope force $F_{Rx}$ is calculated as follows:

$$F_{Rx}=-\sin(\theta)F_R$$

As the sin(0) equals zero, the horizontal portion of the rope force $F_{Rx}$ will also equal zero when θ equals zero.

If the trolley lies behind the subject or patient ($x_T<x_H$), the rope will pull the patient horizontally backward and if the trolley lies in front of the human or patient ($x_T>x_H$), the rope will pull the subject horizontally forward. Experiments done with healthy subjects have shown that subjects are highly sensitive to horizontal forces and therefore, controlling the distance between the trolley and the subject offers the opportunity to apply anterior or posterior horizontal force perturbations during walking and standing tasks.

Figure 48:
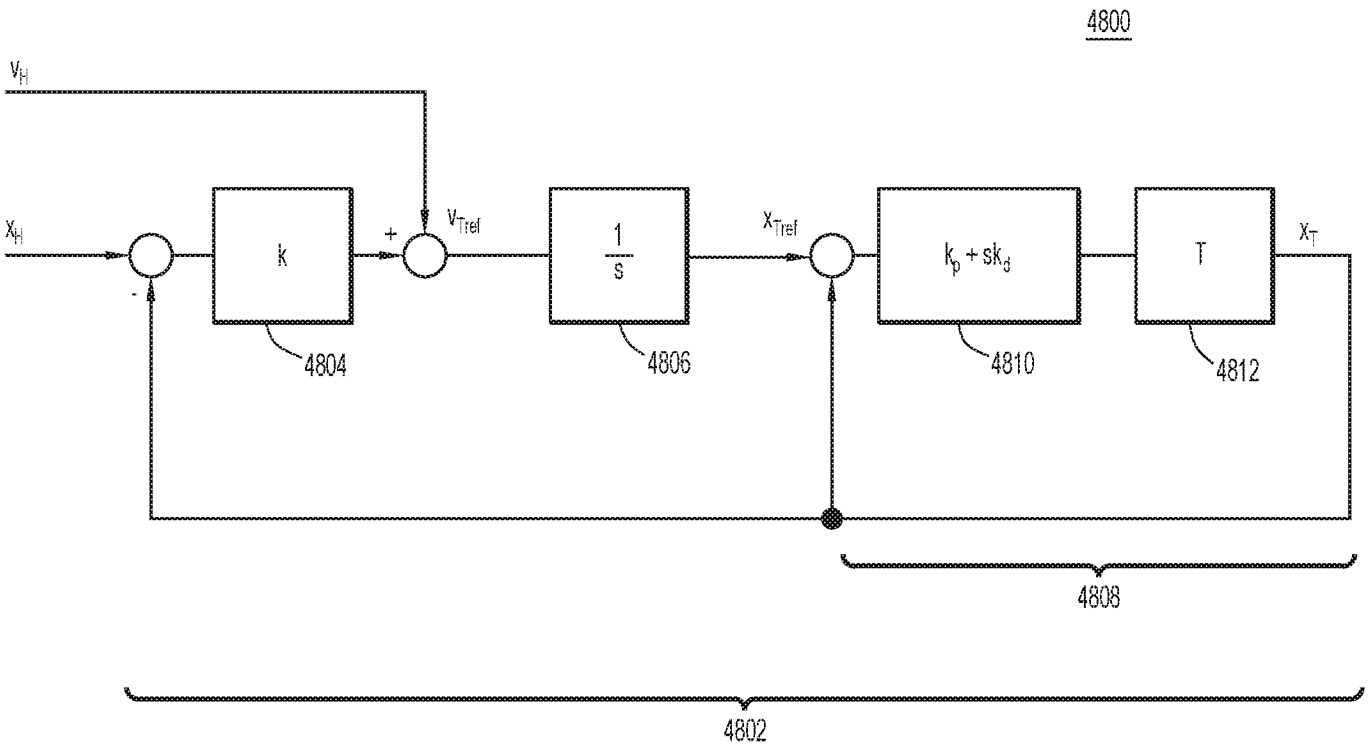
FIG. 48 is a schematic representation of a control system for a dynamic body-weight support system providing gait training via perturbations, according to example embodiments.

As illustrated in FIG. 48, the horizontal position $x_T$ of the trolley 30 may be controlled using a cascade controller 4800 with a feedforward component. According to example embodiments, cascade controller 4800 may be implemented in hardware or software in controller 510 of FIG. 25. Here, the outer loop 4802 includes first controller 4804 and second controller 4806, and the inner loop 4808 includes controller 4810 with the proportional constant $k_p$, and the derivative constant $k_d$. The trolley process 4812 gives the position for the trolley $x_T$. While this specific example of a controller is used to describe the techniques of the present disclosure, other controllers may be utilized without deviating from the inventive concepts disclosed herein.

The reference $x_{Tref}$ value for the position controller 4800 is given by the outer loop 4802 by integration of the velocity $V_{Tref}=v_H+k(x_H-x_T)$. The constant k for first controller 4084 is a tuning parameter that may be determined by experimentally tuning the system for critical damping.

Assuming first-order behavior, the inner loop 4808 gives:

$$x_T=\frac{1}{\tau_p s+1}x_{T_{ref}}$$

where s is the Laplace variable and $\tau_p$ is a time constant that depends on the performance of the inner-loop position controller 4810 and therefore on $k_p$ and $k_d$. Thus, the overall closed loop transfer function is:

$$x_T=\frac{s+k}{\tau s^2+s+k}x_H$$

The resulting horizontal force depends linearly from the tracking error and is:

$$F_{Rx}=-\sin(\theta)F_R=-\frac{x_H-x_T}{l}F_R$$

For use of the system 10 of FIG. 2 without perturbation, the trolley tracking algorithm may be tuned to minimize the tracking error ($x_T-x_H\approx 0$) so that the patient feels no horizontal forces. In order to apply controlled perturbations to patients in both magnitude, direction and duration, the trolley controller may be modified to produce a non-zero distance between the trolley and the human ($x_T-c_H=c$) in proportion to the desired horizontal perturbing force, $F_{Rx}$. The algorithm may automatically take into account the position of the person with respect to trolley 30, which allows for the application of both anterior (c<0) and posterior (c>0) perturbations.

In order for trolley 30 to properly track a patient's movements, there may need to be some tension on the rope 220 of FIG. 2 at all times (i.e. $F_R\neq 0$). Otherwise the trolley algorithm may have no way of knowing the position of the patient with respect to its own position. According to example embodiments, 5 lbs of tension may be sufficient for the trolley 30 to track a patient's movement. To facilitate the desired horizontal perturbation within a brief pulse-like manner, FR may progressively increase as a function of $x_T-x_H=c$. Here, not only will trolley 30 advance in front of or behind the patient, but the level of rope force will simultaneously be increased. If the patient is standing or side-stepping while facing a direction perpendicular to the track, the trolley 30 may advance to the left or to the right of the patient. This advancement of the trolley relative to the position of the patient will allow system 10 to apply a rapid, transient force perturbation to the patient with a relatively short change in position along the track 40. The magnitude and direction of the desired horizontal force perturbation may be adjustable by the therapist, and may be based on the patient's abilities.

The trolley control algorithm parameters, k, $k_p$, and $k_d$ may be tuned to achieve perturbation force errors to within 10% of the desired values, or better. Such levels of accuracy may be sufficient for training stepping responses, given the goal is to destabilize the patient and then ultimately quantify their reaction to these perturbations. Furthermore, the magnitude and direction of the perturbation forces applied to patients may be recorded and stored during training to correlate the reaction of the patient to a known perturbation.

Figures 18, 19:
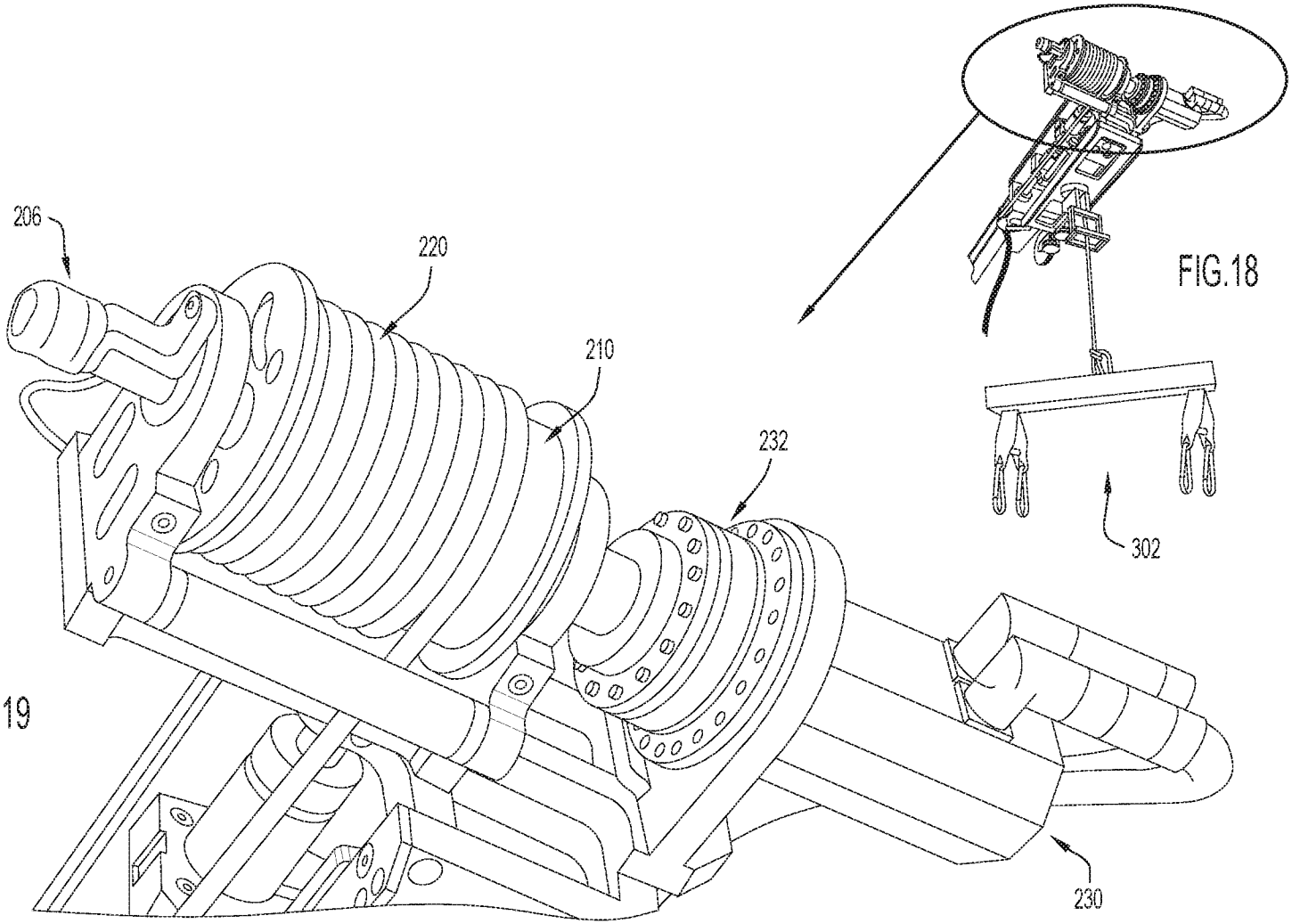
FIGS. 18 and 19 are perspective and close-up views, respectively, of some of the components of the winch of the body-weight support system illustrated in FIG. 1, according to example embodiments.

The above-described algorithms may be used by a controller, such as controller 510 of FIG. 25, to control winch motor 230 of FIG. 19 or ball screw motor 240 of FIG. 20A to induce horizontal perturbation forces.

Once the perturbation is applied to the patient, as will be described below, the system 10 of FIG. 2 will also act to catch the patient if the patient experiences a fall as a result of the perturbation. For example, the subject's vertical height is monitored using the system's instrumentation. In one embodiment, if at any time a fall is detected (identified through, for example, determining that the patient has descended a predetermined distance), the system automatically adjusts the unloading force in order to slow and stop the vertical descent of the patient. In another embodiment, if at any point the vertical height of the subject falls more than four inches or if their vertical speed moves faster than ten inches per second, the system automatically switches into a holding mode and prevents the subject from descending. If the desired unloading force moves outside +/−10%, the system may also switch into a safe holding mode. During perceived falls, the trolley 30 also will automatically slow the forward or backward progression of the patient until equilibrium is achieved.

System 10 may be controlled through a touch screen computer interface as well as a wireless tablet running a commercial operating system, such as the Android OS or Apple's IOS. System 10 may also be controlled through other means, such as personal computer-based interface, or an interface integrated directly into system 10. The interfaces may be provided with a perturbation module that will allow therapists to set the magnitude and direction of the perturbations described above. The module may also implement a trigger function so that the therapist may apply the perturbation during a particular phase of the gait cycle. The algorithms on both interfaces are running at a high clock rate so the delay between trigger onset and perturbation onset is minimized. Having the trigger integrated in the wireless tablet interface will allow the therapist to be next to the patient at all times. Examples of the above-described user interface are illustrated in FIGS. 49A-C, 50, 51A and 51B. These interfaces may be implemented by controller 510 of FIG. 25.

Figure 49A:
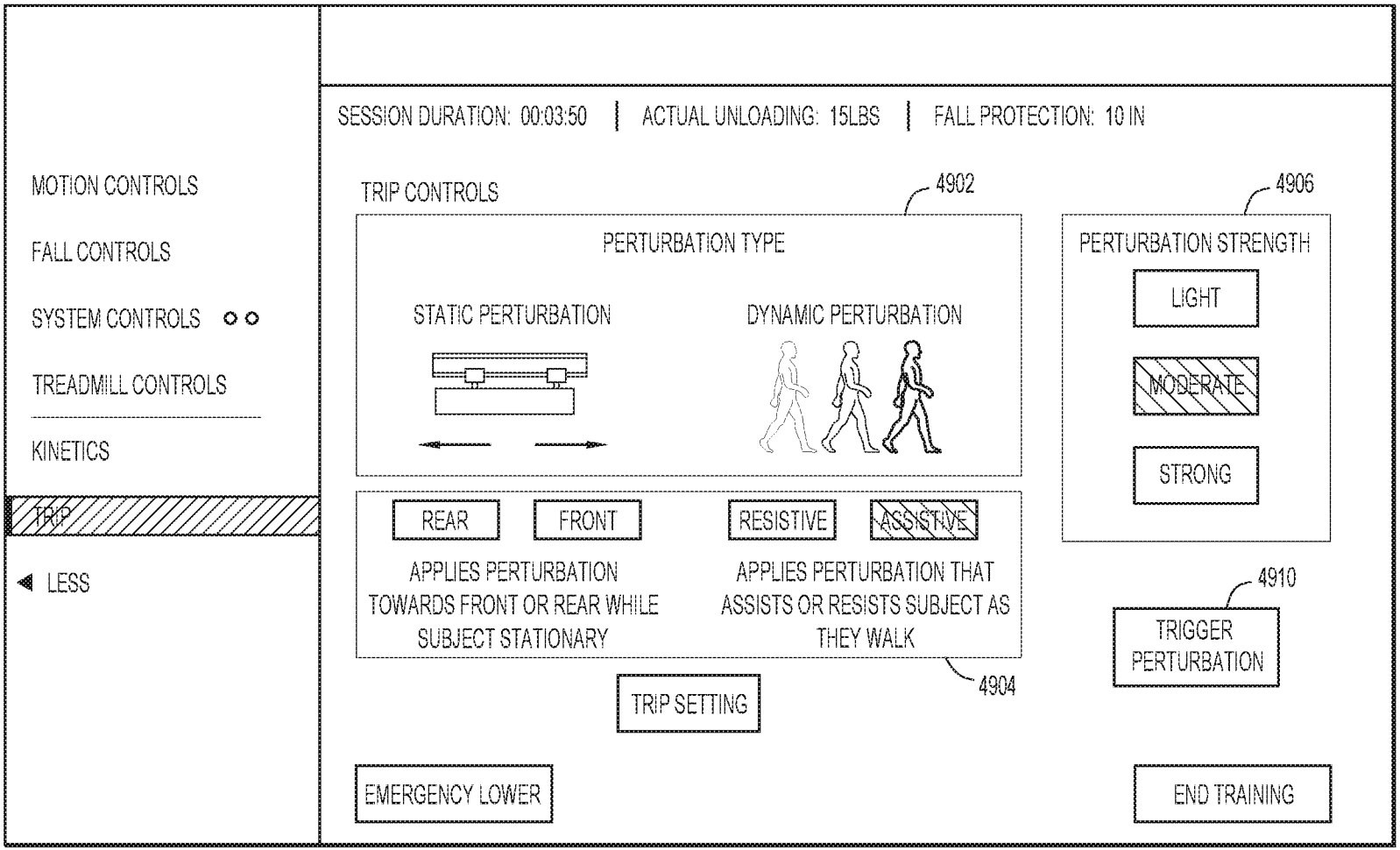
FIG. 49A is a first user interface for a dynamic body-weight support system providing gait training via perturbations, according to example embodiments.
Figure 49B:
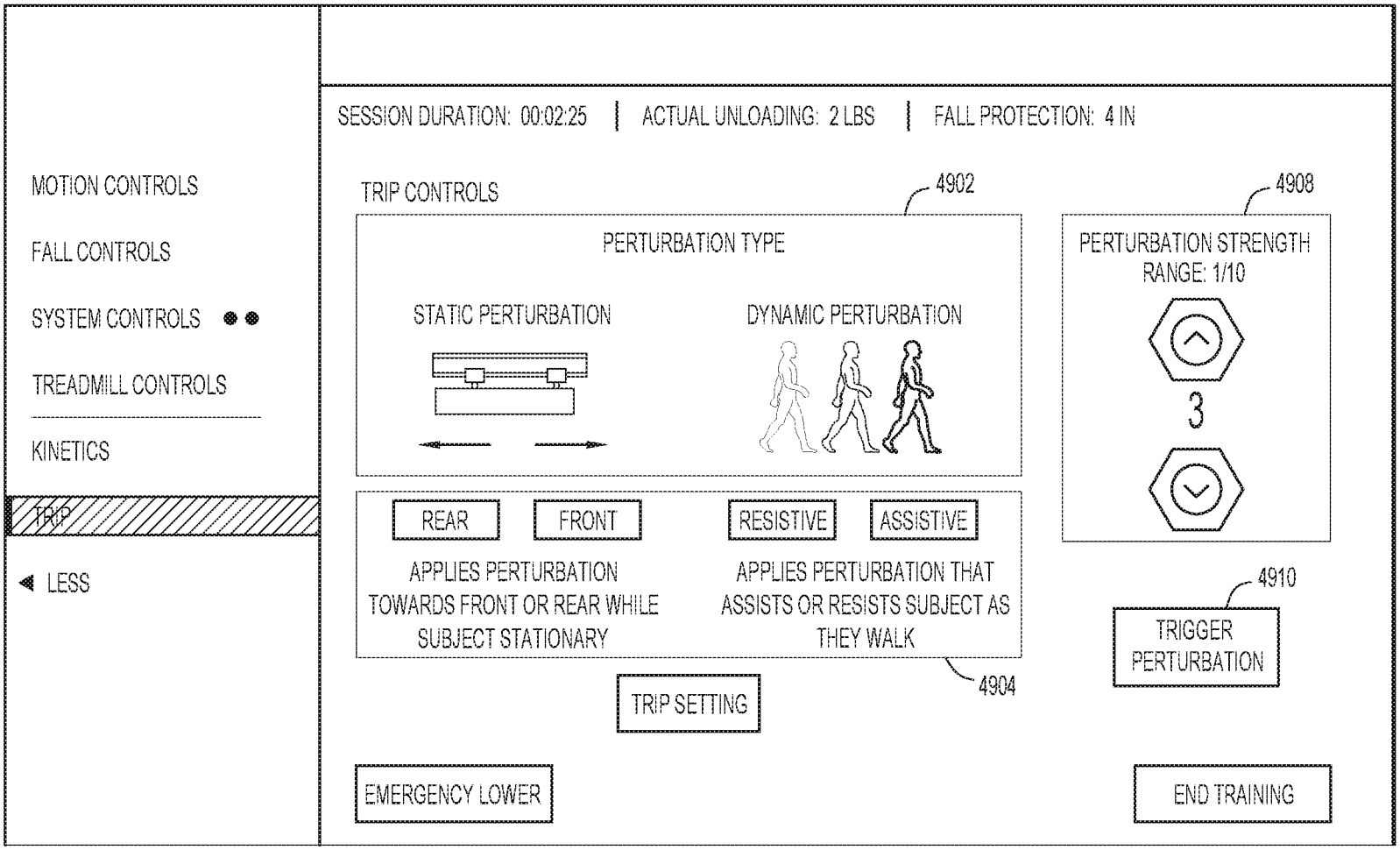
FIG. 49B is a first alternative version of the first user interface for a dynamic body-weight support system providing gait training via perturbations, according to example embodiments.

As shown in FIG. 49A, depicted therein is a perturbation user interface 4900. A therapist or other operator of a body-weight control system may be able to indicate whether the perturbation should be applied when the patient is standing ("Static Perturbations"), or applied when the patient is ambulating ("Dynamic Perturbation"), through perturbation type portion 4902. The therapist or other operator may be able to select the direction of the perturbation in perturbation direction portion 4904. For static perturbations, the operator may be able to select between "Rear" or "Front" perturbations, while for dynamic perturbations, the operator may be able to select between "Resistive" perturbations (i.e., perturbations against the direction in which the patient is ambulating) or "Assistive" perturbations (i.e., perturbations in the same direction as the patient's ambulation). The user interface 4900 also permits a therapist or operator to set a strength or force level of the perturbation through "Perturbation Strength" portion 4906. In the example of FIG. 49A, the therapist is permitted to selected from one of three different predetermined perturbation strength levels, "Light," "Moderate," or "Strong." According to other example embodiments, the therapist may be able to designate a specific strength or force of the perturbation through, for example, a text box or other user interface element. Turning to FIG. 49B, depicted therein is an alternative embodiment of user interface 4900 in which "Perturbation Strength" portion 4908 allows for the selection of a higher number of perturbation levels. Where "Perturbation Strength" portion 4906 of FIG. 49A allows the operator to select between "Light," "Moderate," or "Strong" perturbation strengths, "Perturbation Strength" portion 4908 of FIG. 49B allows the operator to select a perturbation strength of 1 to 10.

Returning to FIG. 49A, user interface 4900 includes perturbation trigger button 4908 to initiate the perturbation once the appropriate settings have been selected by the therapist or operator. The perturbation trigger 4908 of the example embodiment of FIG. 49 is, as illustrated, implemented through software via user interface 4900. According to other example embodiments, the perturbation trigger may be implemented through an additional switch device that is connected to the controller 510 of FIG. 25. For example, the perturbation trigger may be implemented through a physical "dead man" switch that communicates with controller 510 through a wired or wireless connection. This connection to the controller 510 may be a direct connection between the physical switch and controller 510, or the connection may be an indirect connection that connects through a secondary devices, such as a tablet or smartphone device that communicates with controller 510. Such an additional switching device, such as a dead man switch, may allow an operator to more efficiently trigger a perturbation. For example, if the operator is attempting to implement the perturbation at a specific point within the patient's or subject's gait, the operator may be able to more accurately trigger the perturbation with a physical dead man switch than with a button implemented through software on a touchscreen user interface. Specifically, the operator may be able to trigger the perturbation without having to look away from the patient and to the user interface to trigger the perturbation.

Figure 49C:
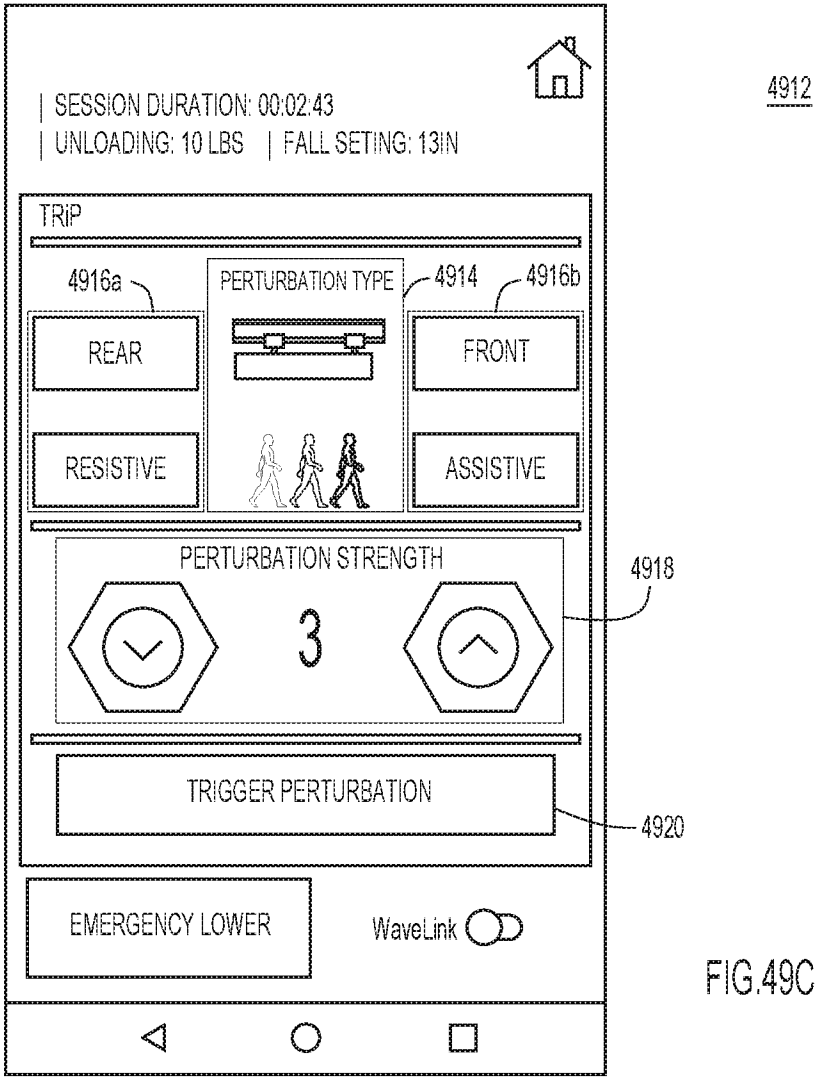
FIG. 49C is a second alternative version of the first user interface for a dynamic body-weight support system providing gait training via perturbations, according to example embodiments.

Turning to FIG. 49C, depicted therein is another example user interface 4912 that is similar to user interfaces 4900 of FIGS. 49A and 49B. User interface 4912 differs in that it is formatted for a smaller screen, such as the screen contained on a smartphone. Accordingly, user interface 4912 contains a perturbation type portion 4914 that permits the operator to select between static or dynamic perturbations. User interface 4912 also contains perturbation direction portions 4916*a* and 4916*b*, which permit the operator to select the direction of the perturbation, either front or rear for static perturbations, or resistive or assistive for dynamic perturbations. Perturbation strength portion 4918 permits the operator to select the strength of the perturbation and perturbation trigger 4920 allows the operator to initiate the perturbation.

As discussed above, user interfaces 4900 and 4912 of FIGS. 49A-C permit an operator to trigger the perturbation. According to other example embodiments, wearable sensors (e.g., accelerometers, gyroscopes, and magnetometers) may be used to track the patient's movements throughout the gait cycle so that the perturbation may be automatically triggered at any point in the gait cycle indicated by the therapist. The sensors may be applied to one or more of the waist, sternum, each foot and/or each wrist of the patient or subject. The sensors may be used to track the patient's gait so that a perturbation may be automatically applied at a particular point in the gait. In example embodiments of the present techniques that employ wearable sensors, the user interface provided to the operator may present the operator with user input elements that allow the operator to select where in the patient's gait that a perturbation should be initiated.

The sensors may also be used to determine how the patient responds to a perturbation. Based upon the sensor data (as well as data collected directly from the body weight support system, in certain example embodiments), it may be determined if the patient falls and/or how the patient compensates for the perturbation. For example, the sensor data may allow the system to determined that the patient took a number of quick steps to compensate for the perturbation, that the patient took one large step to compensate for the perturbation, or that the patient took other compensatory measures to compensate for the perturbation. The response of the patient may then be categorized and recorded for further or future evaluation.

Figure 50:
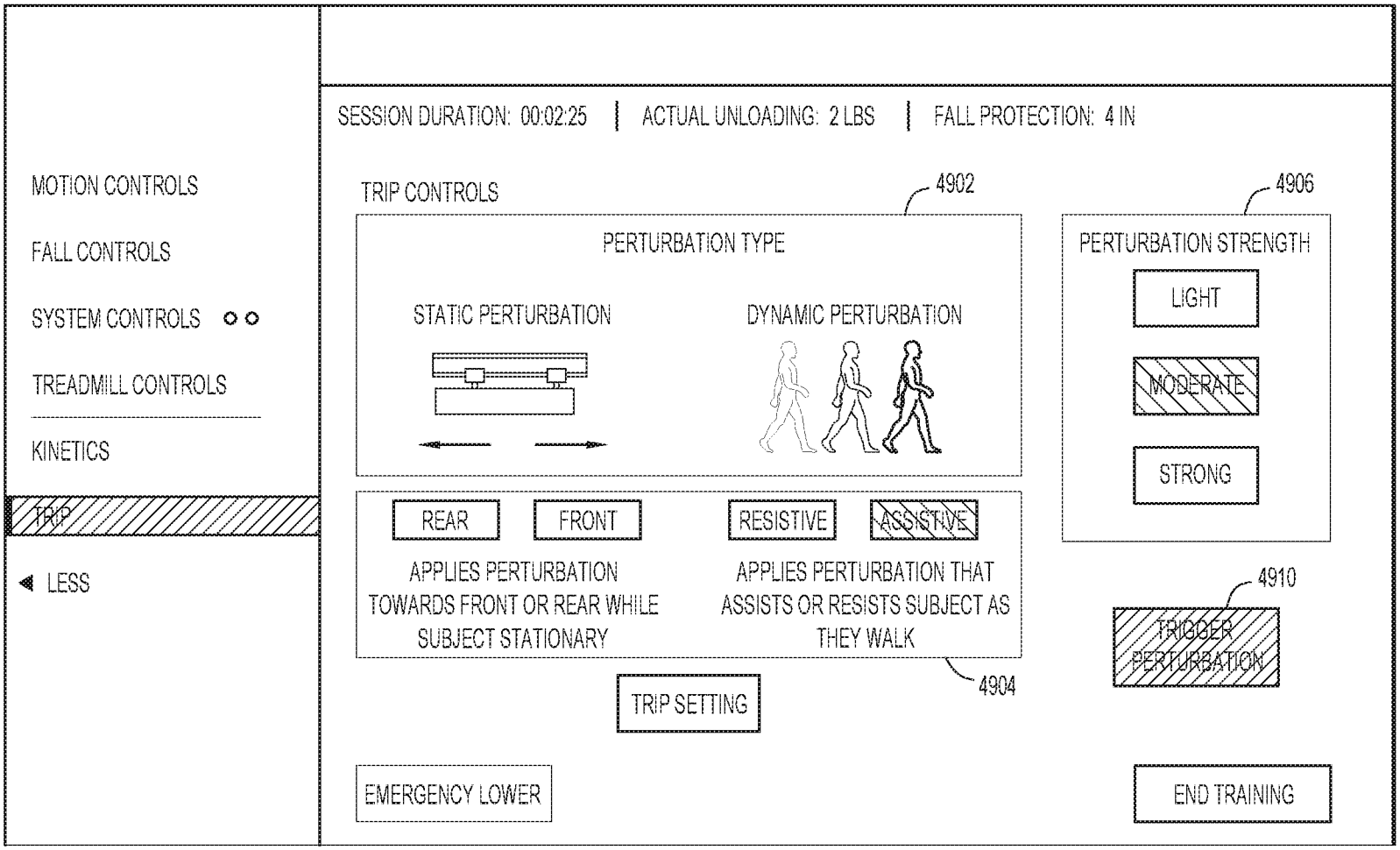
FIG. 50 is a second user interface for a dynamic body-weight support system providing gait training via perturbations, according to example embodiments.

With reference made to FIG. 50, illustrated therein is the user interface 4900 of FIG. 49A in which a safety function of the techniques of the present disclosure is engaged. As illustrated, the "Perturbation Trigger" portion 4910 is disabled because the system is not currently tracking the position of the trolley relative to the location of the patient.

Figure 51A:
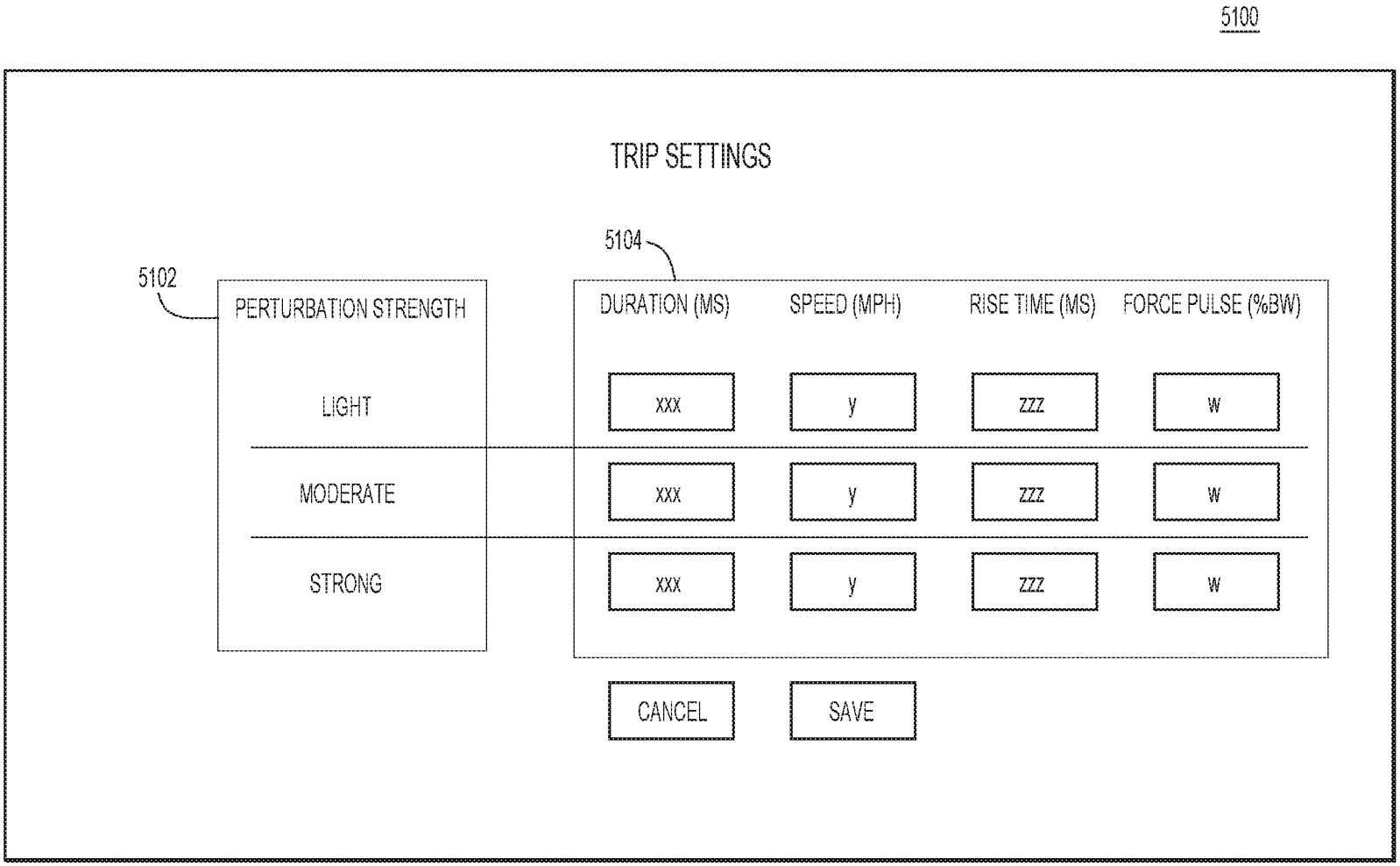
FIG. 51A is a third user interface for a dynamic body-weight support system providing gait training via perturbations, according to example embodiments.

With reference now made to FIG. 51A, depicted therein is a user interface 5100 that allows an operator or therapist to input the settings for the predetermined perturbation strength settings of "LIGHT," "MODERATE" and "STRONG" as discussed above with reference to FIG. 49A. The user interface 5100 allows the operator or therapist to set values for the duration of the perturbation, the speed of the trolley for the perturbation, the rise time for the perturbation and the force pulse for the perturbation, which will be discussed in greater detail below. The ability to change the force of the perturbation allows the system to push the patients to the limits of their stability, while the body weight tracking and support features described above allow the patients to reach or surpass these limits (resulting in a fall or stumble) while allowing the patient to feel safe, knowing the body weight support system will catch them if a fall is detected. The perturbations may also be varied to assess how stable a patient is (e.g., evaluate the patient's risk of falling) and also to train the patient over time with increasing perturbations such that the patient may improve their ability to resist perturbations.

User interface 5100 includes perturbation strength portion 5102 and perturbation value section 5104. According to the specific example embodiment of user interface 5100, the operator may set the perturbation duration, the speed of the trolley during the perturbation, the rise time for the perturbation force to reach its desired maximum, and the perturbation force pulse as a function of the patient's body weight.

Figure 51B:
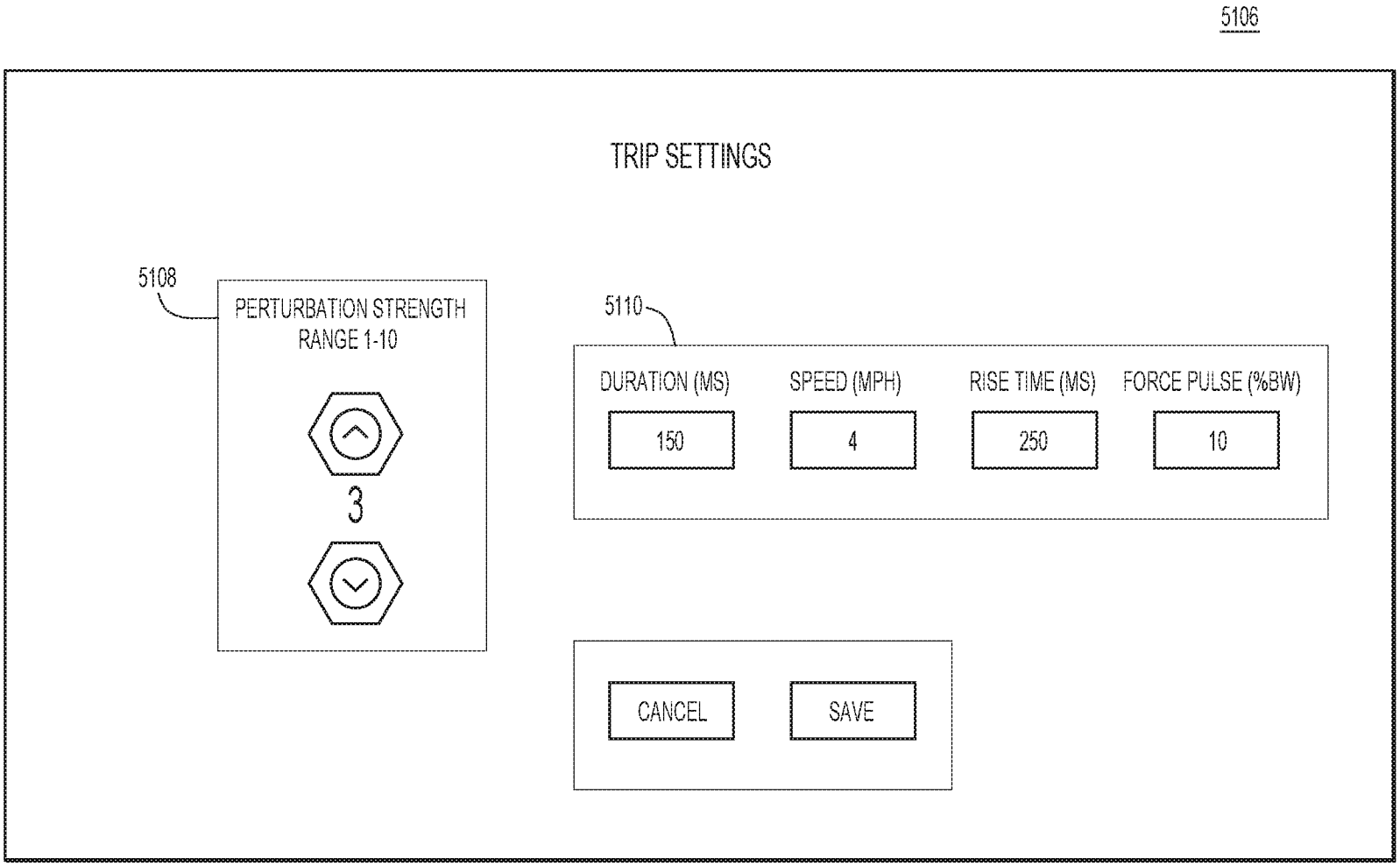
FIG. 51B is a fourth user interface for a dynamic body-weight support system providing gait training via perturbations, according to example embodiments.

With reference now made to FIG. 51B, depicted therein is a user interface 5106 that allows an operator or therapist to input the settings for the predetermined perturbation strength settings of 1 through 10. Accordingly, perturbation strength portion 5108 is analogous to perturbation strength portion 5102 of FIG. 51A, and perturbation value section 5110 is analogous to perturbation value section 5104 of FIG. 51A.

Figure 52:
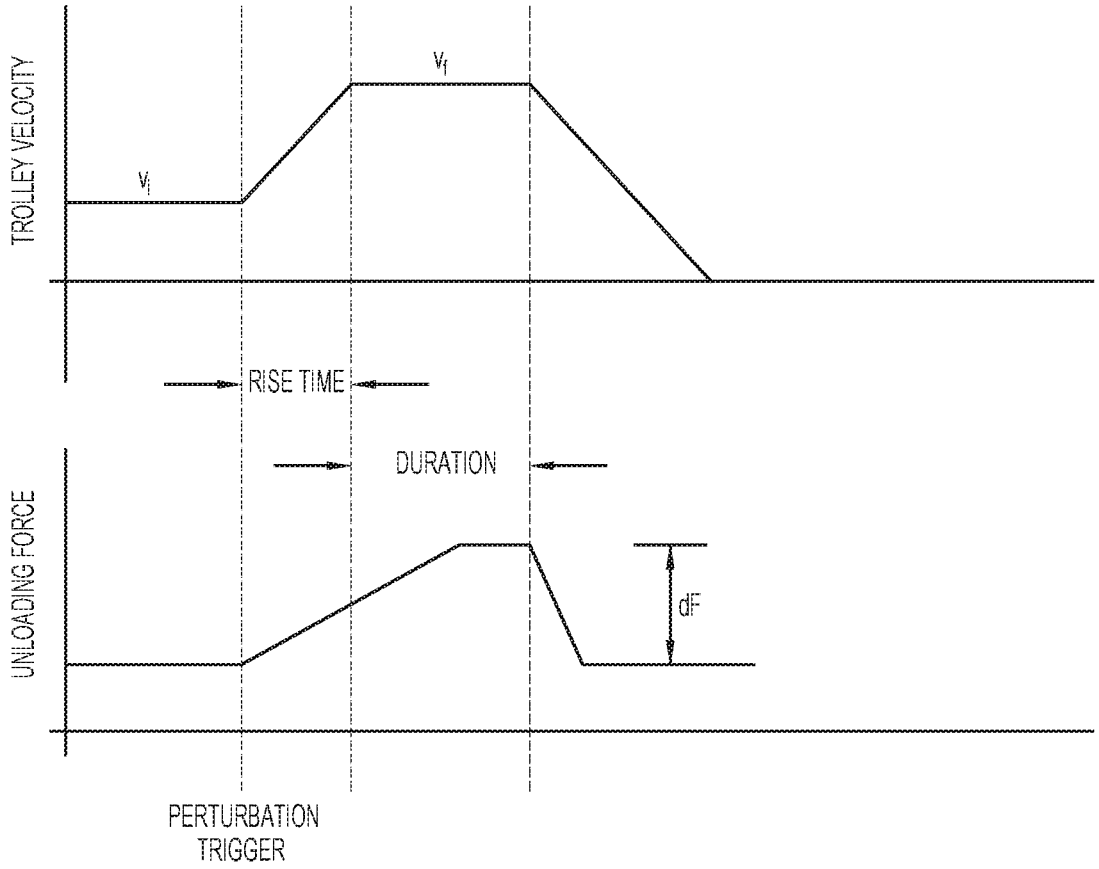
FIG. 52 provides first graphical representations of trolley velocity and unloading force for a dynamic body-weight support system providing gait training via perturbations, according to example embodiments.

With reference now made to FIG. 52, depicted therein is a graph of the trolley velocity and the associated unloading force provided by the system 10 of FIG. 2 before, during and after applying a perturbation to a patient or subject, according to the techniques of the present disclosure. Specifically, FIG. 52 depicts the trolley velocity and unloading forces for an assistive perturbation, i.e., a perturbation whose force is in the same direction as the walking or ambulation of the patient. The basic sequence for a perturbation is shown in FIG. 52, which begins with the patient walking at speed $V_i$. Under normal body weight support operation of the body weight support system, the trolley would also move at $V_i$, staying substantially directly above the patient. Furthermore, the unloading force provided by the trolley may be sufficient to support the patient for body support operations, and therefore, may be a force of approximately 75% of the body weight of the subject or patient. According to other example embodiments, the initial unloading force provided by the trolley may be large enough to only track the location of the patient, or the initial unloading force may be essentially zero.

When the perturbation is initiated (e.g., the perturbation trigger button is manually pressed in the software by the therapist, or according to other example embodiments, the perturbation is initiated automatically by the software in response to, for example, a particular point in the patient's gate), the trolley speed will increase from Vi to $V_f$ in a time period denoted 'Rise Time'. The trolley will continue at speed $V_f$ for a period of time (specified by "duration"). The trolley accelerates to $V_f$ so that it is no longer directed above the patient when the unloading force provided by the body weight support system is increased. If the trolley is directly above the patient when the unloading force is increase, the increased force will simply lift the patient upwards. By accelerating the trolley out in front of the patient (or behind the patient for the resistive perturbation described below), the increase in unloading force will pull the patient along his or her direction of motion (or opposite his or her direction of motion for the resistive perturbation described below). As the trolley accelerates, the trolley may extend the length of the support rope slightly to accommodate the relative position change between the patient and the trolley in order to maintain the unloading force constant, at least initially.

In response to the trolley speed increasing, the level of body-weight support will also be increased by dF. An increase in force may be used to enhance the perturbation effects. For some situations, the best perturbation is delivered when the rate of rope tension increases at ½ the rate of the speed increase. Because the trolley is ahead of the patient due to the increase in velocity to $V_f$, the increase in unloading force dF will induce a horizontal force, i.e., the perturbation on the patient.

After the perturbation is applied, the trolley will then slow down to 0 in/sec. The body weight support system will then automatically switch back into Trolley Tracking mode and resume following the subject's movement. While the graph of FIG. 52 ends with the trolley having zero velocity, because the trolley has switched back into trolley tracking mode, the trolley may begin moving with the patient if the patient has not fallen and continues walking or ambulating.

The graphs of FIG. 52 may also apply to perturbations applied to a stationary patient, i.e., static perturbations. According to such examples, $V_i$ would be 0 for the patient.

Figure 53:
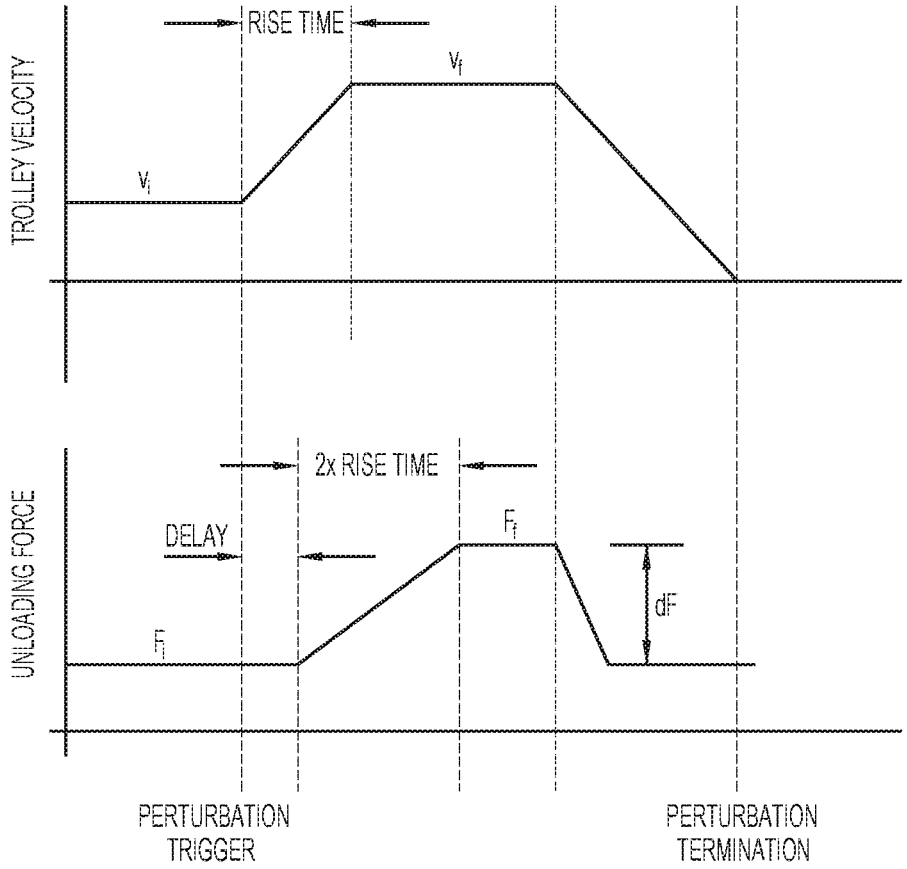
FIG. 53 provides second graphical representations of trolley velocity and unloading force for a dynamic body-weight support system providing gait training via perturbations, according to example embodiments.

FIG. 53 is similar to that of FIG. 52, except it illustrates that it may be beneficial to delay the increase in the unloading force by a predetermined period of time after the trolley begins its acceleration from $V_i$ to $V_f$. The delay illustrated in FIG. 53 allows the trolley to move sufficiently ahead of the patient prior to increasing the unloading force on the patient. During the delay, the trolley may extend the length of the support rope slightly to accommodate the relative position change between the patient and the trolley in order to maintain a constant unloading force, at least initially. While the graph of FIG. 53 ends with the trolley having zero velocity, because the trolley has switched back into trolley tracking mode, the trolley may begin moving with the patient if the patient has not fallen and continues walking or ambulating.

Figure 54:
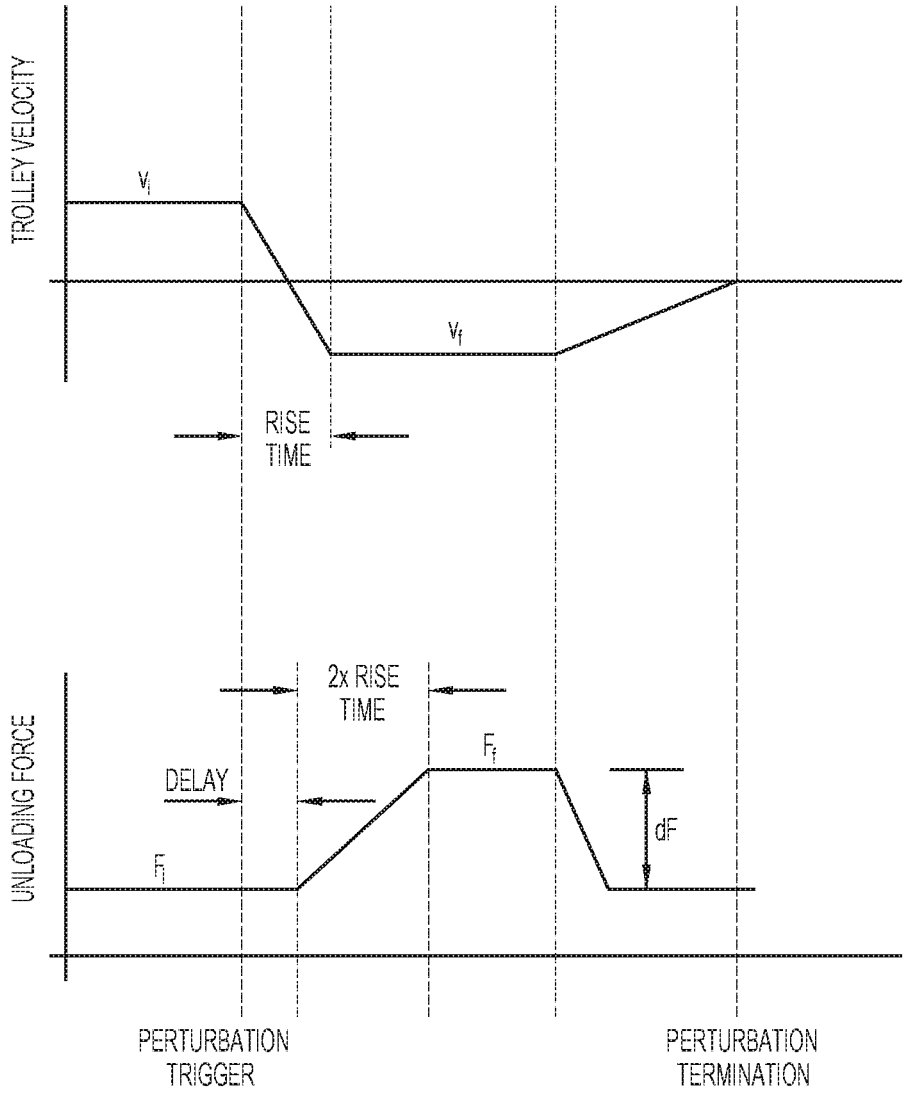
FIG. 54 provides third graphical representations of trolley velocity and unloading force for a dynamic body-weight support system providing gait training via perturbations, according to example embodiments.

FIG. 54 is similar to that of FIG. 53, but it illustrates the trolley velocity and unloading force for a resistive perturbation, i.e., a perturbation whose force is in the opposite direction of the patient's walking or ambulation. As illustrated in FIG. 54, the trolley initially moves at a velocity $V_i$ in the same direction as the patient. The trolley then begins decelerating so that is may change direction and begin moving in a direction opposite to that of the patient. As velocity is a vector, i.e., a value with both a magnitude and direction, the change in direction is illustrated in FIG. 54 via the velocity graph passing through the x-axis (i.e., the point at which the trolley has no velocity as it changes direction) and continuing below the x-axis, representing velocity in the opposite direction to that of the initial value $V_i$. While the graph of FIG. 54 ends with the trolley having zero velocity, because the trolley has switched back into trolley tracking mode, the trolley may begin moving with the patient if the patient has not fallen and continues walking or ambulating.

Figure 55:
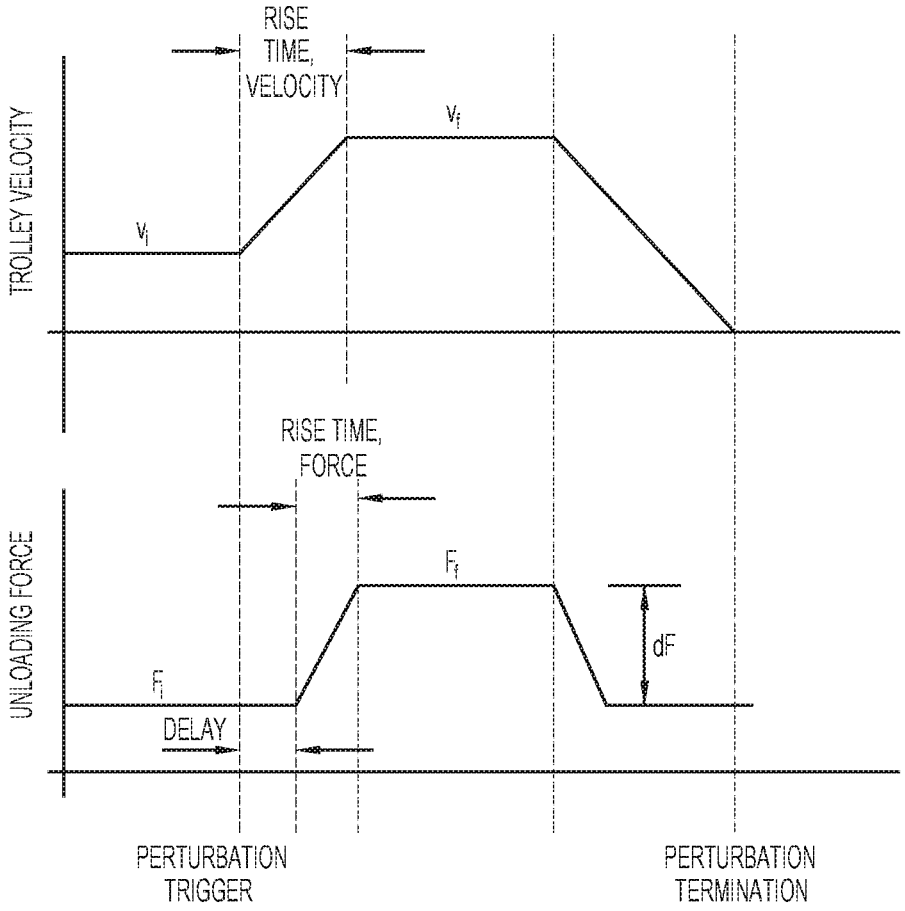
FIG. 55 provides fourth graphical representations of trolley velocity and unloading force for a dynamic body-weight support system providing gait training via perturbations, according to example embodiments.

FIG. 55 is an alternative embodiment of the assistive perturbations illustrated in FIGS. 52 and 53. Comparing the graphs of FIG. 55 with those of FIGS. 52 and 53 illustrates that the unloading force increases more rapidly in the example embodiment of FIG. 55 than it does in FIGS. 52 and 53. As shown in FIG. 55, the unloading force reaches a maximum value $F_f$ at essentially the same time that the trolley reaches speed $V_f$, the maximum speed of the trolley.

Figure 56:
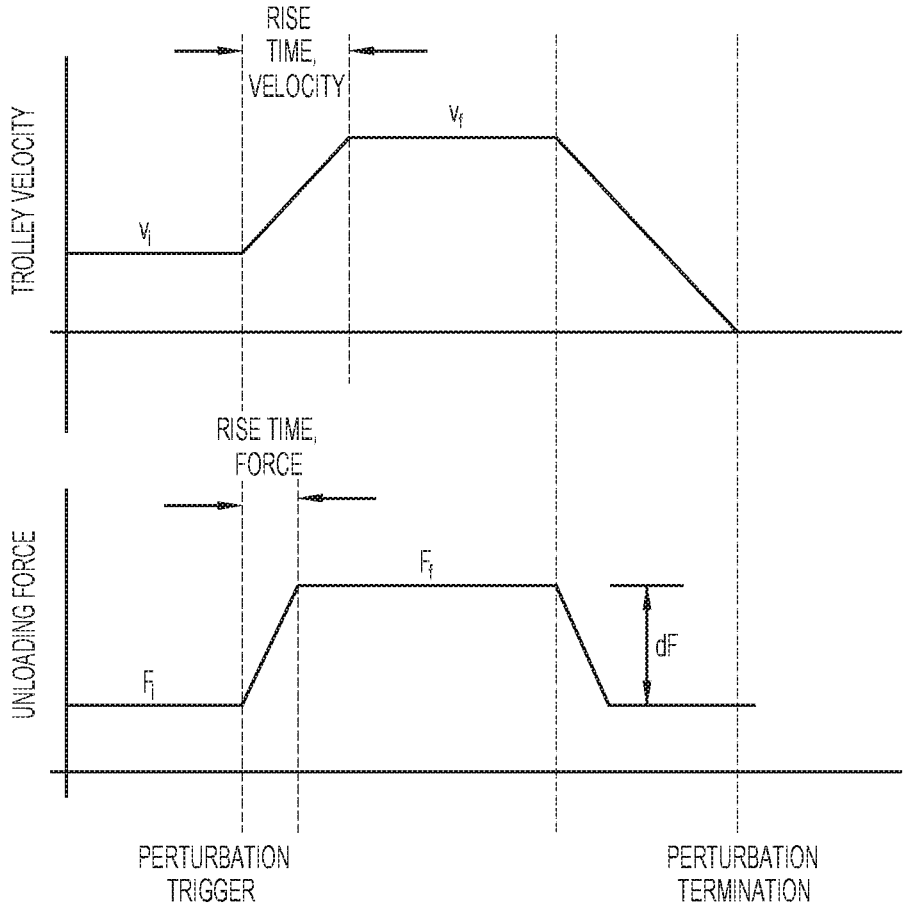
FIG. 56 provides fifth graphical representations of trolley velocity and unloading force for a dynamic body-weight support system providing gait training via perturbations, according to example embodiments.

FIG. 56, is another example embodiment in which the perturbation force rise time is less than that of the rise time for the velocity. Accordingly, the perturbation for reaches its maximum, $F_f$, prior to the velocity reaching its maximum value, $V_f$. As would be understood by the skilled artisan, the perturbation force rise time can be equal to, greater than or less than the velocity rise time. The skilled artisan would further understand that the initiation of the perturbation force may take place before, after or concurrently with the acceleration of the trolley (i.e., the change in velocity of the trolley).

Figure 57:
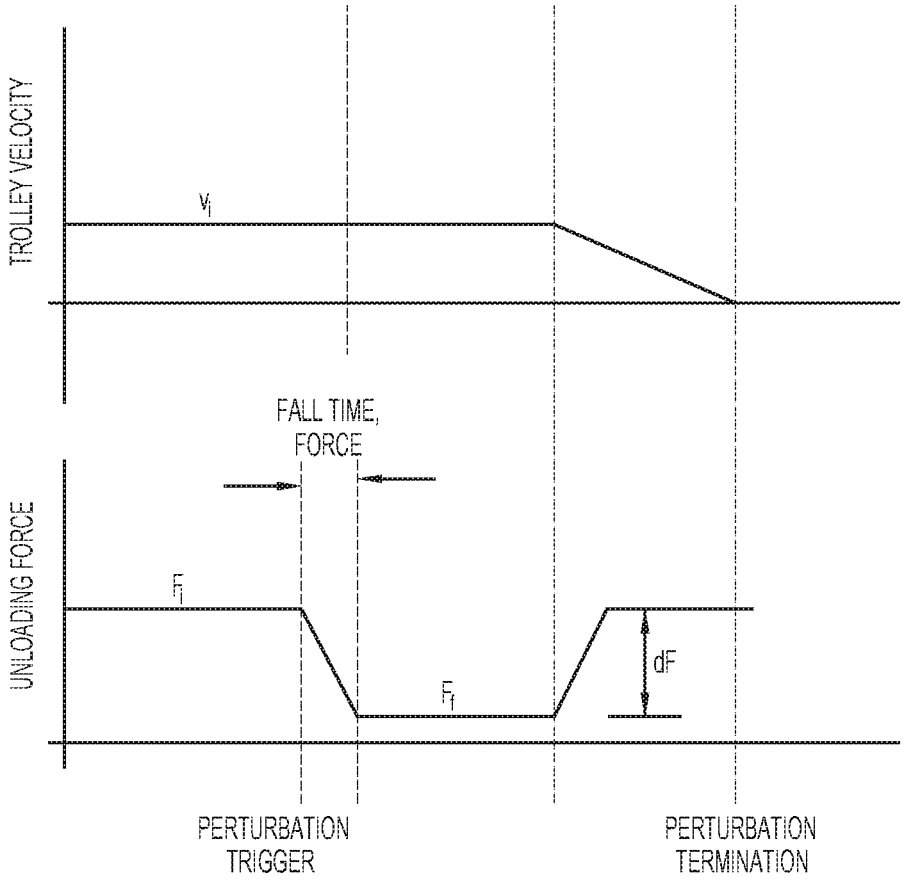
FIG. 57 provides graphical representations of trolley velocity and unloading force for a dynamic body-weight support system providing gait training via negative perturbations, according to example embodiments.

With reference now made to FIG. 57, depicted therein is an example embodiment in which a negative perturbation is applied to the patient or subject. As illustrated in FIG. 57, the trolley velocity begins at $V_i$, which would be the speed at which the patient or subject is ambulating during a dynamic perturbation, or zero for a static perturbation. The unloading force $F_i$ is a force sufficient to support the patient for body support operations, and therefore, may be a force of approximately 75% of the body weight of the subject or patient. When the perturbation is triggered, the unloading force drops to a force $F_f$, which is less than the force $F_i$, resulting in a negative perturbation. Therefore, dF in the present embodiment is negative, whereas dF in the embodiments of FIGS. 52-56 is positive. As illustrated in FIG. 57, the trolley does not accelerate relative to the patient or subject, remaining at velocity $V_i$ throughout the application of the negative perturbation (which as noted above may be zero in specific example embodiments). As with the example embodiments of FIGS. 52-56, upon completion of the perturbation, the trolley may switch back into patient tracking mode. Accordingly, the trolley may begin moving with the patient if the patient has not fallen, or the trolley may stop and catch the patient in the event the negative perturbation results in a fall.

While none of FIGS. 52-57 illustrate the unloading force that would be applied in response to a fall, if the body weight support system detects that a fall is occurring, then the unloading force may increase to, for example, 150% of patient's body-weight (i.e. their weight plus inertial effects) then the force may decrease to, for example, 75% of patient's body-weight (with the patient supporting the remaining 25% of their weight).

In the embodiments described above, the perturbation is initiated via the trolley accelerating such that the trolley is positioned ahead or behind (or to the left or right of) the patient. This positioning is established by setting a speed for the trolley that exceeds the velocity of the patient in the direction from which the perturbation is to be initiated. According to other example embodiments, the trolley may be moved to a position that is determined via an angular position relative to the patient. For example, the trolley may move ahead or behind the patient until the angle of the arm 66 of FIG. 2 is at or exceeds an angular threshold. Such an angular threshold may be set at or between 10° and 20°, though the inventive concepts of the present disclosure may include angles outside this range. In other words, the determination of when the perturbation is to be initiated is based upon the angle of arm 66 as opposed to a distance between the trolley and the patient or as opposed to a time after which the trolley accelerates. According to such an example embodiment, the parameter an operator or therapist may set for initiation of the perturbation would not be a rise time and/or trolley speed, as described above, but the angular value of arm 66 of FIG. 2.

According to still other example embodiments, arm 66 may be motorized such that it may move to selectable angular positions relative to the patient while the trolley remains positioned above the patient. The trolley may maintain a constant unloading force while remaining substantially above the patient while changing the angular position of arm 66 by, for example, increasing the length of rope 220. Upon the motorized arm reaching the predetermined angular position, the unloading force may be increased such that the horizontal component of the rope force is sufficient to cause a horizontal perturbation on the patient.

Discussed below are the parameters that may be set via a user or software (including the interfaces of FIGS. 51A and 51B) in accordance with the present disclosure. By setting these parameters, different trolley velocity and unloading force graphs (like those illustrated in FIGS. 52-57) may be achieved. In other words, the techniques of the present disclosure allow an operator to control a body weight support system to provide gait training via perturbations that meet the needs of specific patients or subjects.

A first parameter of gait training via perturbations is the duration of the perturbation. The duration of a perturbation may determine how long the perturbation remains on. For example, the duration of a perturbation may refer to the duration at which the trolley remains at $V_f$ in the examples of FIGS. 52-56. A second parameter of gait training via perturbations is the type of perturbation. The type of perturbation refers to whether the perturbation is static (i.e., the patient is stationary), the direction to which the force is applied in a static perturbation, whether the perturbation is dynamic (i.e., the patient is walking or ambulating) and whether the perturbation is resistive (i.e., opposite the direction of the patient's motion) or whether the perturbation is assistive (in the same direction as the patient's motion). Examples of the values for the type perturbation are included below.

- Perturbation in the direction of walking. As the subject is walking, the trolley will pull them in the direction of movement for the duration set by the duration parameter
- Perturbation opposite direction of walking. As the subject is walking, the trolley will pull them in the opposite direction for the duration set by the duration parameter.
- Perturbation towards the front of the system. As the subject is standing, the trolley will move in the direction of the front of the trolley for a duration set by the duration parameter.
- Perturbation towards the rear of the system. As the subject is standing, the trolley will move in the direction of the rear of trolley for a duration set by the duration parameter.

A third parameter, the speed of the perturbation, indicates how fast the trolley moves to initiate the perturbation. Depending on the example embodiment, this speed may be set relative to the track or relative to the patient.

A fourth parameter, the perturbation rise time, dictates how long it will take the trolley to accelerate from $V_i$ to $V_f$ as illustrated in, for example, FIGS. 52-56.

A fifth parameter, the perturbation force, refers to the increase in unloading force applied while, for example, the trolley moves at the velocity $V_f$ in FIGS. 52-56. The unloading force may be expressed as percent of the patient's body-weight. For example, a possible range for the perturbation force may be an increase of between 5% and 50% of the patient's or subject's body weight.

Figure 58:
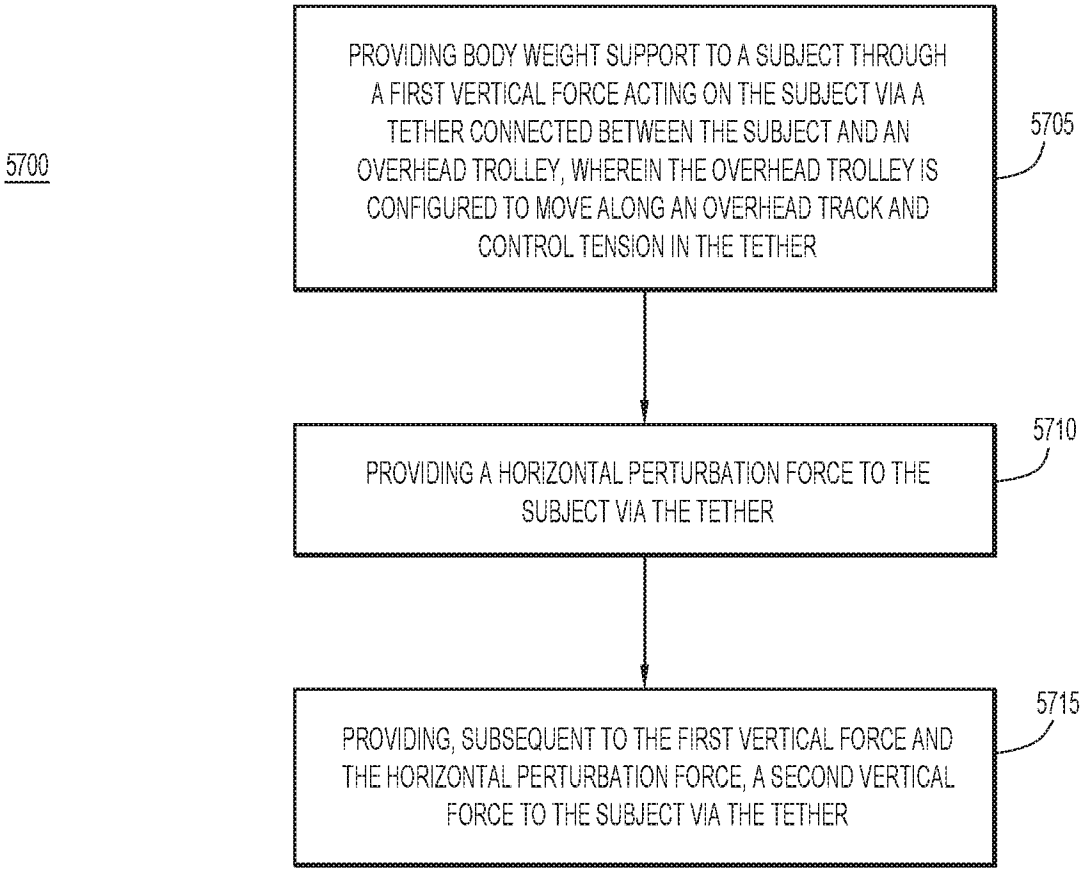
FIG. 58 is a flowchart illustrating process flow for implementing the gait training via perturbations techniques of the present disclosure, according to example embodiments.

With reference made to FIG. 58, depicted therein is a flowchart 5700 illustrating a process flow for implementing the gait training via perturbations techniques of the present disclosure. The process flow of flowchart 5700 begins in operation 5705 where body weight support is provided to a subject through a first vertical force acting thereon. According to the example embodiment of flowchart 5700, the first vertical force is provided by a tether, such as tether or rope 220 and trolley 30 of FIG. 2. The body weight support provided by operation 5705 may be static body weight support (i.e., support for the subject while the subject is stationary) or dynamic body weight support (i.e., support for the subject while the subject is ambulating).

As discussed above, example embodiments of the methods of the present disclosure may begin without initially providing body weight support to the subject. Instead, the trolley may only provide sufficient force to the subject via the tether to track the location of the subject. According to other example embodiments, the trolley may provide essentially no force to the subject via the tether when, for example, the subject has been instructed to remain stationary relative to the trolley. In such example embodiments, operation 5705 may be omitted without deviating from the techniques of the present disclosure.

In operation 5710, a horizontal perturbation force is provided to the subject via the tether. The horizontal perturbation may be applied by increasing the tension in the rope or tether 220, as described above with reference to FIGS. 19 and 20A, by accelerating the trolley relative to the subject, or through other techniques known to the skilled artisan. The timing of the perturbation force of operation 5710 relative to the motion and location of the trolley may be defined by the graphs illustrated in FIGS. 52-56, described above. Furthermore, the magnitude and direction of the perturbation force may be determined or set according to the techniques described above with reference to FIGS. 49A-51B.

In operation 5715, a second vertical force is provided to the subject via the tether subsequent to the first vertical force and the horizontal perturbation force. The second vertical force may be the re-initiation of body weight support if the horizontal perturbation force does not cause the patient or subject to fall. According to still other example embodiments, the second vertical force may only be a force sufficient to track the location of the patient relative to the trolley, but insufficient to provide body weight support to the patient. Accordingly to further example embodiments, the second vertical force may be a force sufficient to detect how quickly the patient is descending, if at all, in order to detect whether or not the subject has experienced a fall, but insufficient to arrest the fall. According to further example embodiments, the second vertical force may be a force sufficient to catch the patient or subject if the horizontal perturbation force results in a fall.

Figure 59:
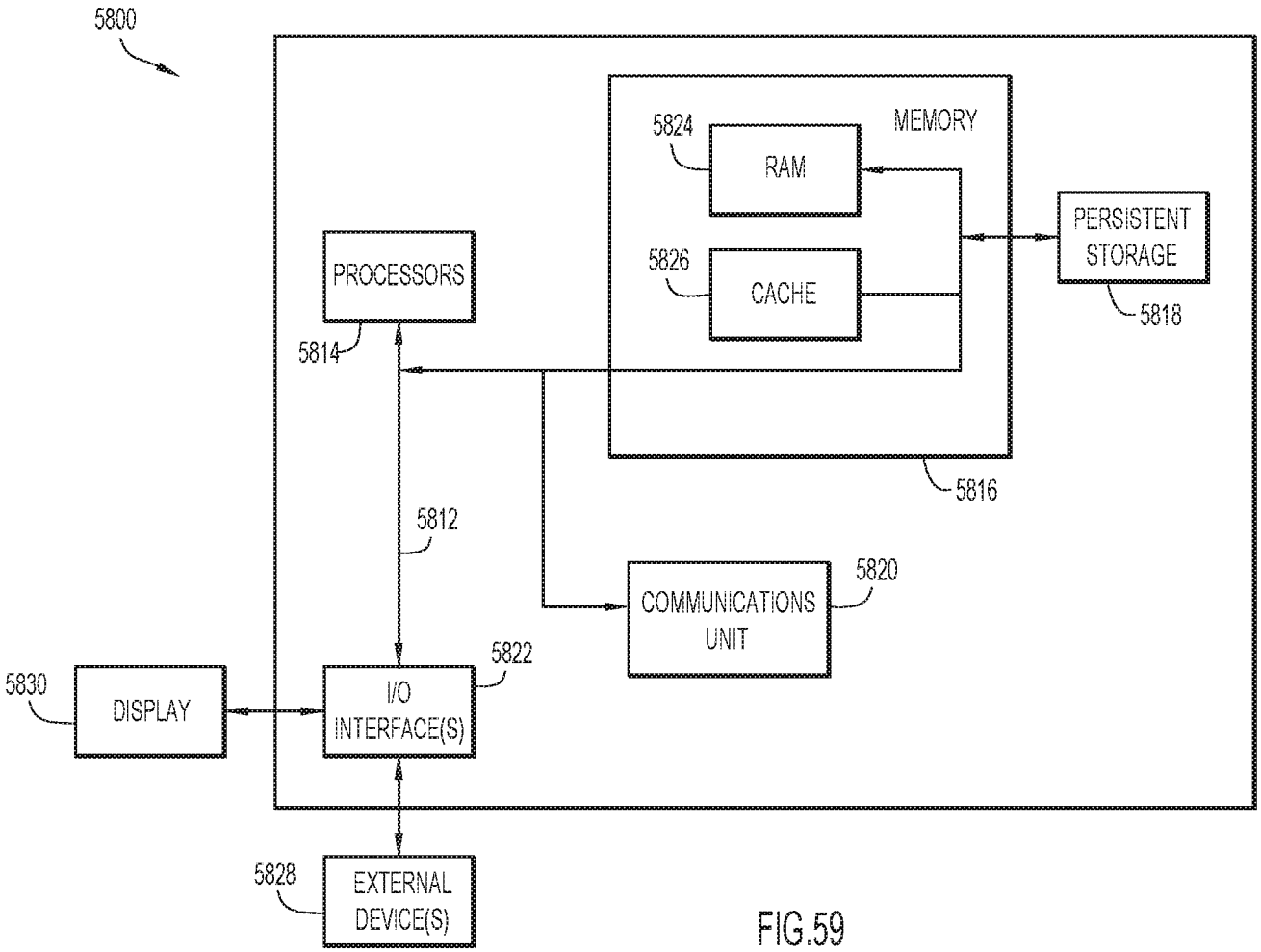
FIG. 59 is a block diagram of a computing device configured to implement the gait training via perturbations techniques of the present disclosure, according to example embodiments.

With reference now made to FIG. 59, illustrated therein is a hardware block diagram of an example device 5800 (e.g., a computing device that performs the operations of the devices disclosed herein, such as controller 510 of FIG. 25. For example, device 5800 may be embodied as a computer, smart device (e.g., a smart phone), or a tablet computing device configured to control a trolley (e.g., trolley 30 of FIG. 2) to carry out the gait training via perturbation techniques of the present disclosure. It should be appreciated that FIG. 59 provides only an illustration of one embodiment and does not imply any limitations with regard to the environments in which different embodiments may be implemented. Many modifications to the depicted environment may be made.

As depicted, the device 5800 includes a bus 5812, which provides communications between computer processor(s) 5814, memory 5816, persistent storage 5818, communications unit 5820, and Input/Output (I/O) interface(s) 5822. Bus 5812 can be implemented with any architecture designed for passing data and/or control information between processors (such as microprocessors, communications and network processors, etc.), system memory, peripheral devices, and any other hardware components within a system. For example, bus 5812 can be implemented with one or more buses.

Memory 5816 and persistent storage 5818 are computer readable storage media. In the depicted embodiment, memory 5816 includes Random Access Memory (RAM) 5824 and cache memory 5826. In general, memory 5816 can include any suitable volatile or non-volatile computer readable storage media. Instructions to implement the techniques of the present disclosure may be stored in memory 5816 or persistent storage 5818 for execution by computer processor (s) 5814.

One or more programs may be stored in persistent storage 5818 for execution by one or more of the respective computer processors 5814 via one or more memories of memory 5816. The persistent storage 5818 may be a magnetic hard disk drive, a solid state hard drive, a semiconductor storage device, Read-Only Memory (ROM), Erasable Programmable ROM (EPROM), Flash memory, or any other computer readable storage media that is capable of storing program instructions or digital information.

The media used by persistent storage 5818 may also be removable. For example, a removable hard drive may be used for persistent storage 5818. Other examples include optical and magnetic disks, thumb drives, and smart cards that are inserted into a drive for transfer onto another computer readable storage medium that is also part of persistent storage 5818.

Communications unit 5820, in these examples, provides for communications with other data processing systems or devices. In these examples, communications unit 5820 includes one or more network interface cards. Communications unit 5820 may provide communications through the use of either or both physical and wireless communications links.

I/O interface(s) 5822 allows for input and output of data with other devices that may be connected to device 5800. For example, I/O interface(s) 5822 may provide a connection to external devices 5828 such as a keyboard, keypad, a touch screen, and/or some other suitable input device. External devices 5828 can also include portable computer readable storage media such as database systems, thumb drives, portable optical or magnetic disks, and memory cards.

Software and data used to practice embodiments can be stored on such portable computer readable storage media and can be loaded onto persistent storage 5818 via I/O interface(s) 5822. I/O interface(s) 5822 may also connect to a display 5830. Display 5830 provides a mechanism to display data to a user and may be, for example, a computer monitor.

The programs described herein are identified based upon the application for which they are implemented in a specific embodiment. However, it should be appreciated that any particular program nomenclature herein is used merely for convenience, and thus the embodiments should not be limited to use solely in any specific application identified and/or implied by such nomenclature.

Data relating to operations described herein may be stored within any conventional or other data structures (e.g., files, arrays, lists, stacks, queues, records, etc.) and may be stored in any desired storage unit (e.g., database, data or other repositories, queue, etc.). The data transmitted between entities may include any desired format and arrangement, and may include any quantity of any types of fields of any size to store the data. The definition and data model for any datasets may indicate the overall structure in any desired fashion (e.g., computer-related languages, graphical representation, listing, etc.).

The present embodiments may employ any number of any type of user interface (e.g., Graphical User Interface (GUI), command-line, prompt, etc.) for obtaining or providing information, where the interface may include any information arranged in any fashion. The interface may include any number of any types of input or actuation mechanisms (e.g., buttons, icons, fields, boxes, links, etc.) disposed at any locations to enter/display information and initiate desired actions via any suitable input devices (e.g., mouse, keyboard, etc.). The interface screens may include any suitable actuators (e.g., links, tabs, etc.) to navigate between the screens in any fashion.

The environment of the present embodiments may include any number of computer or other processing systems (e.g., client or end-user systems, server systems, etc.) and databases or other repositories arranged in any desired fashion, where the present embodiments may be applied to any desired type of computing environment (e.g., cloud computing, client-server, network computing, mainframe, standalone systems, etc.). The computer or other processing systems employed by the present embodiments may be implemented by any number of any personal or other type of computer or processing system (e.g., desktop, laptop, Personal Digital Assistant (PDA), mobile devices, etc.), and may include any commercially available operating system and any combination of commercially available and custom software (e.g., machine learning software, etc.). These systems may include any types of monitors and input devices (e.g., keyboard, mouse, voice recognition, etc.) to enter and/or view information.

It is to be understood that the software of the present embodiments may be implemented in any desired computer language and could be developed by one of ordinary skill in the computer arts based on the functional descriptions contained in the specification and flow charts illustrated in the drawings. Further, any references herein of software performing various functions generally refer to computer systems or processors performing those functions under software control. The computer systems of the present embodiments may alternatively be implemented by any type of hardware and/or other processing circuitry.

The various functions of the computer or other processing systems may be distributed in any manner among any number of software and/or hardware modules or units, processing or computer systems and/or circuitry, where the computer or processing systems may be disposed locally or remotely of each other and communicate via any suitable communications medium (e.g., Local Area Network (LAN), Wide Area Network (WAN), Intranet, Internet, hardwire, modem connection, wireless, etc.). For example, the functions of the present embodiments may be distributed in any manner among the various end-user/client and server systems, and/or any other intermediary processing devices. The software and/or algorithms described above and illustrated in the flow charts may be modified in any manner that accomplishes the functions described herein.

In addition, the functions in the flow charts or description may be performed in any order that accomplishes a desired operation.

The software of the present embodiments may be available on a non-transitory computer useable medium (e.g., magnetic or optical mediums, magneto-optic mediums, floppy diskettes, Compact Disc ROM (CD-ROM), Digital Versatile Disk (DVD), memory devices, etc.) of a stationary or portable program product apparatus or device for use with stand-alone systems or systems connected by a network or other communications medium.

The communication network may be implemented by any number of any type of communications network (e.g., LAN, WAN, Internet, Intranet, Virtual Private Network (VPN), etc.). The computer or other processing systems of the present embodiments may include any conventional or other communications devices to communicate over the network via any conventional or other protocols. The computer or other processing systems may utilize any type of connection (e.g., wired, wireless, etc.) for access to the network. Local communication media may be implemented by any suitable communication media (e.g., LAN, hardwire, wireless link, Intranet, etc.).

Each of the elements described herein may couple to and/or interact with one another through interfaces and/or through any other suitable connection (wired or wireless) that provides a viable pathway for communications. Interconnections, interfaces, and variations thereof discussed herein may be utilized to provide connections among elements in a system and/or may be utilized to provide communications, interactions, operations, etc. among elements that may be directly or indirectly connected in the system. Any combination of interfaces can be provided for elements described herein in order to facilitate operations as discussed for various embodiments described herein.

The system may employ any number of any conventional or other databases, data stores or storage structures (e.g., files, databases, data structures, data or other repositories, etc.) to store information. The database system may be implemented by any number of any conventional or other databases, data stores or storage structures to store information. The database system may be included within or coupled to the server and/or client systems. The database systems and/or storage structures may be remote from or local to the computer or other processing systems, and may store any desired data.

The embodiments presented may be in various forms, such as a system, a method, and/or a computer program product at any possible technical detail level of integration. The computer program product may include a computer readable storage medium (or media) having computer readable program instructions thereon for causing a processor to carry out aspects presented herein.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a RAM, a ROM, EPROM, Flash memory, a Static RAM (SRAM), a portable CD-ROM, a DVD, a memory stick, a floppy disk, a mechanically encoded device, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a LAN, a WAN, and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present embodiments may be assembler instructions, Instruction-Set-Architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Python, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a LAN or a WAN, or the connection may be made to an external computer (for example, through the Internet using an Internet Service Provider). In some embodiments, electronic circuitry including, for example, programmable logic circuitry, Field-Programmable Gate Arrays (FPGA), or Programmable Logic Arrays (PLA) may execute the computer readable program instructions by utilizing state information of the computer readable program instructions to personalize the electronic circuitry, in order to perform aspects presented herein.

Aspects of the present embodiments are described herein with reference to flowchart illustrations and/or block diagrams of methods, apparatus (systems), and computer program products according to the embodiments. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments. In this regard, each block in the flowchart or block diagrams may represent a module, fragment, or portion of instructions, which comprises one or more executable instructions for implementing the specified logical function(s). In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the techniques of the present disclosure have been described in detail and with references to specific embodiments thereof, it will be apparent to one skilled in the art that various changes and modifications can be made therein without departing from the spirit and scope thereof. Thus, it is intended that the present disclosure covers these modifications and variations.

What is claimed is:

1. A method comprising:

connecting a subject to an overhead trolley via a tether connected between the subject and the overhead trolley, wherein the overhead trolley is configured to move along an overhead track and control tension in the tether;

providing a horizontal perturbation force to the subject via the tether; and providing, subsequent to the horizontal perturbation force, a first vertical force to the subject via the tether.

2. The method of claim 1, further comprising providing body weight support to the subject via a second vertical force acting on the subject via the tether, wherein providing the first vertical force comprises providing the first vertical force subsequent to the second vertical force and subsequent to the horizontal perturbation force.

3. The method according to claim 1, wherein providing the horizontal perturbation force comprises:

positioning the overhead trolley in a position offset from the subject in a horizontal direction; and increasing tension in the tether subsequent to positioning the overhead trolley in the position offset from the subject in the horizontal direction.

4. The method according to claim 1, wherein providing the horizontal perturbation force comprises increasing a velocity of the overhead trolley in a horizontal direction relative to a velocity of the subject.

5. The method according to claim 1, wherein providing the first vertical force comprises:

detecting that the subject is falling in response to the horizontal perturbation force; and increasing tension in the tether to arrest the falling.

6. The method according to claim 1, providing the first vertical force comprises:

positioning the overhead trolley overhead of the subject; and providing body weight support to the subject via the first vertical force.

7. The method of claim 1, further comprising:

receiving data from sensors worn by the subject during and subsequent to providing the horizontal perturbation force to the subject; and determining, from the data, a response of the subject to the horizontal perturbation force.

8. The method of claim 7, wherein determining the response of the subject to the horizontal perturbation force comprises determining that the subject experienced one or more of a fall or a recovery step.

9. The method of claim 8, further comprising evaluating the quality of the recovery step.

10. An apparatus comprising:

an overhead trolley, wherein the overhead trolley is configured to move along an overhead track;

a tether configured to connect between the overhead trolley and a subject, wherein the overhead trolley is configured to control tension in the tether; and a processor; wherein the processor is configured to:

control the overhead trolley to provide a horizontal perturbation force to the subject via the tether; and control the overhead trolley to provide, subsequent to the horizontal perturbation force, a first vertical force to the subject via the tether.

11. The apparatus according to claim 10, wherein the processor is configured to control the overhead trolley to provide body weight support to the subject via a second vertical force acting on the subject via the tether, and wherein the processor is configured to control the overhead trolley to provide the first vertical force by controlling the trolley to provide the first vertical force subsequent to the second vertical force and subsequent to the horizontal perturbation force.

12. The apparatus according to claim 10, wherein the processor is configured to control the overhead trolley to provide the horizontal perturbation force by:

controlling a position of the overhead trolley such that the overhead trolley is in a position offset from the subject in a horizontal direction; and controlling the overhead trolley to increase tension in the tether subsequent to positioning the overhead trolley in the position offset from the subject in the horizontal direction.

13. The apparatus according to claim 10, wherein the processor is configured to control the overhead trolley to provide the horizontal perturbation force by controlling the overhead trolley to increase a velocity of the overhead trolley in a horizontal direction relative to a velocity of the subject.

14. The apparatus according to claim 10, wherein the processor is configured to control the overhead trolley to provide the first vertical force by:

receiving data indicative of the subject falling in response to the horizontal perturbation force; and controlling the overhead trolley to increase tension in the tether to arrest the falling.

15. The apparatus according to claim 10, wherein the processor is configured to control the overhead trolley to provide the first vertical force by:

controlling the overhead trolley such the overhead trolley is in a position where the tether is substantially perpendicular to a surface on which the subject stands; and controlling the overhead trolley to provide body weight support to the subject via the first vertical force.

16. The apparatus according to claim 10, wherein the processor is configured to:

receive data from sensors worn by the subject during and subsequent to providing the horizontal perturbation force to the subject; and determine, from the data, a response of the subject to the horizontal perturbation force.

17. The apparatus according to claim 16, wherein the processor is configured to:

determine the response of the subject to the horizontal perturbation force by determining that the subject experienced one or more of a fall or a recovery step.

18. One or more non-transitory, computer readable mediums encoded with instructions, wherein the instructions, when executed by a processor, are operable to:

control an overhead trolley connected to a subject via a tether, to provide a horizontal perturbation force to the subject via the tether, wherein the tether is connected between the subject and the overhead trolley, and wherein the overhead trolley is configured to move along an overhead track and control tension in the tether; and control the overhead trolley to provide, subsequent to the horizontal perturbation force, a first vertical force to the subject via the tether.

19. The one or more non-transitory, computer readable mediums according to claim 18, wherein the instructions are operable to control the overhead trolley to provide body weight support to the subject via a second vertical force acting on the subject via the tether, and wherein the instructions are operable to control the overhead trolley to provide the first vertical force by controlling the trolley to provide the first vertical force subsequent to the second vertical force and subsequent to the horizontal perturbation force.

20. The one or more non-transitory, computer readable mediums according to claim 18, wherein the instructions are operable to control the overhead trolley to provide the horizontal perturbation force by:

controlling the overhead trolley such that the overhead trolley is in a position offset from the subject in a horizontal direction; and controlling the overhead trolley to increase tension in the tether subsequent to positioning the overhead trolley in the position offset from the subject in the horizontal direction.

* * * * *